US010186763B2

(12) United States Patent
Niihara et al.

(10) Patent No.: US 10,186,763 B2
(45) Date of Patent: Jan. 22, 2019

(54) VEHICLE-MOUNTED ANTENNA DEVICE

(71) Applicant: FUJIKURA LTD., Tokyo (JP)

(72) Inventors: Yoshihiro Niihara, Sakura (JP); Yuichiro Yamaguchi, Sakura (JP); Hiroshi Chiba, Tokyo (JP); Ning Guan, Sakura (JP); Hiroiku Tayama, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 15/509,138

(22) PCT Filed: Feb. 4, 2016

(86) PCT No.: PCT/JP2016/053432
§ 371 (c)(1),
(2) Date: Mar. 6, 2017

(87) PCT Pub. No.: WO2016/125876
PCT Pub. Date: Aug. 11, 2016

(65) Prior Publication Data

US 2017/0301981 A1 Oct. 19, 2017

(30) Foreign Application Priority Data

Feb. 5, 2015 (JP) ..... 2015-021644
Feb. 24, 2015 (JP) ..... 2015-034475
(Continued)

(51) Int. Cl.
*H01Q 1/32* (2006.01)
*H01Q 1/36* (2006.01)
(Continued)

(52) U.S. Cl.
CPC ..... *H01Q 1/3275* (2013.01); *H01Q 1/36* (2013.01); *H01Q 1/38* (2013.01); *H01Q 7/00* (2013.01);
(Continued)

(58) Field of Classification Search
CPC ..... H01Q 1/3275; H01Q 1/22; H01Q 7/00; H01Q 9/16; H01Q 9/28; H01Q 9/295; H01Q 9/42
See application file for complete search history.

(56) References Cited

U.S. PATENT DOCUMENTS 5,177,493 A * 1/1993 Kawamura ..... H01Q 1/1278 343/713
2001/0048398 A1* 12/2001 Nilsson ..... H01Q 1/3275 343/713
(Continued)

FOREIGN PATENT DOCUMENTS

JP 63-114502 U 7/1988
JP 2-79607 U 6/1990
(Continued)

OTHER PUBLICATIONS

Extended European Search Report dated Jan. 9, 2018, issued in counterpart Application No. 16746707.5 (9 pages).
(Continued)

*Primary Examiner* — Hoang V Nguyen
(74) *Attorney, Agent, or Firm* — Westerman, Hattori, Daniels & Adrian, LLP

(57) ABSTRACT

In an on-vehicle antenna device (1), an on-vehicle antenna device (10) which is provided at an end part of a roof (20) includes an antenna (11) which has antenna elements (14, 15) drawn out from one feed point (13*a*) in a first direction and drawn out from another feed point (13*b*) in a second direction. The first direction is direction intersecting with a
(Continued)

horizontal plane in accordance with the on-vehicle antenna device (10) is mounted on a vehicle body (1).

13 Claims, 35 Drawing Sheets

(30) Foreign Application Priority Data

| | | |
|---|---|---|
| Apr. 15, 2015 | (JP) | 2015-083421 |
| Jun. 26, 2015 | (JP) | 2015-129117 |
| Aug. 7, 2015 | (JP) | 2015-157539 |
| Feb. 4, 2016 | (JP) | 2016-020333 |

(51) Int. Cl.

| | |
|---|---|
| ***H01Q 1/38*** | (2006.01) |
| ***H01Q 7/00*** | (2006.01) |
| ***H01Q 9/28*** | (2006.01) |
| *H01Q 9/16* | (2006.01) |
| *H01Q 9/42* | (2006.01) |

(52) U.S. Cl.
CPC ..... *H01Q 9/28* (2013.01); *H01Q 9/285* (2013.01); *H01Q 9/16* (2013.01); *H01Q 9/42* (2013.01)

(56) References Cited

U.S. PATENT DOCUMENTS

| | | | |
|---|---|---|---|
| 2004/0169608 | A1 | 9/2004 | Sampo et al. |
| 2004/0217906 | A1 | 11/2004 | Ishibayashi et al. |

FOREIGN PATENT DOCUMENTS

| | | | |
|---|---|---|---|
| JP | 2-116106 | | 9/1990 |
| JP | 6-42339 | U | 6/1994 |
| JP | 11-68438 | A | 3/1999 |
| JP | 2004-32312 | A | 1/2004 |
| JP | 2004-179790 | A | 6/2004 |
| JP | 2008-283609 | A | 11/2008 |

OTHER PUBLICATIONS

International Search Report dated Mar. 1, 2016, issued in counterpart International Application No. PCT/JP2016/053432 (2 pages).
Notification of Reasons for Refusal dated Jul. 24, 2018, issued in counterpart Japanese Application No. 2015-129117, with English translation. (5 pages).
Decision to Grant a Patent dated Jul. 24, 2018, issued in counterpart Japanese Application No. 2015-083421, with English translation. (3 pages).
Decision to Grant a Patent dated Nov. 20, 2018, issued in counterpart Japanese Application No. 2015-129117, with English translation. (3 pages).

* cited by examiner

VEHICLE-MOUNTED ANTENNA DEVICE

TECHNICAL FIELD

The present invention relates to an on-vehicle antenna device which is to be provided at an end part of a roof of a vehicle body.

BACKGROUND ART

As an on-vehicle antenna device, an antenna device is known in which an antenna is incorporated into a spoiler that is provided at a rear end of a roof of a vehicle body, as disclosed in Cited Document 1. In the on-vehicle antenna device disclosed in Cited Document 1, an antenna element of a digital television antenna and an antenna element of a radio antenna are horizontally incorporated into a spoiler that is attached to a vehicle body.

CITATION LIST

Patent Literature

[Patent Literature 1]

Japanese Patent Application Publication Tokukai No. 2008-283609 (Publication date: Nov. 20, 2008)

SUMMARY OF INVENTION

Technical Problem

However, an antenna structure of the on-vehicle antenna device disclosed in Patent Literature 1 has a problem that a radiant gain to a front of the vehicle body is small.

The present invention is accomplished in view of the problem, and its object is to provide an on-vehicle antenna device which can achieve a radiant gain in a direction across a roof is greater than that of a conventional technique in a case where the on-vehicle antenna device is mounted at an end part of the roof of the vehicle body.

Solution to Problem

In order to attain the object, the on-vehicle antenna device in accordance with an aspect of the present invention is an on-vehicle antenna device which is to be provided at an end part of a roof of a vehicle body, the on-vehicle antenna device including: an antenna having antenna elements which include a first antenna element and a second antenna element, the first antenna element being drawn out from one feed point of a pair of feed points in a first direction, and the second antenna element being drawn out from another feed point of the pair of feed points in a second direction which is different from the first direction; or an antenna having a single antenna element which is drawn out from one feed point of a pair of feed points in a first direction and is drawn out from another feed point of the pair of feed points in a second direction which is different from the first direction. The first direction is a direction intersecting with a horizontal plane in a case where the on-vehicle antenna device is mounted on the vehicle body.

Note that, in the antenna element, as long as the section including the one feed point is drawn out in the first direction and the section including the another feed point is drawn out in the second direction, an extending direction of the antenna element in sections other than those sections is not particularly limited. For example, in a case where the antenna is a dipole antenna, it is only necessary that a starting end of the first antenna element including the one feed point is drawn out in the first direction and a starting end of the second antenna element including the another feed point is drawn out in the second direction, and extending directions of a terminal end of the first antenna element and a terminal end of the second antenna element can be arbitrarily determined. For example, it is possible to employ any of (1) a configuration in which the terminal end of the first antenna element and the terminal end of the second antenna element extend in a forward direction of the vehicle body (see Embodiment 1 and Embodiment 3 described below), (2) a configuration in which the terminal end of the first antenna element extends in a rightward direction of the vehicle body and the terminal end of the second antenna element extends in a leftward direction of the vehicle body (see Embodiment 2 described below), and (3) a configuration in which the terminal end of the first antenna element extends in the forward direction of the vehicle body and the terminal end of the second antenna element extends in a backward direction of the vehicle body (see Embodiment 4 described below).

In order to attain the object, the on-vehicle antenna device in accordance with an aspect of the present invention is an on-vehicle antenna device which is to be provided at an end part of a roof of a vehicle body, the on-vehicle antenna device including: an antenna having a first antenna element and a second antenna element, the first antenna element being drawn out from one feed point of a pair of feed points in a first direction which intersects with a horizontal plane in a case where the on-vehicle antenna device is mounted on the vehicle body, and the second antenna element being drawn out from another feed point of the pair of feed points in a second direction which goes along the horizontal plane in a case where the on-vehicle antenna device is mounted on the vehicle body. The second antenna element includes an overlapping section which (i) lies along a metallic member constituting the end part of the roof, (ii) overlaps with the metallic member while being apart from the metallic member, and (iii) includes an end of the second antenna element, and a length of the overlapping section is 64.5% or less of a total length of the second antenna element.

In order to attain the object, the on-vehicle antenna device in accordance with an aspect of the present invention is an on-vehicle antenna device which is to be mounted at an end part of a roof of a vehicle body, the on-vehicle antenna device including: an antenna having an antenna element which includes a first antenna element and a second antenna element, the first antenna element being drawn out from one feed point of a pair of feed points in a first direction which intersects with a horizontal plane in a case where the on-vehicle antenna device is mounted on the vehicle body, and the second antenna element being drawn out from another feed point of the pair of feed points in a second direction which is different from the first direction in a case where the on-vehicle antenna device is mounted on the vehicle body. In a case where the on-vehicle antenna device is mounted on the vehicle body, a location of the antenna element in the on-vehicle antenna device is determined such that: (1) at least part of the antenna element lies along a metallic member constituting the end part of the roof and overlaps with the metallic member while being apart from the metallic member, and (2) a shortest distance from a structure, which is made of metal, is electrically connected with the end part of the roof, and extends in a direction intersecting with the horizontal plane, to the antenna element becomes ⅓ or more and ⅔ or less of a wavelength of a center frequency in an operating band of the antenna element.

Advantageous Effects of Invention

According to the present invention, it is possible to provide the on-vehicle antenna device which can achieve a greater radiant gain in the direction across the roof, as compared with a conventional technique.

BRIEF DESCRIPTION OF DRAWINGS (a) of FIG. 1 is a perspective view illustrating an appearance of a vehicle body on which an on-vehicle antenna device in accordance with Embodiment 1 of the present invention is mounted, and (b) of FIG. 1 is a partially-magnified plan view illustrating the vehicle body on which the on-vehicle antenna device is mounted.

(a) of FIG. 2 is a partially-magnified cross-sectional view which is taken along the line A-A' in (b) of FIG. 1 and illustrates the vehicle body on which the on-vehicle antenna device is mounted. (b) of FIG. 2 is a development view illustrating an antenna included in the on-vehicle antenna device.

(a) of FIG. 3 is a partially-magnified plan view illustrating a vehicle body on which an on-vehicle antenna device in accordance with Embodiment 2 is mounted. (b) of FIG. 3 is a partially-magnified cross-sectional view which is taken along the line L-L' in (a) of FIG. 3 and illustrates the vehicle body on which the on-vehicle antenna device is mounted.

(a) of FIG. 4 is a cross-sectional view illustrating a vehicle body on which an on-vehicle antenna device in accordance with Embodiment 3 of the present invention is mounted. (b) of FIG. 4 is a development view illustrating an antenna included in the on-vehicle antenna device.

(a) of FIG. 5 is a partially-magnified cross-sectional view illustrating a vehicle body on which an on-vehicle antenna device in accordance with Embodiment 4 is mounted. (b) of FIG. 5 is a development view illustrating an antenna included in the on-vehicle antenna device.

(a) of FIG. 6 is a development view illustrating an antenna in accordance with Modified Example 1 of the present invention, and (b) of FIG. 6 is a lateral view illustrating the antenna. (c) of FIG. 6 is a development view illustrating an antenna in accordance with Modified Example 2 of the present invention, and (d) of FIG. 6 is a lateral view illustrating the antenna.

Figure 17:
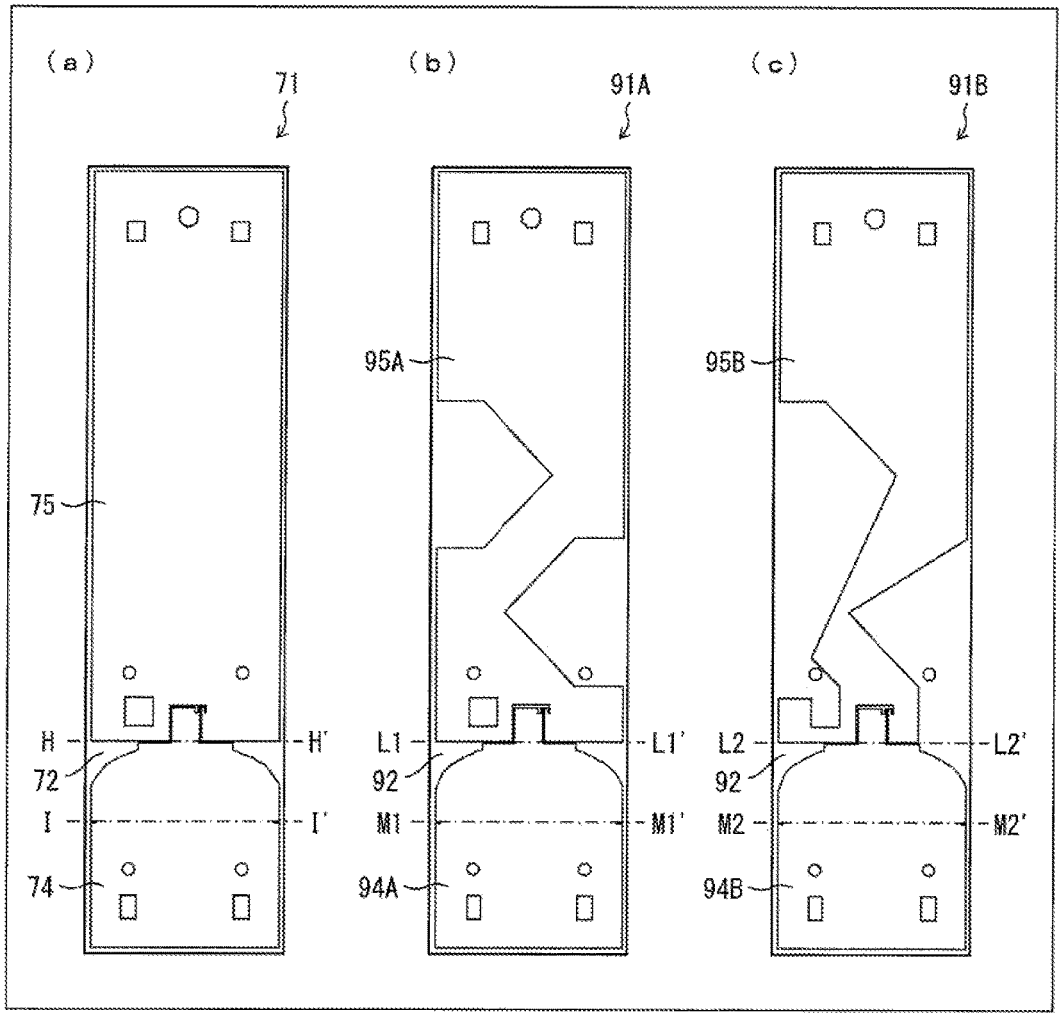

(a) through (c) of FIG. 17 are development views illustrating flatly-developed antennas which are respectively included in antenna devices in accordance with Examples 5 through 7.

Figure 18:
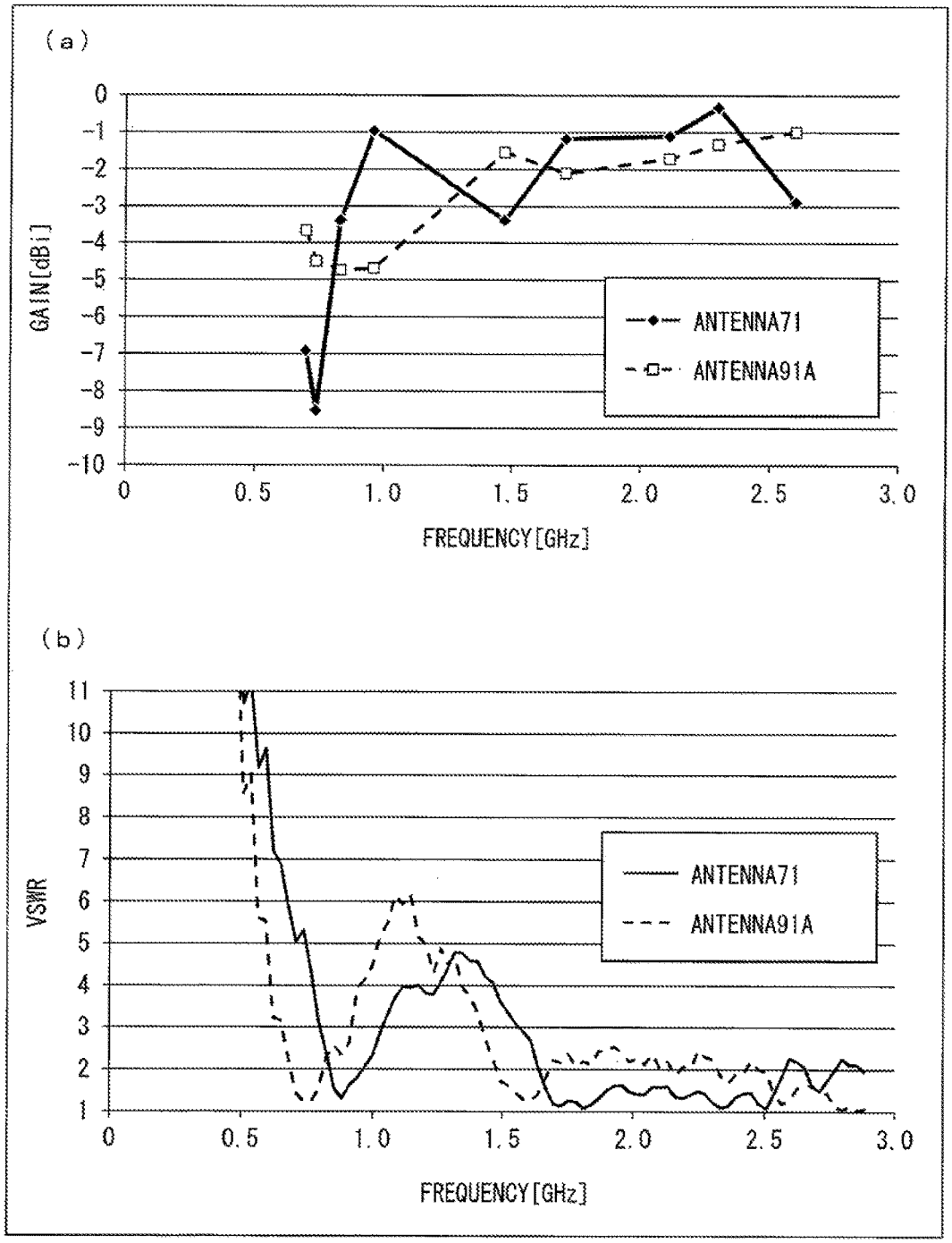

(a) of FIG. 18 is a graph showing frequency dependency of radiant gains of antenna devices in accordance with Examples 5 and 6. (b) of FIG. 18 is a graph showing frequency dependency of VSWRs of the antenna devices in accordance with Examples 5 and 6.

Figure 19:
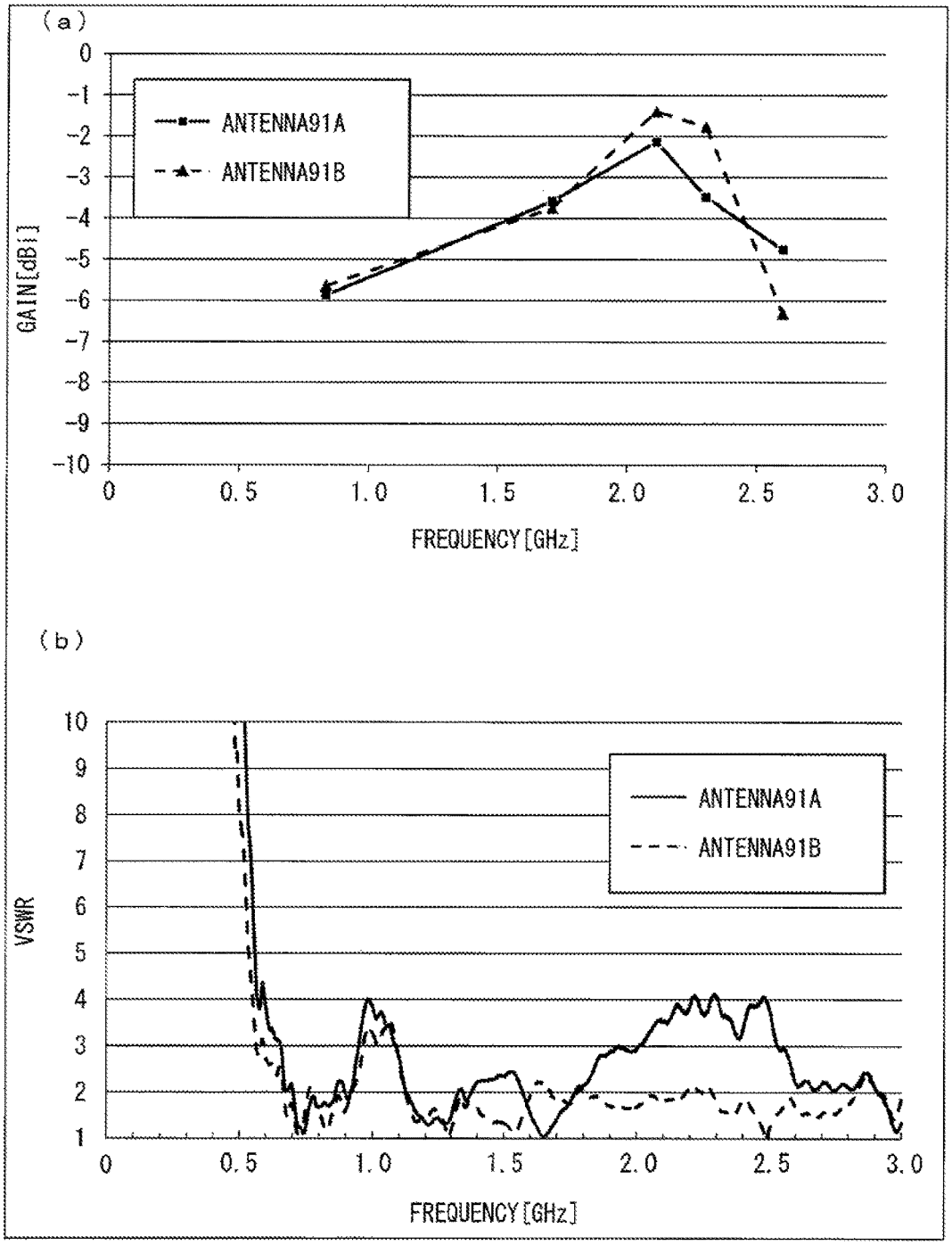

(a) of FIG. 19 is a graph showing frequency dependency of radiant gains of antenna devices in accordance with Examples 6 and 7. (b) of FIG. 19 is a graph showing frequency dependency of VSWRs of the antenna devices in accordance with Examples 6 and 7.

Figure 7:
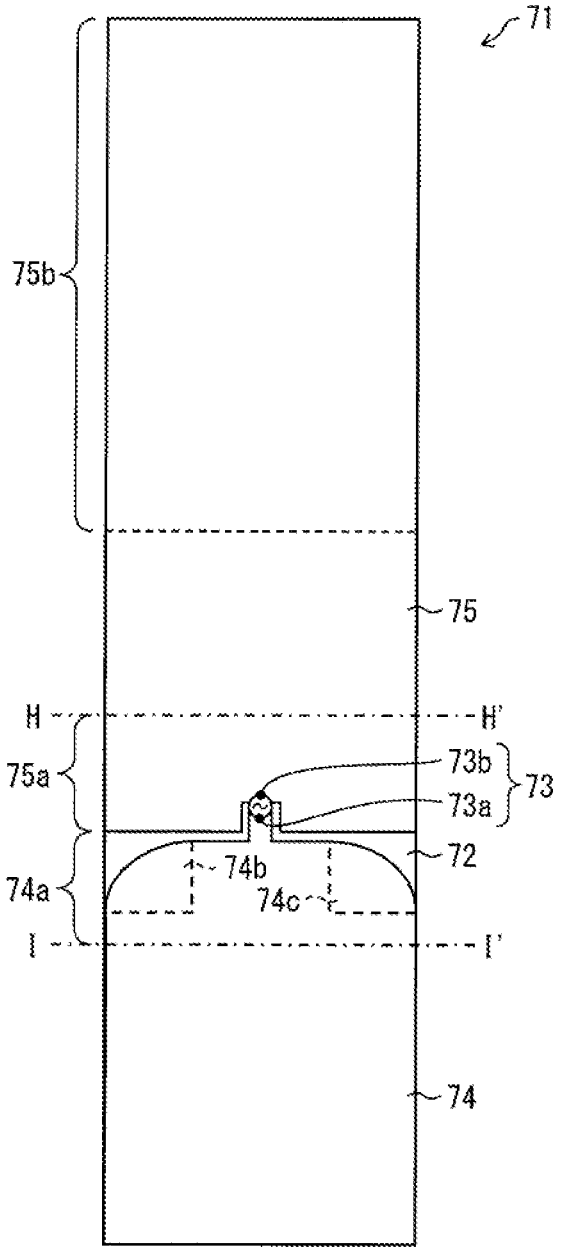
FIG. 7 is a development view illustrating an antenna in accordance with Modified Example 3.
Figure 20:
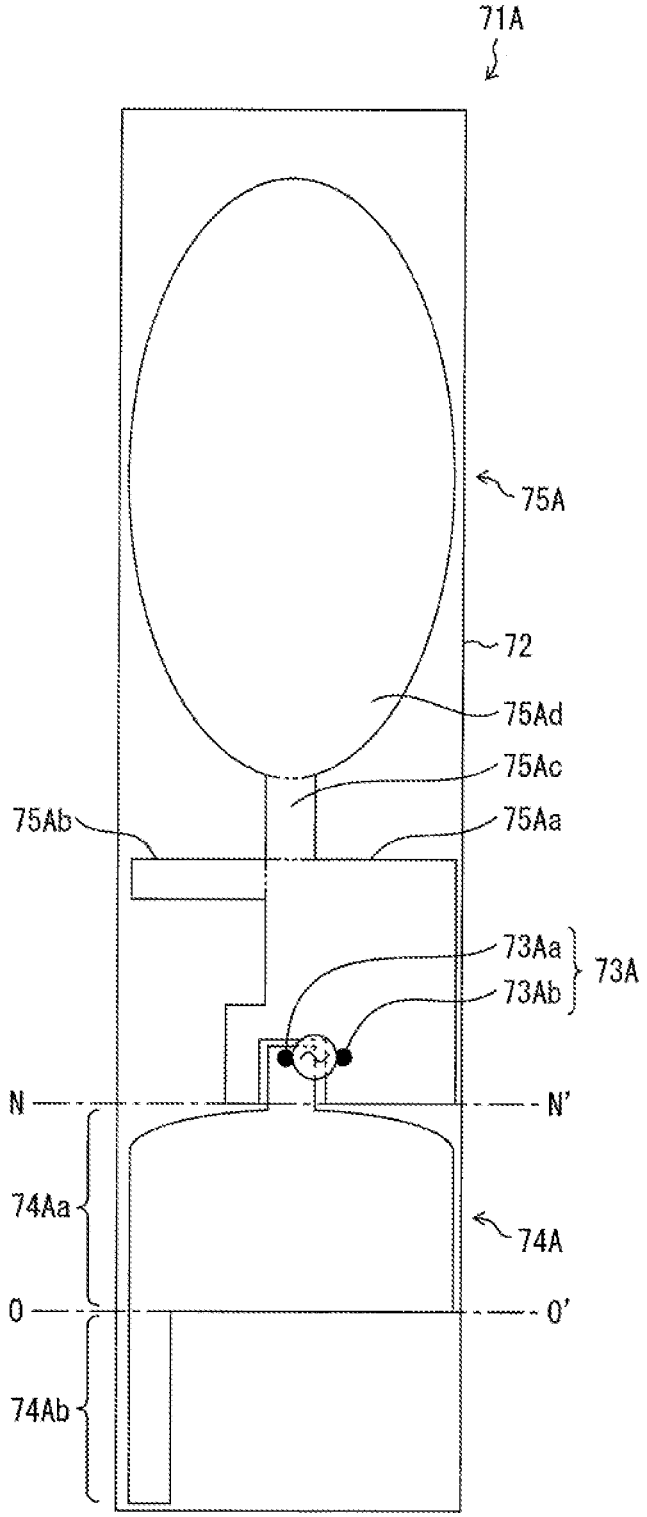

FIG. 20 is a development view illustrating a modified example of the flatly developed antenna illustrated in FIG. 7.

Figure 21:
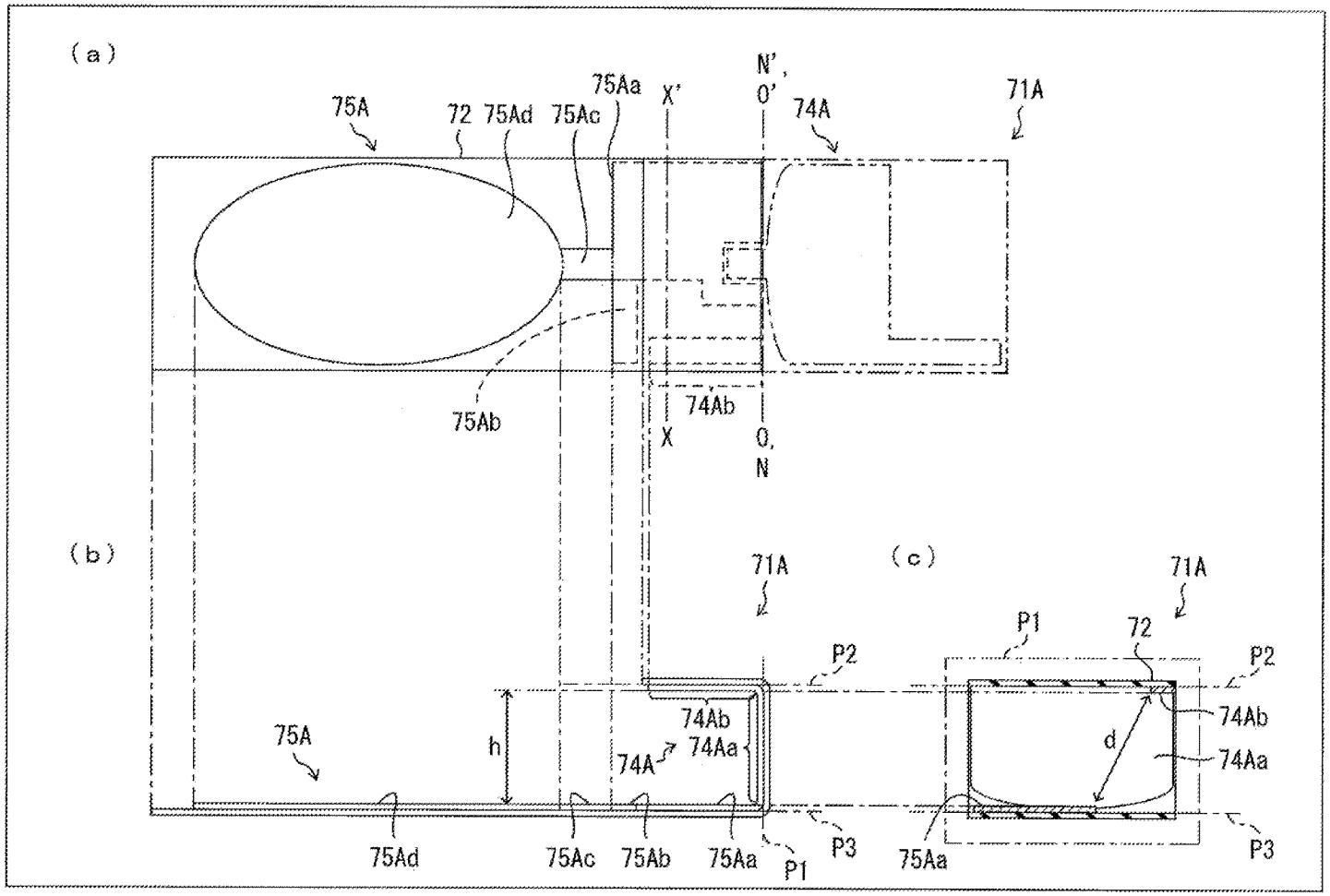

(a) of FIG. 21 is a plan view illustrating the antenna illustrated in FIG. 20. (b) of FIG. 21 is a right-side lateral view illustrating the antenna. (c) of FIG. 21 is a cross sectional view illustrating the antenna.

Figure 22:
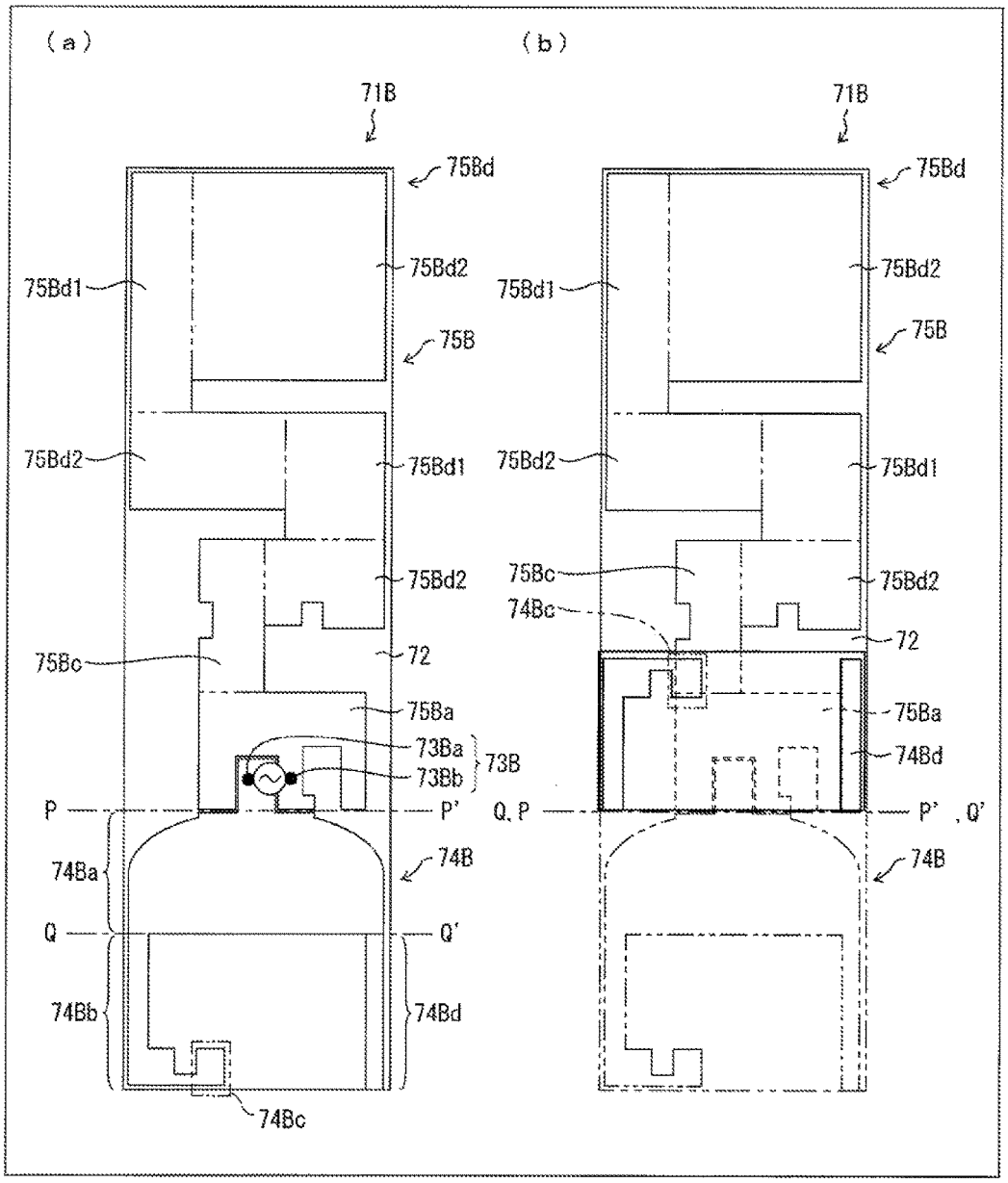

(a) of FIG. 22 is a development view illustrating another modified example of the flatly developed antenna illustrated in FIG. 7. (b) of FIG. 22 is a plan view illustrating the antenna.

Figure 23:
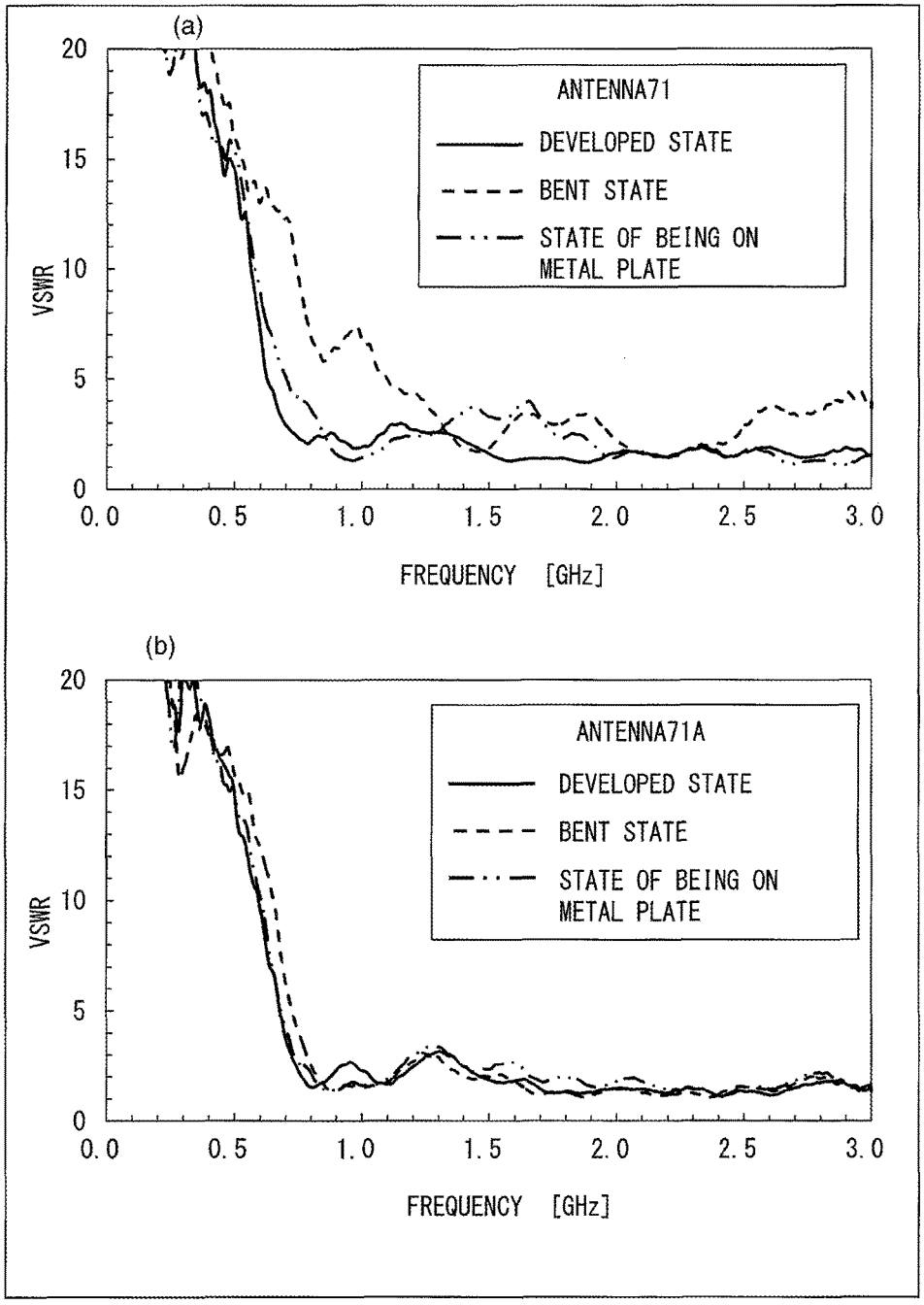

(a) of FIG. 23 is a graph showing frequency dependency of VSWRs of the antenna device in accordance with Example 5. (b) of FIG. 23 is a graph showing frequency dependency of VSWRs of the antenna device in accordance with Example 8.

Figure 24:
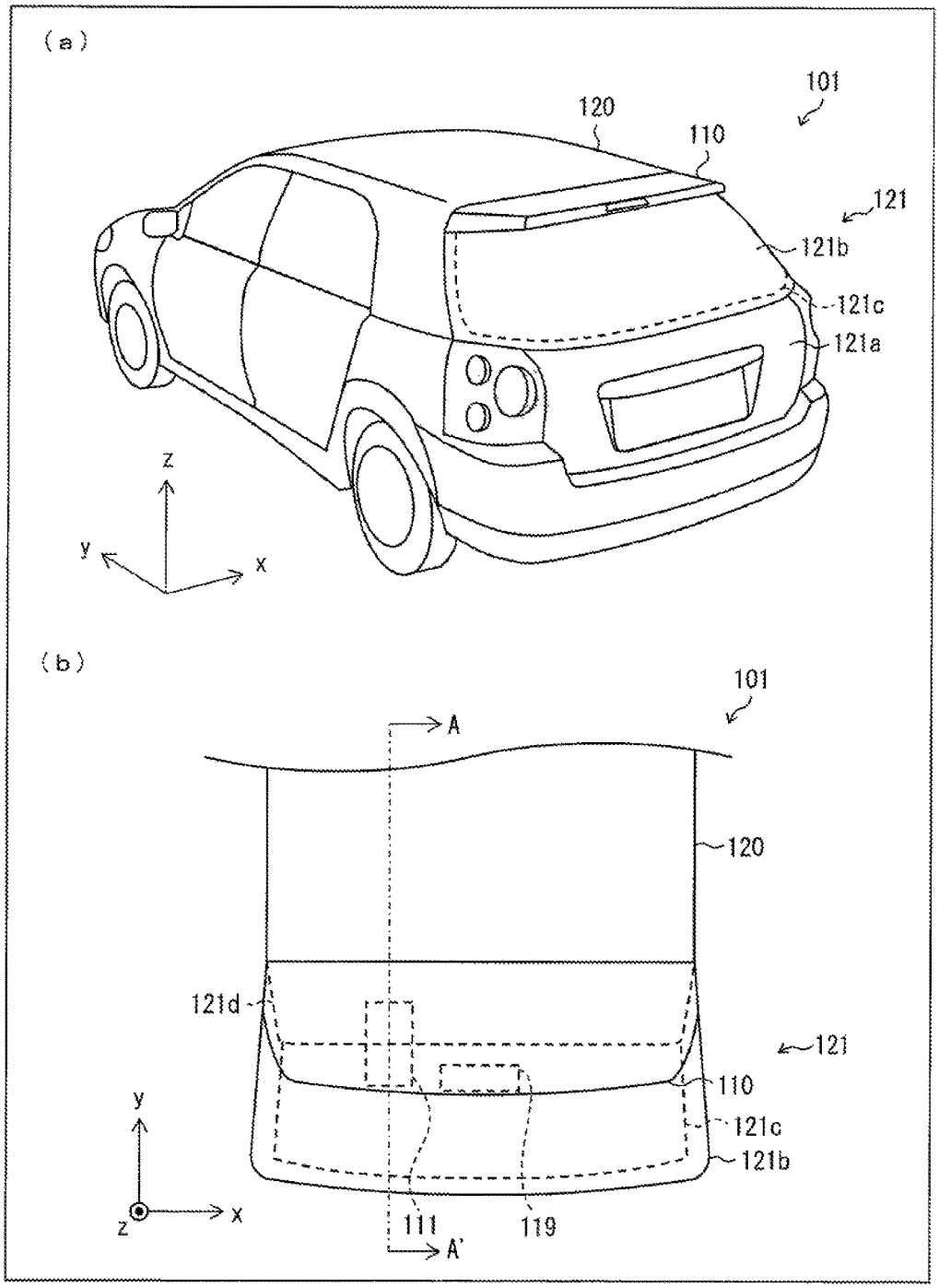

(a) of FIG. 24 is a perspective view illustrating an appearance of a vehicle body on which an on-vehicle antenna device in accordance with Embodiment 6 of the present invention is mounted. (b) of FIG. 24 is a partially-magnified plan view illustrating the vehicle body on which the on-vehicle antenna device is mounted.

Figure 25:
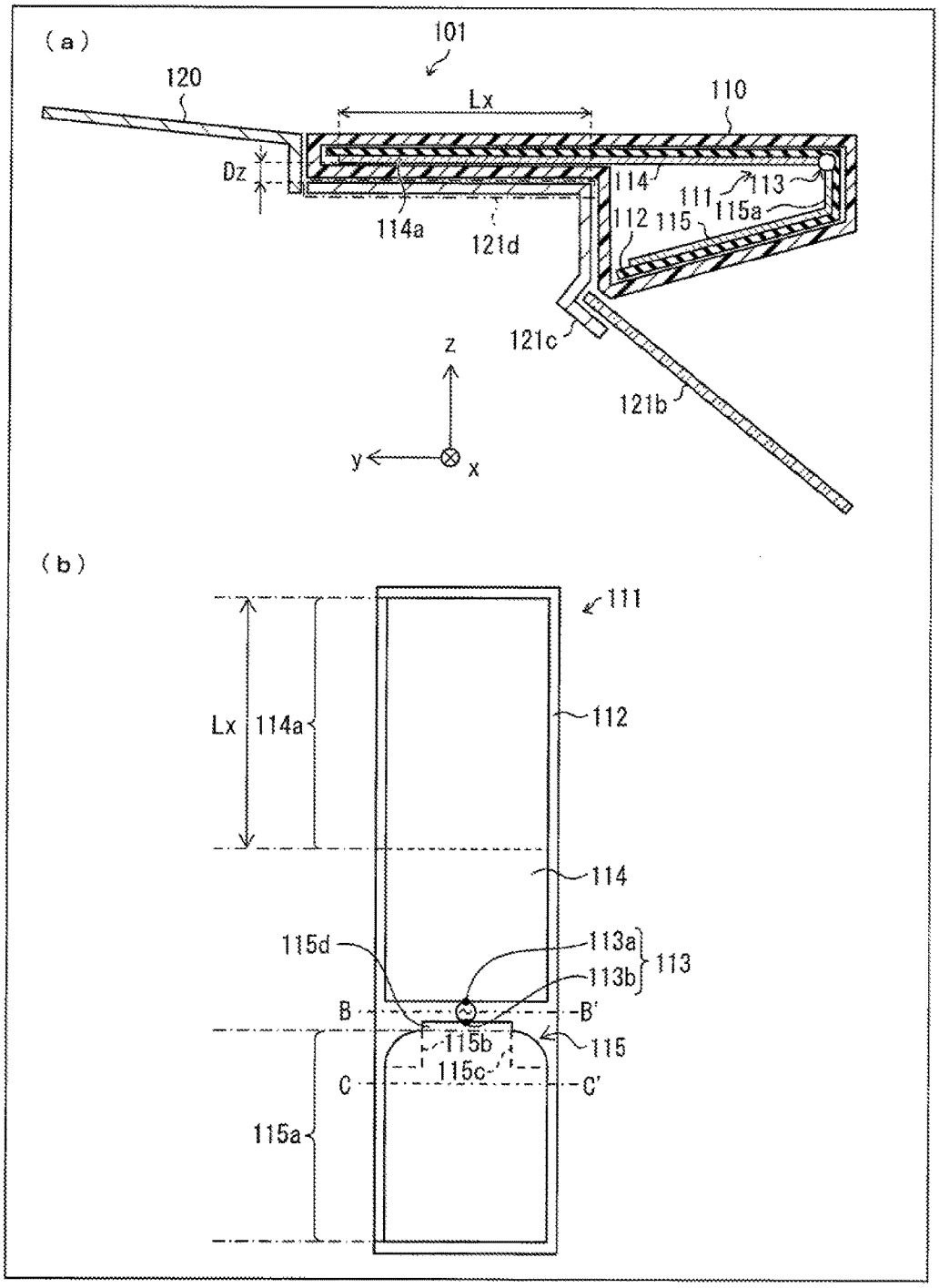

(a) of FIG. 25 is a cross-sectional view which is taken along the line A-A' in (b) of FIG. 24 and illustrates a partially magnified part of the vehicle body on which the on-vehicle antenna device is mounted. (b) of FIG. 25 is a development view illustrating an antenna included in the on-vehicle antenna device.

Figure 26:
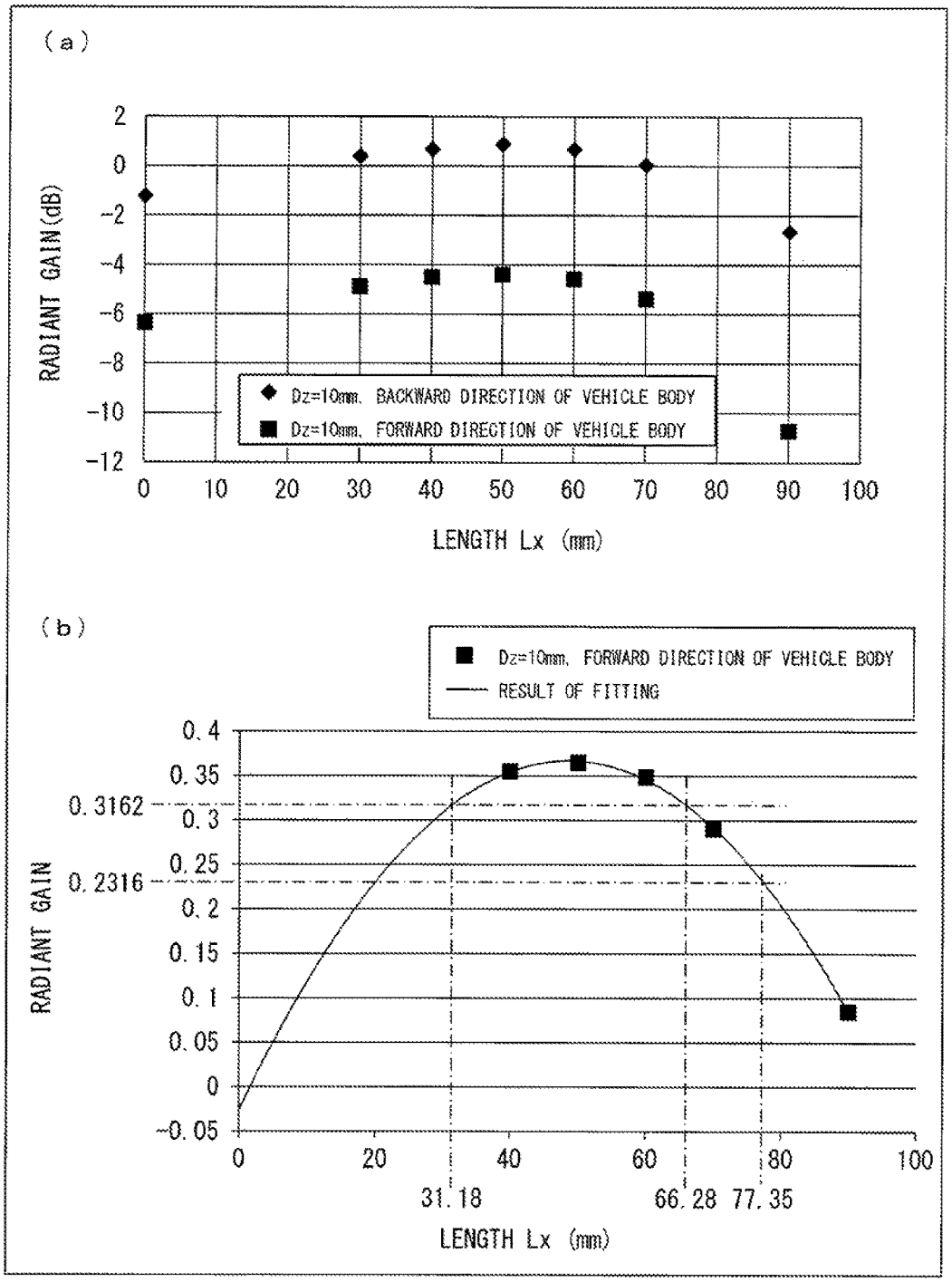

(a) of FIG. 26 is a graph showing a correlation between a length Lx and radiant gains which are obtained by each of on-vehicle antenna devices in accordance with Example 9, Modified Examples 7 through 11, and Comparative Example of the present invention. (b) of FIG. 26 is a graph showing a result of fitting the radiant gain shown in (a) of FIG. 26.

Figure 27:
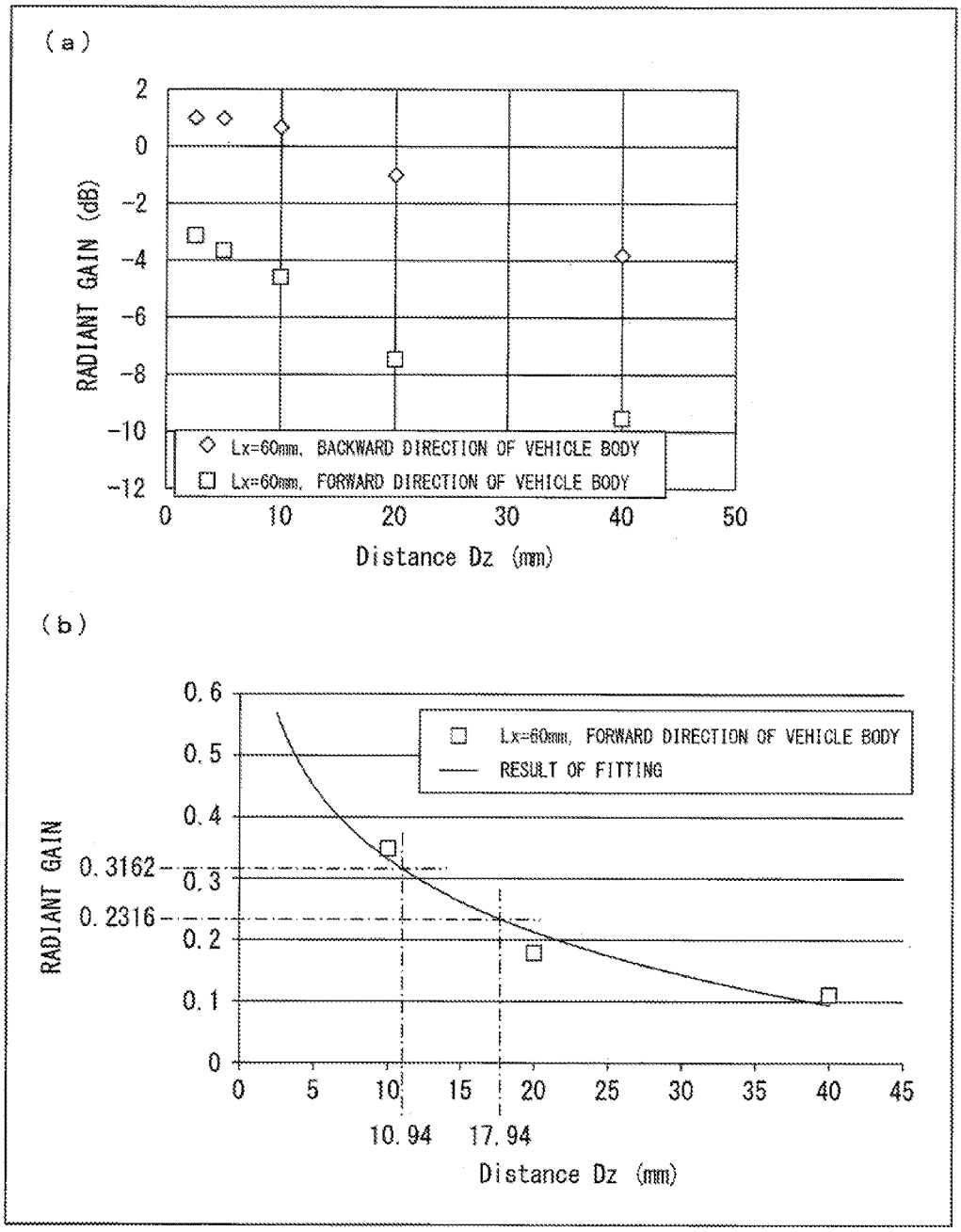

(a) of FIG. 27 is a graph showing a correlation between a distance Dz and radiant gains which are obtained by each of on-vehicle antenna devices in accordance with Example 9 and Modified Examples 12 through 15 of the present invention. (b) of FIG. 27 is a graph showing a result of fitting the radiant gains shown in (a) of FIG. 27.

Figure 28:
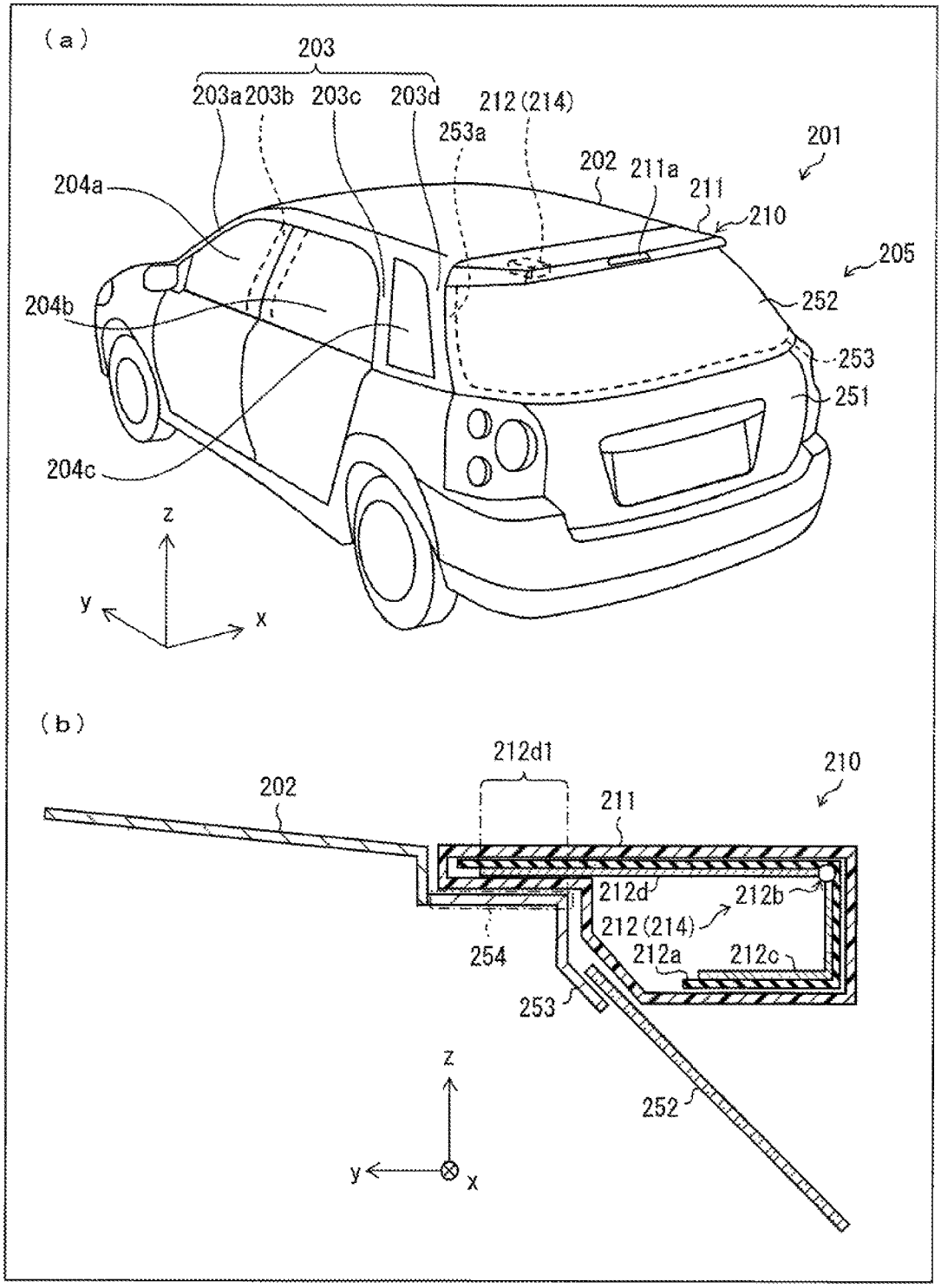

(a) of FIG. 28 is a perspective view illustrating an appearance of a vehicle body on which an on-vehicle antenna device in accordance with Embodiment 1 of the present invention is mounted. (b) of FIG. 28 is a partially-magnified cross-sectional view illustrating the vehicle body on which the on-vehicle antenna device is mounted.

Figure 29:
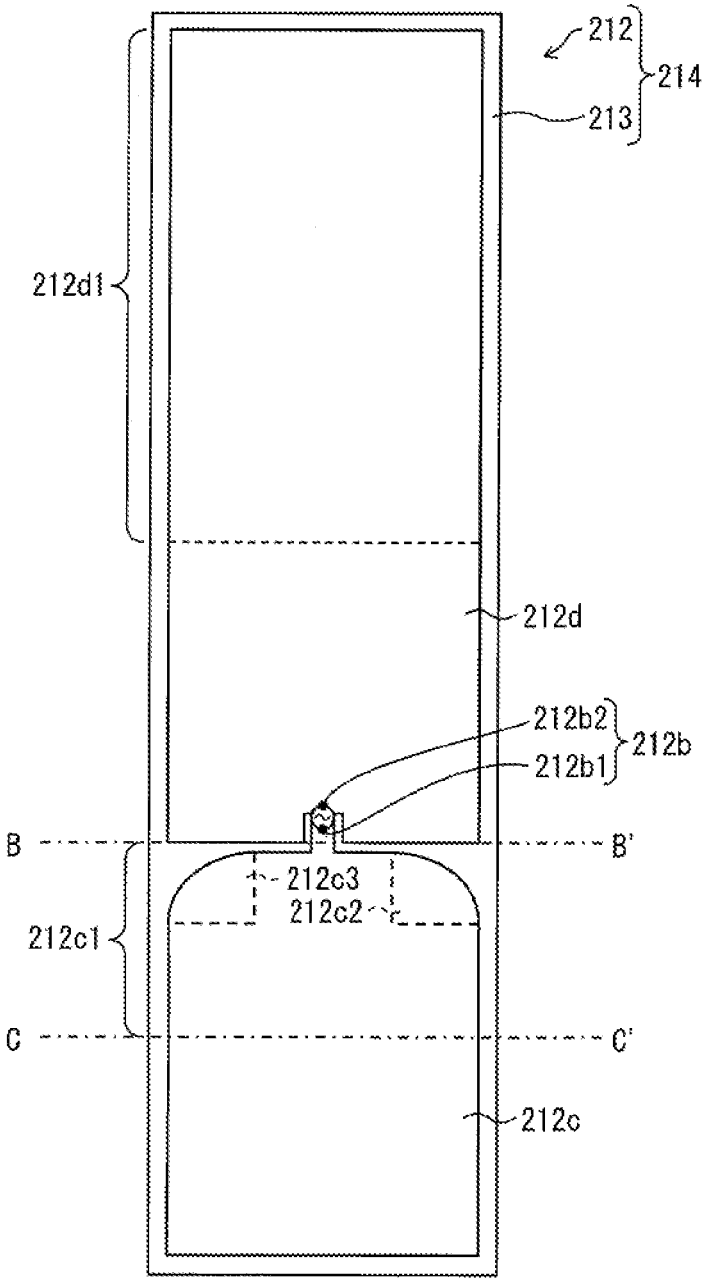

FIG. 29 is a development view illustrating an antenna element included in the on-vehicle antenna device.

Figure 30:
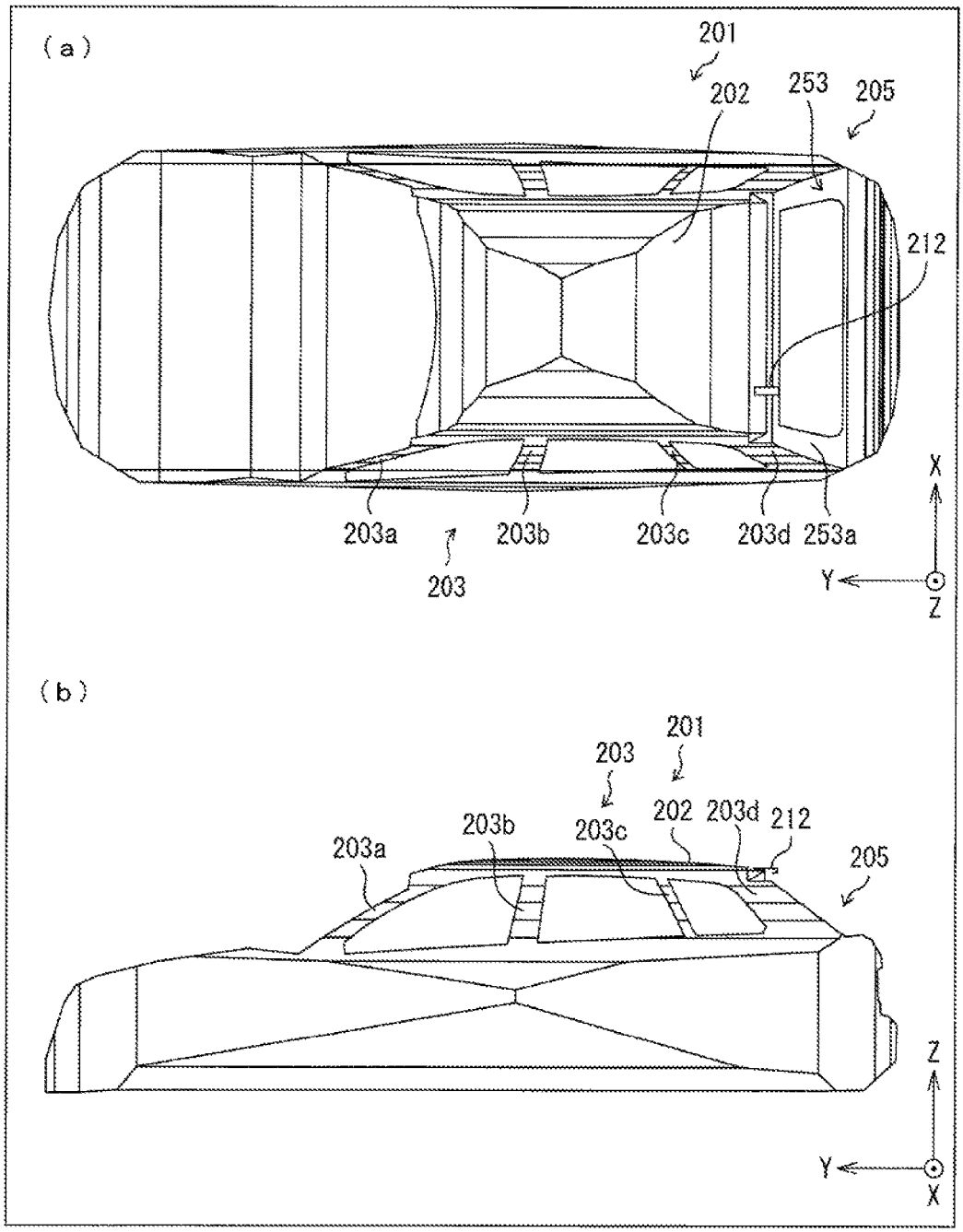

(a) of FIG. 30 is a top view illustrating a configuration of a model of a vehicle body on which an on-vehicle antenna device is mounted, the model being used to calculate a radiant gain of each of on-vehicle antenna devices in Examples of the present invention. (b) of FIG. 30 is a lateral view illustrating a configuration of the model.

Figure 31:
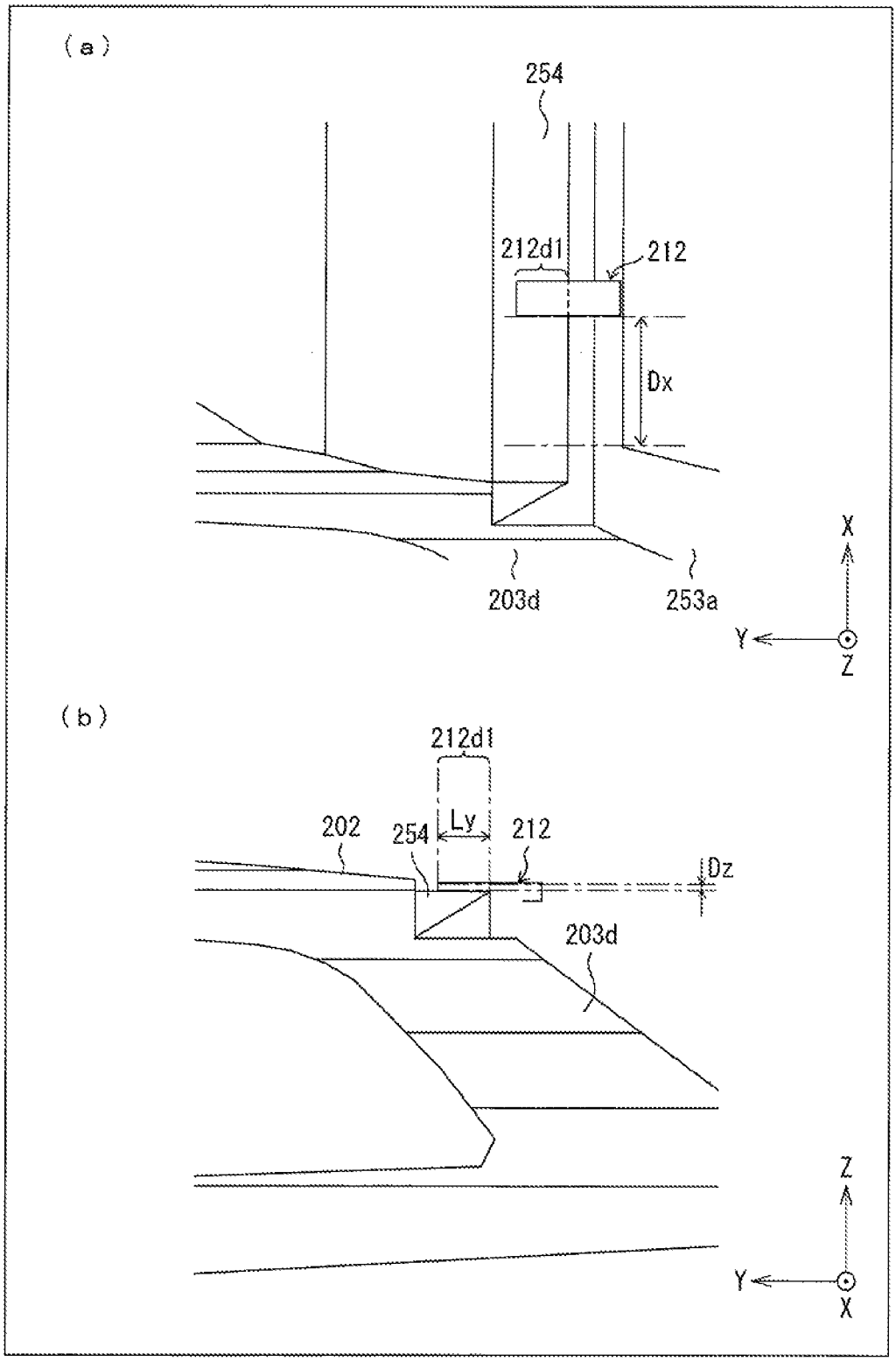

(a) of FIG. 31 is a partially-magnified top view illustrating the model illustrated in (a) of FIG. 30. (b) of FIG. 31 is a partially-magnified lateral view illustrating the model illustrated in (b) of FIG. 30.

Figure 32:
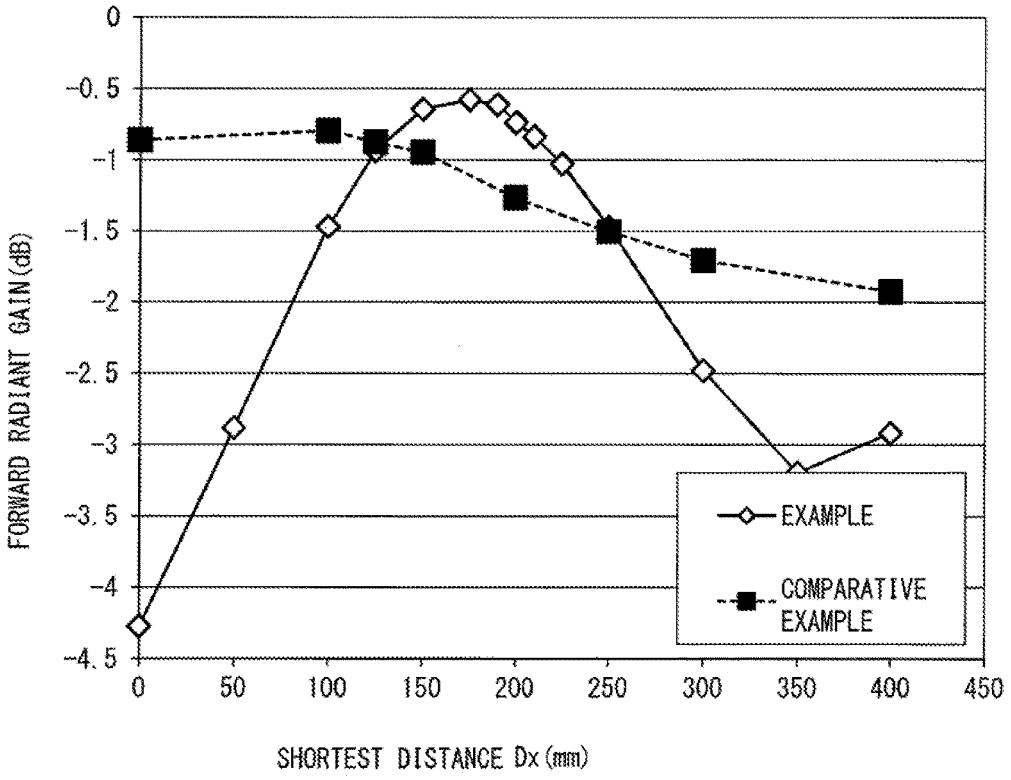
Figure 33:
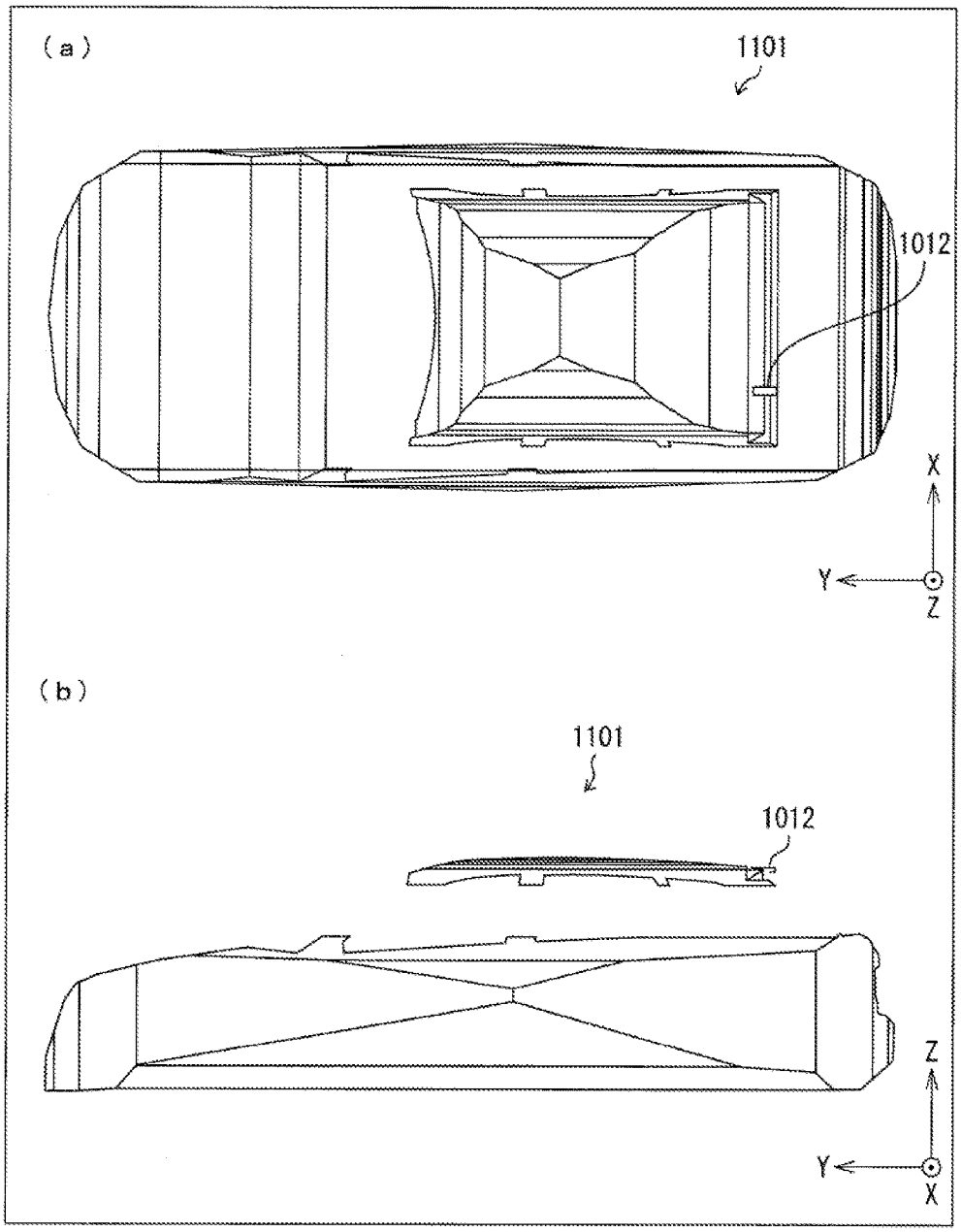

FIG. 32 is a graph showing shortest distance Dx dependency of a forward radiant gain of the on-vehicle antenna device mounted on the vehicle body illustrated in FIG. 30 and an on-vehicle antenna device mounted of the vehicle body illustrated in FIG. 33.

(a) of FIG. 33 is a top view illustrating a configuration of a model of a vehicle body on which an on-vehicle antenna device is mounted, the model being used to calculate a radiant gain of an on-vehicle antenna device in Comparative Example of the present invention. (b) of FIG. 33 is a lateral view illustrating a configuration of the model.

Figure 34:
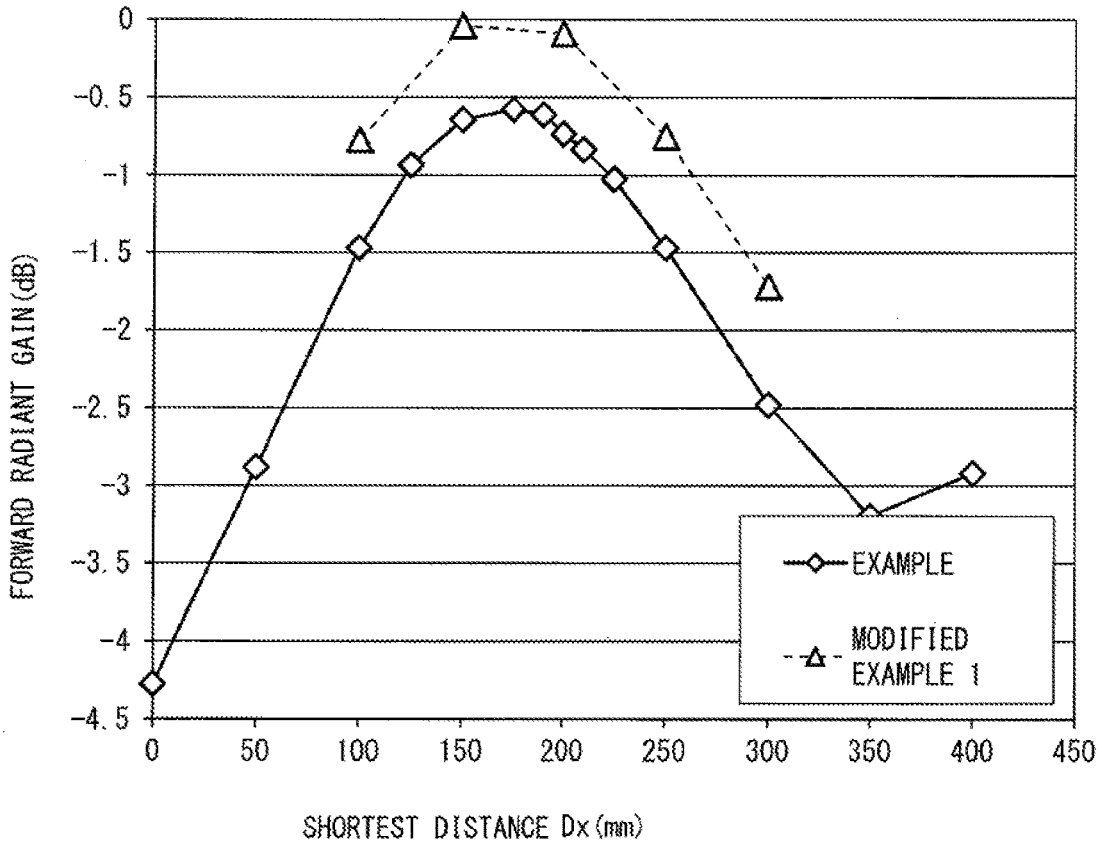

FIG. 34 is a graph showing shortest distance Dx dependency of a forward radiant gain of an on-vehicle antenna device of Example of the present invention mounted on the vehicle body illustrated in FIG. 30 and an on-vehicle antenna device of Modified Example 1 mounted on the vehicle body illustrated in FIG. 30.

Figure 35:
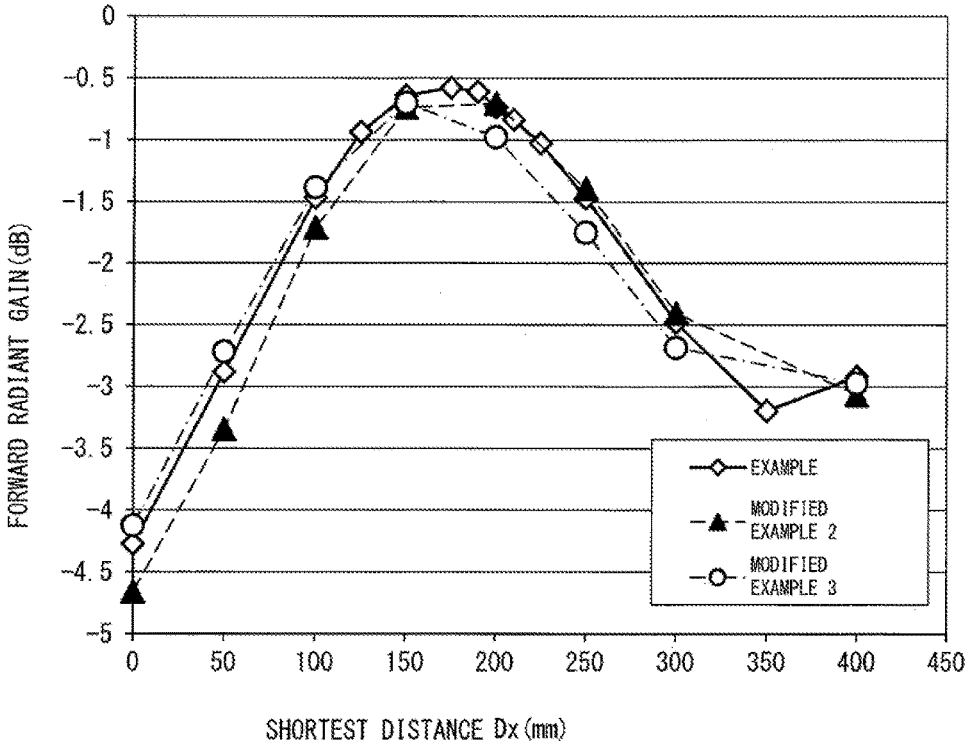

FIG. 35 is a graph showing shortest distance Dx dependency of a forward radiant gain of an on-vehicle antenna device of Example of the present invention mounted on the vehicle body illustrated in FIG. 30, an on-vehicle antenna device of Modified Example 2 mounted on the vehicle body illustrated in FIG. 30, and an on-vehicle antenna device of Modified Example 3 mounted on the vehicle body illustrated in FIG. 30.

DESCRIPTION OF EMBODIMENTS

The following description will discuss embodiments of an antenna device in accordance with the present invention with reference to the drawings.

Note that, in the following descriptions, a direction in which a vehicle body 1 goes forward (i.e., a positive direction of a y-axis in each of FIG. 1, FIG. 24, and FIG. 28) is referred to as "forward direction", and a direction in which the vehicle body 1 goes backward (i.e., a negative direction of the y-axis in each of FIG. 1, FIG. 24, and FIG. 28) is referred to as "backward direction". Moreover, a direction on the right of the vehicle body 1 (i.e., a positive direction of an x axis in each of FIG. 1, FIG. 24, and FIG. 28) is referred to as "rightward direction", and a direction on the left of the vehicle body 1 (i.e., a negative direction of the x-axis in FIG. 1) is referred to as "leftward direction". Further, a direction from a chassis to a roof of the vehicle body 1 (i.e., a positive direction of a z-axis in each of FIGS. 1 and 24) is referred to as "upward direction", and a direction from the roof to the chassis of the vehicle body 1 (i.e., a negative direction of the z-axis in FIG. 1) is referred to as "downward direction". Furthermore, in a case where the leftward direction and the rightward direction are not distinguished, those directions are collectively referred to as "right-and-left direction" and, in a case where the upward direction and the downward direction are not distinguished, those directions are collectively referred to as "up-and-down direction".

In embodiments described in this specification, an on-vehicle antenna device is described in which a spoiler provided at a rear end of a roof serves as a housing. Note, however, that the present invention is not limited to this. That is, the present invention can be applied to an on-vehicle antenna device which is to be provided at a front end, a right end, or a left end of the roof.

[Embodiment 1]

Figure 1:
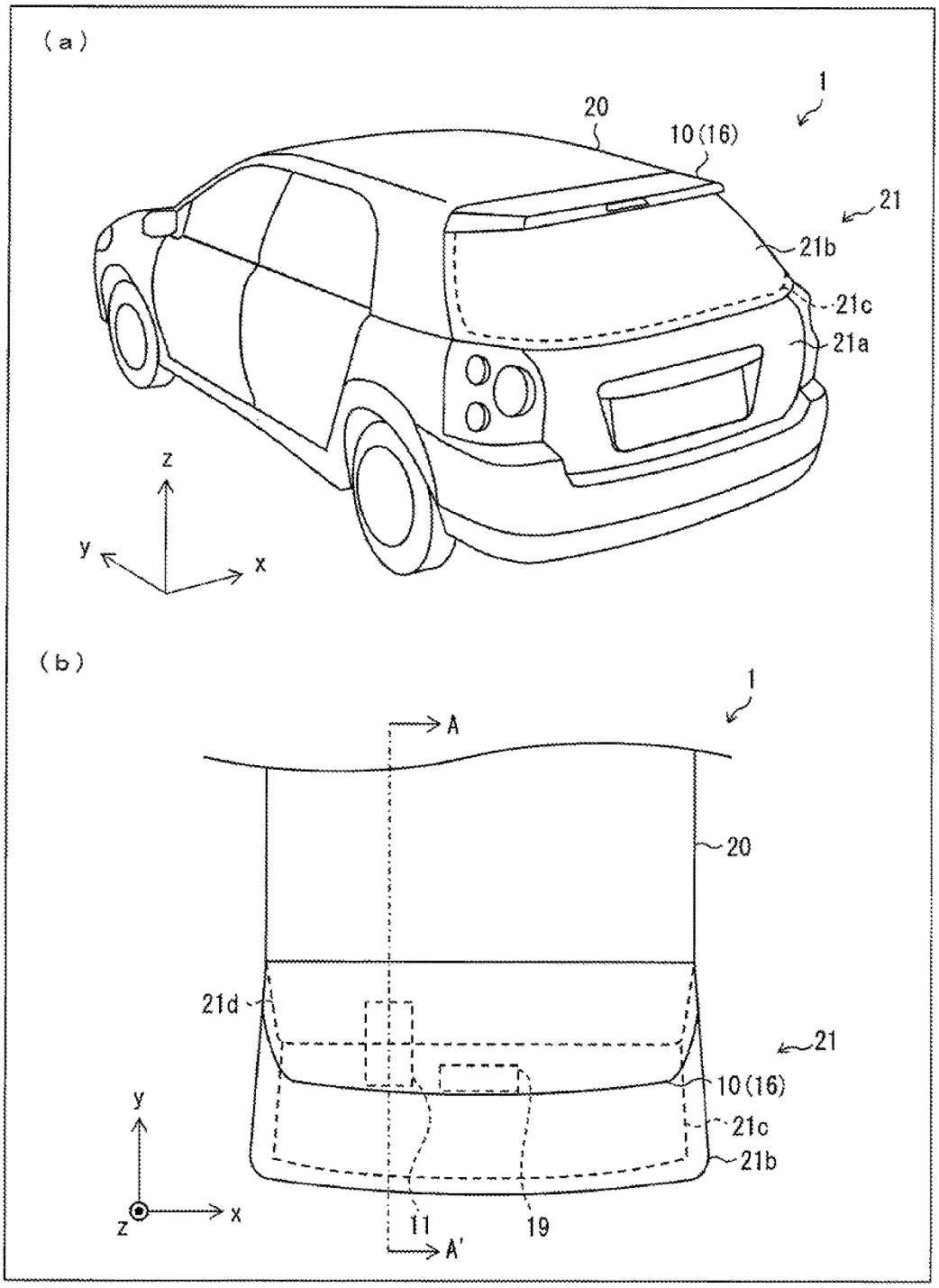
Figure 2:
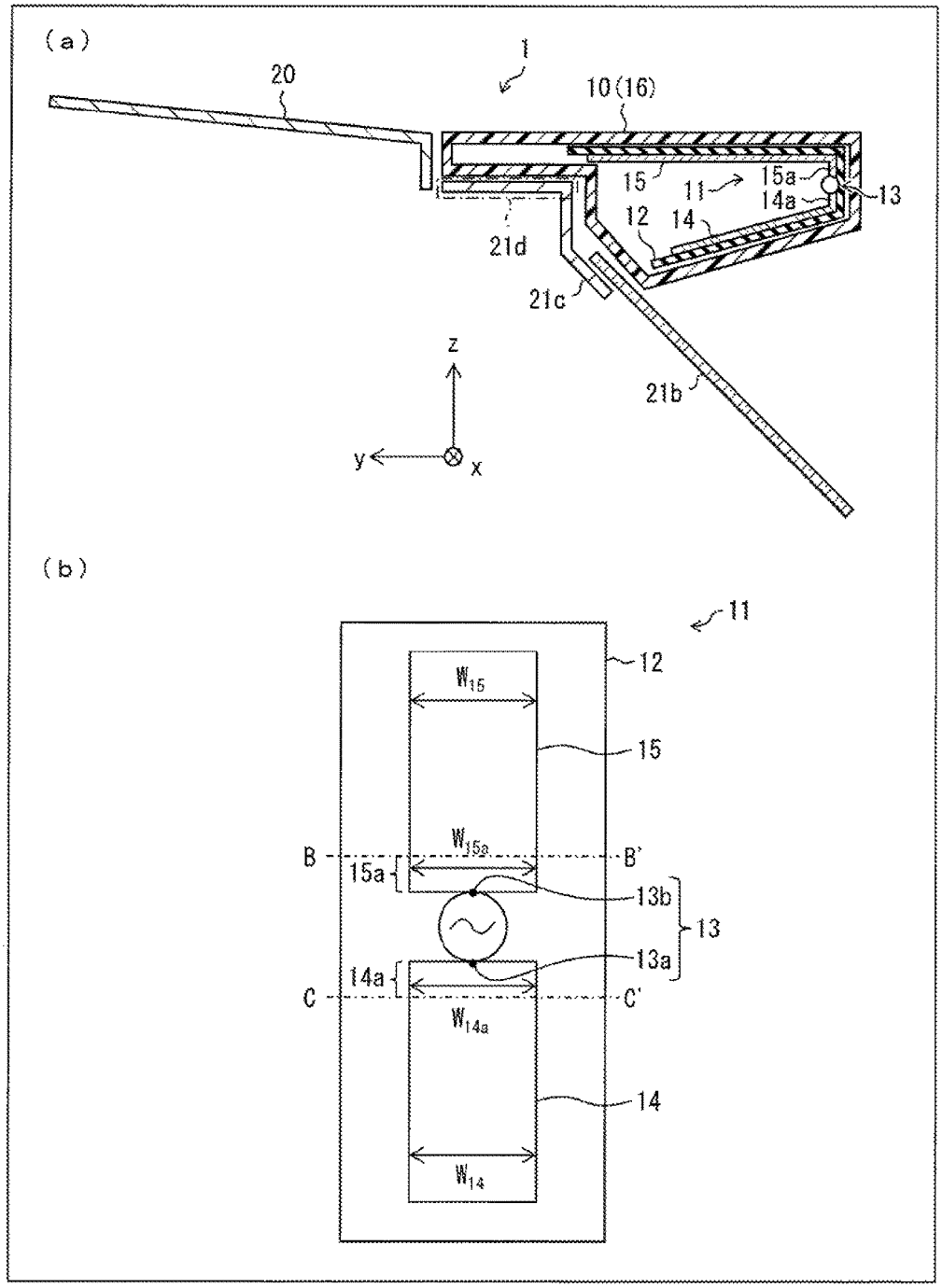

The following description will discuss an on-vehicle antenna device 10 in accordance with Embodiment 1 of the present invention, with reference to FIGS. 1 and 2.

[Mounting Example of On-vehicle Antenna Device 10]

First, an example of mounting the on-vehicle antenna device 10 in accordance with Embodiment 1 of the present invention on the vehicle body 1 will be described with reference to FIG. 1. (a) of FIG. 1 is a perspective view illustrating an appearance of the vehicle body 1 on which the on-vehicle antenna device 10 in accordance with Embodiment 1 is mounted. (b) of FIG. 1 is a partially-magnified plan view illustrating the vehicle body 1 on which the on-vehicle antenna device 10 in accordance with Embodiment 1 is mounted. Specifically, (b) of FIG. 1 is a magnified plan view illustrating the on-vehicle antenna device 10 mounted on the vehicle body 1.

The vehicle body 1 illustrated in (a) of FIG. 1 is a hatchback type vehicle body. In the vehicle body 1, an outer plate (body panel) including a roof 20 is constituted by a metallic member such as a steel plate and an aluminum plate, and a surface constituted by the roof 20 substantially horizontally lies. That is, the roof 20 lies along a horizontal plane and intersects with the up-and-down direction of the vehicle body 1. In embodiments described in this specification, a direction along the roof is synonymous with a direction along the horizontal plane, and a direction intersecting with the roof is synonymous with a direction intersecting with the horizontal plane. The on-vehicle antenna device 10 in accordance with Embodiment 1 is an on-vehicle antenna device in which a spoiler 16 serves as a housing, and the on-vehicle antenna device 10 is mounted at a rear end of the roof 20.

As illustrated in (b) of FIG. 1, a hatch gate 21 of the vehicle body 1 is made up of a hatch gate panel 21*a* which constitutes a lower part of the hatch gate 21, a frame body 21*c* which constitutes an upper part of the hatch gate 21, and a rear glass 21*b*. The frame body 21*c* is made up of two vertical poles and two beams, and the rear glass 21*b* is provided in the frame. One of the two beams of the frame body 21*c* which one is on a side (upper side) in a vicinity of the roof 20 is attached to the rear end of the roof 20 by a hinge (not illustrated). The rear glass 21*b* secures rearward visibility for a driver, and serves also as a windshield. The hatch gate panel 21*a* and the frame body 21*c* are configured by metallic members.

A spoiler fixing section 21*d* (antenna device fixing section in claims) is provided in a part of an upper beam of the two beams of the frame body 21*c*. The upper beam of the frame body 21*c* is caused to partially protrude to the backward direction, and the part thus protruding is used as the spoiler fixing section 21*d* (see (a) of FIG. 2). The spoiler fixing section 21*d* is configured by a metallic member, as with the frame body 21*c*. A surface of the spoiler fixing section 21*d* on which surface the spoiler 16 is provided faces substantially in a zenith direction and lies along the horizontal plane, as with the surface formed by the roof 20. As such, the spoiler fixing section 21*d* constitutes a rear end part of the roof 20. In Embodiment 1, the spoiler fixing section 21*d* is a metallic member which is integrally formed with the frame body 21*c*. Note, however, that the spoiler fixing section 21*d* can be a metallic member which is formed separately from the frame body 21*c* and is fixed to the frame body 21*c* with a bolt or the like.

The spoiler 16 is attached to the spoiler fixing section 21*d* with fixing means (e.g., a bolt or the like, not illustrated). By thus fixing the spoiler 16 to the spoiler fixing section 21*d*, an upper surface of the spoiler 16 becomes substantially flush with an entire upper surface of the roof 20. The spoiler 16 has functions of improving beauty of the vehicle body 1, enhancing an aerodynamic characteristic of the vehicle body 1, and the like, and also serves as a housing of the on-vehicle antenna device 10 in an aspect of the present invention. In the spoiler 16, an antenna 11 and a stop lamp 19 are incorporated. The spoiler 16 is made of a dielectric substance (e.g., resin or the like), and allows an electromagnetic wave to pass through.

The antenna 11 is arranged inside the spoiler 16 at a location at which the antenna 11 does not interfere with the stop lamp 19. Specifically, the antenna 11 is arranged on a left side of the stop lamp 19 so as to avoid the stop lamp 19 which is arranged at a center of the spoiler 16 in the right-and-left direction.

[On-vehicle Antenna Device 10]

The following description will discuss a specific configuration of the on-vehicle antenna device 10 with reference to FIG. 2. FIG. 2 illustrates a configuration of the on-vehicle antenna device 10 in accordance with Embodiment 1. (a) of FIG. 2 is a partially-magnified cross-sectional view which is taken along the line A-A' in (b) of FIG. 1 and illustrates the vehicle body 1 on which the on-vehicle antenna device 10 is mounted. (b) of FIG. 2 is a development view illustrating a state where the antenna 11 included in the on-vehicle antenna device 10 is flatly developed.

As illustrated in (a) of FIG. 2, the on-vehicle antenna device 10 is configured such that the antenna 11 which is being bent is placed inside the spoiler 16. Examples of the fixing means for fixing the antenna 11 to the spoiler 16 encompass an adhesive sheet, a double-sided adhesive tape, a resin fastener, and the like. The fixing means is not limited and is preferably made of a member which is not electrically conductive so as not to interfere with transmission and reception of electromagnetic waves. A specific way of bending the antenna 11 and the like will be described later with reference to (b) of FIG. 2.

[Antenna 11]

The antenna 11 includes a dielectric substrate, an antenna element which is provided on a surface of the dielectric substrate, and a connection section with which a coaxial line (not illustrated) and the antenna element are connected with each other. In Embodiment 1, a dielectric film 12 is employed as the dielectric substrate. A material of the dielectric film 12 can be, for example, polyimide resin but is not limited to this. The antenna 11 thus configured can be regarded as a film antenna or can be regarded as a flexible printed circuit (FPC) board.

In an example illustrated in (b) of FIG. 2, an antenna element constituted by a first antenna element 14 and a second antenna element 15 is provided on a surface of the dielectric film 12. Each of the first antenna element 14 and the second antenna element 15 is a thin plate member made of a conductor. Each of the first antenna element 14 and the second antenna element 15 can be, for example, a copper foil but is not limited to this.

A connection section 13 connects the coaxial line (not illustrated) with the antenna elements 14 and 15 and includes feed points 13*a* and 13*b* (pair of feed points). The feed points 13*a* and 13*b* are respectively provided on surfaces of the antenna elements 14 and 15. To the connection section 13, one end of the coaxial line can be connected. By connecting the other end of the coaxial line to an on-vehicle apparatus such as a tuner, the on-vehicle antenna device 10 can transmit/receive radio waves.

One of two conductors (e.g., inner-side conductor) included in the coaxial line is connected with the first antenna element 14 at the first feed point 13*a* that is one feed point of the connection section 13. The other conductor (e.g., outer-side conductor) of the coaxial line is connected with the second antenna element 15 at the second feed point 13*b* that is another feed point of the connection section 13. In Embodiment 1, a dipole antenna is employed as the antenna 11. Note, however, that it is possible to use a loop antenna, a monopole antenna, or an inverted F antenna as the antenna 11. Moreover, each of the antenna elements can be a planar antenna element as with the antenna elements 14 and 15 of Embodiment 1, or can be a linear antenna element.

The antenna 11 is bent along the line B-B' and the line C-C' in (b) of FIG. 2 such that folds come to an inner side. Consequently, the antenna 11 is formed into a U-shape such that the dielectric film 12 comes to an outer side and the first antenna element 14 and the second antenna element 15 come to the inner inside. As illustrated in (a) of FIG. 2, the on-vehicle antenna device 10 has a configuration in which the antenna 11, which is being bent in the U-shape, is fixed along an inner wall of the spoiler 16.

As illustrated in (a) of FIG. 2, in a case where the on-vehicle antenna device 10 is mounted at the rear end of the vehicle body 1, the first antenna element 14 of the antenna 11 is drawn out from the feed point 13*a* in the downward direction (corresponding to the first direction in claims) of the vehicle body 1 which is a direction intersecting with the roof 20. Further, the second antenna element 15 is drawn out from the feed point 13*b* in the upward direction (corresponding to the second direction in claims) which is a direction intersecting with the roof 20 and is different from the downward direction of the vehicle body 1. The on-vehicle antenna device 10 has the configuration in which the first direction and the second direction intersect with the roof 20.

In the first antenna element 14, a part drawn out from the feed point 13*a* in the downward direction, that is, a part from a starting end (root) of the first antenna element 14 at which the first antenna element 14 is connected with the feed point 13*a* to the line C-C' along which the first antenna element 14 is bent such that a fold comes to an inner side is referred to as "feed point vicinity 14*a*".

The feed point vicinity 14*a* is drawn out from the feed point 13*a* in the downward direction, and therefore a direction of an electric current which flows in the feed point vicinity 14*a* is mainly the up-and-down direction. An electric current density of the electric current flowing in the first antenna element 14 is highest at the starting end of the first antenna element 14 (i.e., the connection section with the feed point 13*a*), and becomes lower as approaching a terminal end. From this, in the feed point vicinity 14*a*, an electric current having a relatively high electric current density flows in the up-and-down direction of the vehicle body 1. As a result, the first antenna element 14 can increase a ratio of a vertically polarized wave component contained in a radiated electromagnetic wave, as compared with a conventional technique (i.e., the on-vehicle antenna device disclosed in Patent Literature 1).

Further, the vertically polarized wave has a characteristic of hardly subjected to a damping effect by the roof 20, as compared with a horizontally polarized wave. Therefore, the on-vehicle antenna device 10 including the first antenna element 14 can sufficiently increase a radiant gain of the vertically polarized wave in a direction (in this case, forward direction) which goes across the roof 20, even in a case where the roof 20 is made of metal. As a result, even in a case where the roof is made of metal, it is possible to sufficiently increase a radiant gain of an electromagnetic wave in the direction going across the roof.

A width $W_{14a}$ of the feed point vicinity 14*a* is preferably ½ or less of a shortest wavelength of an electromagnetic wave radiated from the antenna 11. In Embodiment 1, the first antenna element 14 has a rectangular shape and accordingly the feed point vicinity 14*a* also has a rectangular shape, and the width $W_{14a}$ is constant from the feed point 13*a* to the line C-C'. In a case where the feed point vicinity 14*a* does not have a rectangular shape, it is preferable that a maximum value of the width $W_{14a}$ is ½ or less of the shortest wavelength of the electromagnetic wave radiated from the antenna 11.

The configuration of the first antenna element 14 (*i*) inhibits an electric current fed from the feed point 13*a* from flowing in the right-and-left direction of the vehicle body 1 in the feed point vicinity 14*a* and (ii) facilitates flow of the electric current in the up-and-down direction of the vehicle body 1. Therefore, it is possible to further increase a radiant gain of the vertically polarized wave, as compared with a case where the width $W_{14a}$ is greater than ½ of the shortest wavelength of the electromagnetic wave radiated from the antenna 11. As a result, it is possible to further increase a radiant gain of the electromagnetic wave in the forward direction of the vehicle body 1.

In the second antenna element 15, a part drawn out from the feed point 13*b* in the upward direction, that is, a part from a starting end (root) of the second antenna element 15 at which the second antenna element 15 is connected with the feed point 13*b* to the line B-B' along which the second antenna element 15 is bent such that a fold comes to an inner side is referred to as "feed point vicinity 15*a*".

In the on-vehicle antenna device 10, the feed point vicinity 15*a* of the second antenna element 15 is drawn out in the upward direction of the vehicle body 1. The feed point vicinity 15*a* thus configured can further increase a ratio of a vertically polarized wave component contained in an electromagnetic wave which is radiated from the on-vehicle antenna device 10.

In the configuration in which the feed point vicinity 14*a* is drawn out from the feed point 13*a* in the downward direction and the feed point vicinity 15*a* is drawn out from the feed point 13*b* in the upward direction, each of the width $W_{14a}$ and the width $W_{15a}$ is preferably ½ or less of the shortest wavelength of the electromagnetic wave radiated from the antenna 11 in order to increase a radiant gain of the vertically polarized wave. However, in a case where any one of the width $W_{14a}$ and the width $W_{15a}$ is ½ or less of the shortest wavelength of the electromagnetic wave radiated from the antenna, it is possible to further increase a radiant gain of the vertically polarized wave, as compared with a case where both the width $W_{14a}$ and the width $W_{15a}$ are greater than ½ of the shortest wavelength of the electromagnetic wave radiated from the antenna 11.

Moreover, in the antenna 11 of the on-vehicle antenna device 10 which is provided at the rear end part of the roof 20, it is more preferable that widths $W_{14}$ and $W_{15}$ (i.e., width of the antenna element measured along a rear end side of the roof 20) of respective parts of the antenna elements other than the feed point vicinities 14*a* and 15*a* are also ½ or less of the shortest wavelength of the electromagnetic wave radiated from the antenna. Here, in a case where the width $W_{14}$ of the first antenna element 14 is different from the width $W_{15}$ of the second antenna element 15, it is preferable that both the widths $W_{14}$ and $W_{15}$ are ½ or less of the shortest wavelength of the electromagnetic wave radiated from the antenna.

The configuration of the antenna 11 (*i*) inhibits an electric current fed from the feed point 13*a* to the first antenna element 14 and an electric current fed from the feed point 13*b* to the second antenna element 15 from flowing in the right-and-left direction of the vehicle body 1 and (ii) facilitates flow of the electric currents in the up-and-down direction of the vehicle body 1. That is, it is possible to restrict directions of electric currents which mainly flow in the first and second antenna elements 14 and 15 to the up-and-down direction and the front-and-rear direction of the vehicle body 1. As a result, for example, even in a case where another antenna, whose antenna element extending in the right-and-left direction of the vehicle body 1 is stuck to rear glass, is provided in the vicinity of the on-vehicle antenna device 10 provided in the spoiler 16 serving as a housing, it is possible to inhibit the antenna elements 14 and 15 of the antenna 11 from influencing another antenna (i.e., the antenna element extending in the right-and-left direction of the vehicle body 1) or from being influenced by another antenna.

As such, in the on-vehicle antenna device 10, the antenna element is drawn out from the one feed point in the first direction which intersects with the roof, and it is therefore possible to radiate a vertically polarized wave as a main polarized wave component. A polarization plane of the vertically polarized wave lies in a direction intersecting with the roof which is a metallic member. From this, as compared with a horizontally polarized wave, the vertically polarized wave is less likely to be influenced by the damping effect (described above in the process of traveling across the vehicle body) by the roof, and the vertically polarized wave can travel across the roof without a loss of a radiant gain.

Therefore, according to the on-vehicle antenna device 10 provided at the rear end part of the roof 20, even in a case where the roof 20 is a metallic member, it is possible to provide the on-vehicle antenna device which can achieve a greater radiant gain in the direction (forward direction) going across the roof 20, as compared with a conventional technique. Therefore, the on-vehicle antenna device 10 can be suitably used also as an on-vehicle antenna device which utilizes a frequency band of a short wavelength which is typically of an electromagnetic wave for LTE. That is, according to a conventional on-vehicle antenna device in which an antenna element inside of a spoiler is horizontally arranged, a polarized wave component of an electromagnetic wave radiated from the antenna is mainly a horizontally polarized wave, and therefore the electromagnetic wave is more likely to be subjected to a damping effect by the roof. From this, the conventional on-vehicle antenna device has been difficult to use in antenna systems such as 3G and LTE which require communication with base stations that are provided above the ground. On the other hand, according to the on-vehicle antenna device in accordance with an aspect of the present invention, it is possible to radiate a vertically polarized wave as a main polarized wave component, and therefore the on-vehicle antenna device in accordance with an aspect of the present invention can be suitably used in the antenna systems such as 3G and LTE which require communication with base stations that are provided above the ground.

Note that, as illustrated in (a) of FIG. 2, a part of the second antenna element 15 which part is from the line B-B' to the terminal end is arranged in a direction along the roof 20. According to the configuration, the on-vehicle antenna device 10 can radiate not only a vertically polarized wave but also a horizontally polarized wave.

[Embodiment 2]

Figure 3:
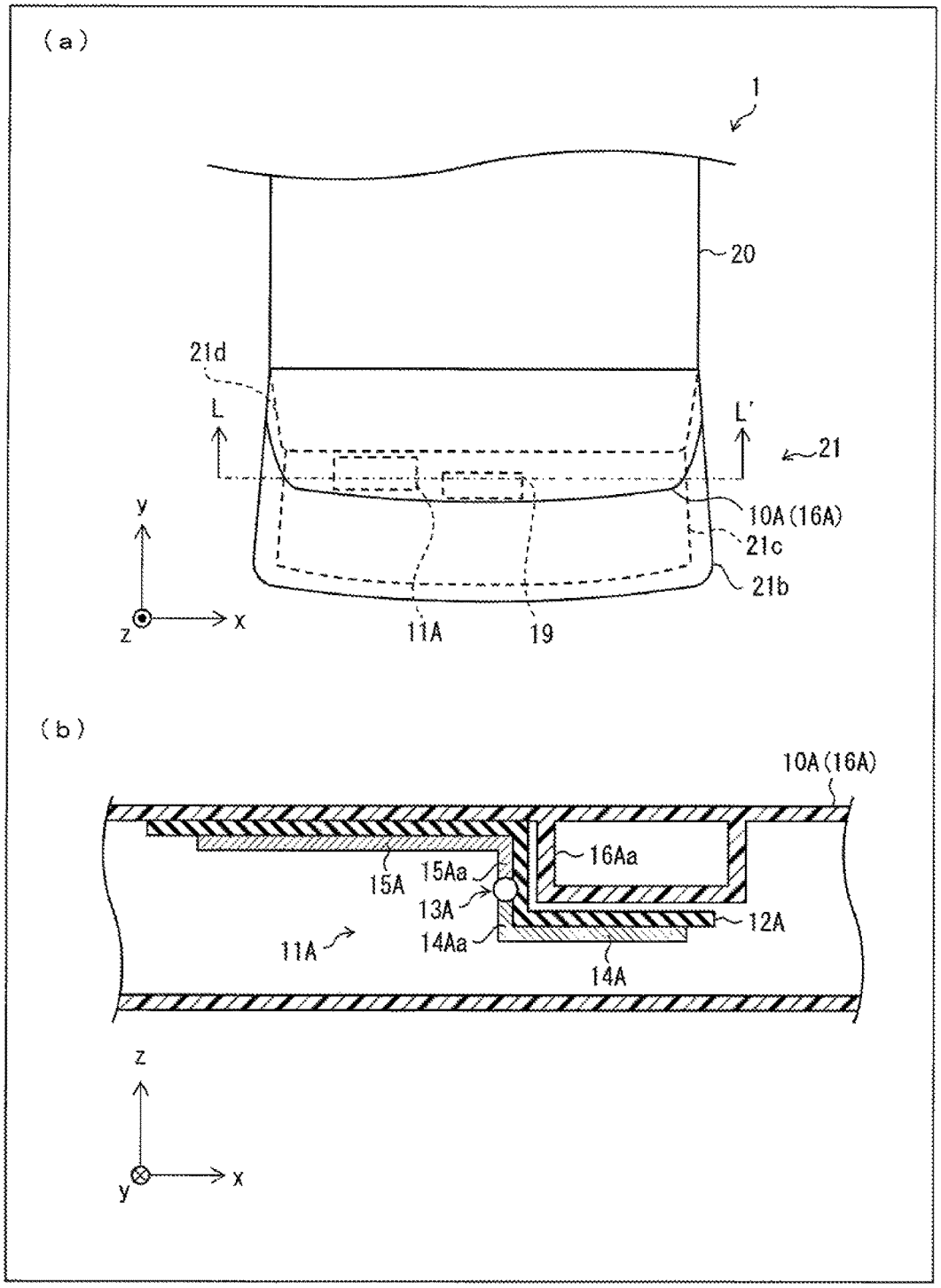

Next, the following description will discuss an on-vehicle antenna device in accordance with Embodiment 2 of the present invention with reference to FIG. 3. (a) of FIG. 3 is a partially-magnified plan view illustrating a vehicle body 1 on which an on-vehicle antenna device 10A in accordance with Embodiment 2 is mounted. (b) of FIG. 3 is a partially-magnified cross-sectional view which is taken along the line L-L' in (a) of FIG. 3 and illustrates the vehicle body 1 on which the on-vehicle antenna device 10A is mounted.

The on-vehicle antenna device 10A in accordance with Embodiment 2 is obtained by replacing the antenna 11 and the spoiler 16 of the on-vehicle antenna device 10 in accordance with Embodiment 1 with an antenna 11A and a spoiler 16A, respectively, which will be described below.

The antenna 11A is obtained by (i) rotating the antenna 11 of the on-vehicle antenna device 10 in accordance with Embodiment 1 by 90 degrees in an anticlockwise direction in a top view of the vehicle body 1 (see (b) of FIG. 1) and (ii) extending the terminal end of the first antenna element 14 in the rightward direction of the vehicle body 1, instead of the leftward direction. In other words, a feed point vicinity 14Aa including one feed point is drawn out in the downward direction (i.e., the first direction) of the vehicle body 1, and a feed point vicinity 14Ab including another feed point is drawn out in the upward direction (i.e., the second direction) of the vehicle body 1. Further, a terminal end of a first antenna element 14A extends in the rightward direction of the vehicle body 1, and a terminal end of a second antenna element 15A extends in the leftward direction of the vehicle body 1 (see (b) of FIG. 3). With regard to a way of bending the antenna element, the antenna elements 14A and 15A are bent in a step shape (or Z-shape), unlike the antenna elements 14 and 15 which are bent in the U-shape.

As illustrated in (b) of FIG. 3, the spoiler 16A includes an antenna base 16Aa on which the antenna 11A is placed. The antenna base 16Aa is made up of a plane intersecting with the roof 20 and a plane which lies along the roof 20 and is located inside the spoiler 16A. Specifically, the plane intersecting with the roof 20 is a yz plane in coordinate axes shown in (b) of FIG. 3, and the plane lying along the roof 20 is an xy plane in the coordinate axes shown in (b) of FIG. 3. As illustrated in (b) of FIG. 3, the antenna base 16Aa is a step on which the antenna 11A is placed, and forms a step which projects toward an inner side of the spoiler 16A.

The antenna 11A can be fixed to the spoiler 16A with use of fixing means similar to the fixing means for fixing the antenna 11 to the spoiler 16. As illustrated in (a) of FIG. 3, a shape of the spoiler 16A in a plan view is shorter in the front-and-rear direction of the vehicle body 1 and is longer in the right-and-left direction of the vehicle body 1. In a case where a front region and a rear region of the spoiler 16A are compared in terms of an internal space, a space in the rear region is considerably larger than a space of the front region. This is because a spoiler fixing section 21*d* is provided in the front region of the spoiler 16A and an upper surface of the spoiler is substantially flush with an entire upper surface of the roof 20.

The antenna elements 14A and 15A of the antenna 11A extend in a longer side direction of the spoiler 16A. Therefore, it is possible to design a length of the antenna element from its starting end to terminal end to be longer, as compared with the antenna elements 14 and 15 of the antenna 11. As a result, the antenna 11A can improve a radiant gain, as compared with the antenna 11. Moreover, the antenna 11A may be placed in the rear region, which is larger in space, of the spoiler 16A, and it is therefore possible to easily place the antenna 11A in the spoiler 16A, as compared with the antenna 11.

In the on-vehicle antenna device 10A thus configured also, the feed point vicinity 14Aa is drawn out in the downward direction of the vehicle body 1, and the feed point vicinity 15Aa is drawn out in the upward direction of the vehicle body 1. Therefore, the on-vehicle antenna device 10A can radiate a vertically polarized wave as a main polarized wave component. From this, even in a case where the roof 20 is a metallic member, the on-vehicle antenna device 10A can provide an on-vehicle antenna device which achieves a greater radiant gain in the direction (forward direction) going across the roof 20, as compared with a conventional technique.

[Embodiment 3]

Figure 4:
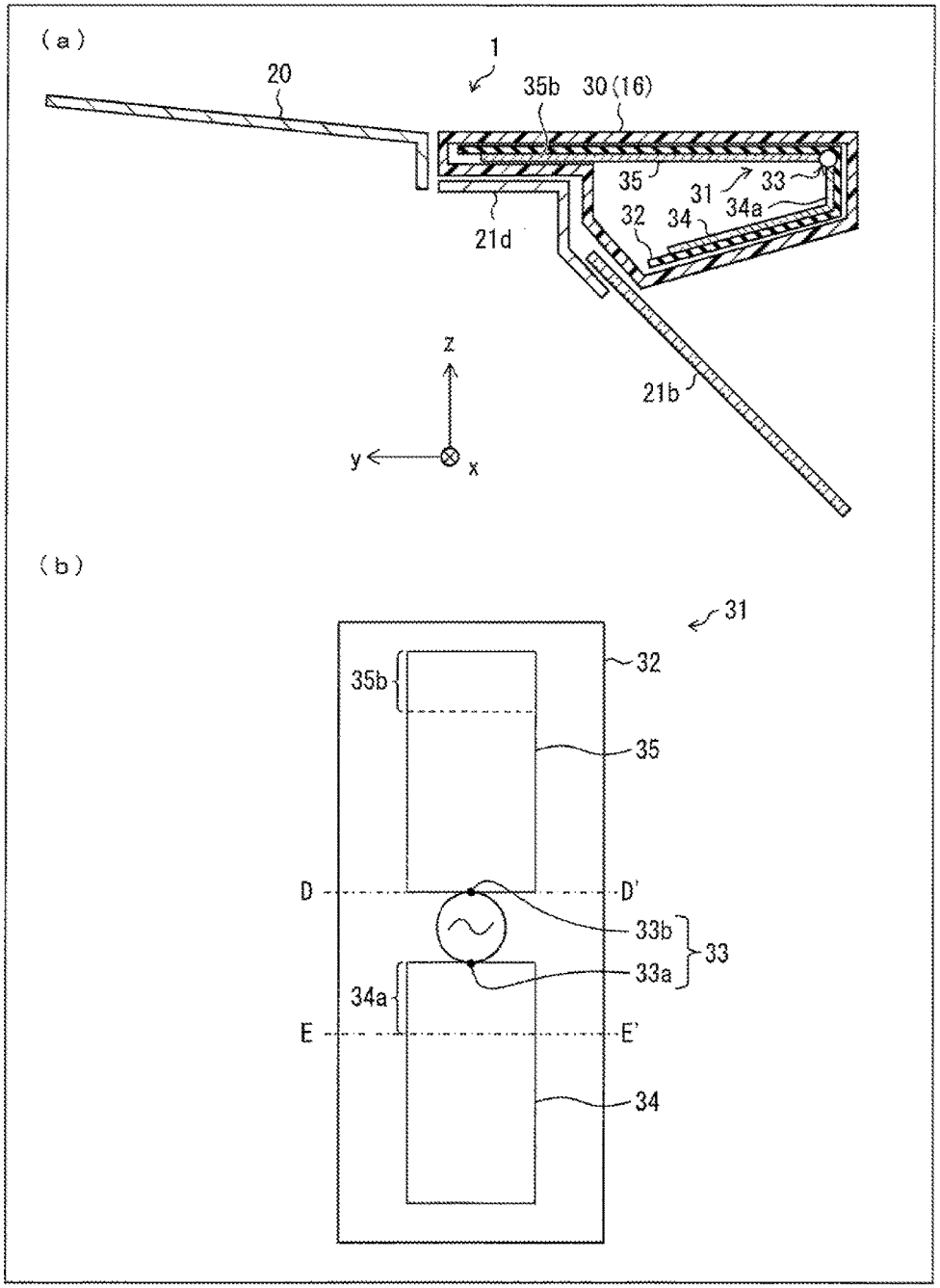

Next, the following description will discuss an on-vehicle antenna device 30 in accordance with Embodiment 3 of the present invention with reference to FIG. 4. The on-vehicle antenna device 30 is obtained by replacing the antenna 11 of the on-vehicle antenna device 10 in accordance with Embodiment 1 with an antenna 31 which is described below.

(a) of FIG. 4 is a cross-sectional view illustrating a vehicle body 1 on which the on-vehicle antenna device 30 in accordance with Embodiment 3 is mounted. (b) of FIG. 4 is a development view illustrating the antenna 31 included in the on-vehicle antenna device 30.

The antenna 31 is different from the antenna 11 in locations at which the antenna 31 is bent into a U-shape. In other words, the antenna 31 is configured similarly to the antenna 11, except for the bending locations.

Specifically, in the antenna 31, the line D-D' which is one of the bending locations is a straight line that includes a feed point 33*b* and a side serving as a starting end of a second antenna element 35. Moreover, the line E-E' is employed which is a straight line closer to a terminal end of a first antenna element 34, as compared with the line C-C' in (b) of FIG. 2.

The antenna 31, which is being bent along the line D-D' and the line E-E' into the U-shape is placed inside the spoiler 16 (see (a) of FIG. 4). Specifically, a configuration is employed in which, in a case where the on-vehicle antenna device 30 is mounted at the rear end of the vehicle body 1, a feed point vicinity 34*a* of the first antenna element 34 is drawn out from a feed point 33*a* in the downward direction (i.e., a direction intersecting with the roof 20; the first direction) of the vehicle body 1, and the second antenna element 35 is drawn out from the feed point 33*b* in the forward direction (i.e., a direction along the roof 20; the second direction) of the vehicle body.

The antenna 31 further includes an overlapping section 35*b* which lies along a metallic member (spoiler fixing section 21*d*) constituting the rear end part of the roof 20 and overlaps with the metallic member while being apart from the metallic member. In Embodiment 3, the overlapping section 35*b* is provided in a part including a terminal end of the second antenna element 35. Note, however, that a location at which the overlapping section 35*b* is provided is not limited to the part including the terminal end, provided that the overlapping section 35*b* is provided in at least part of the second antenna element 35 which part extends in a direction along the roof 20. In a case where the overlapping section 35*b* overlaps with the spoiler fixing section 21*d* which is made up of an electric conductor, the spoiler fixing section 21*d* is used as a ground of the antenna 31, and it is possible to further increase a radiant gain in the forward direction of the vehicle body.

In Embodiment 3, the configuration is employed in which the overlapping section 35*b* is provided in a part of the second antenna element 35. Note, however, that it is possible to employ a configuration in which an overlapping section which is provided in a part of the first antenna element 34 overlaps with the spoiler fixing section 21*d*. It is possible to appropriately determine which one of the antenna elements 34 and 35 is to include the overlapping section, in accordance with a location of the connection section 33, shapes of the antenna elements 34 and 35, a shape of the spoiler 16, and a relative positional relation between the antenna 31 and the spoiler fixing section 21*d*.

[Embodiment 4]

Figure 5:
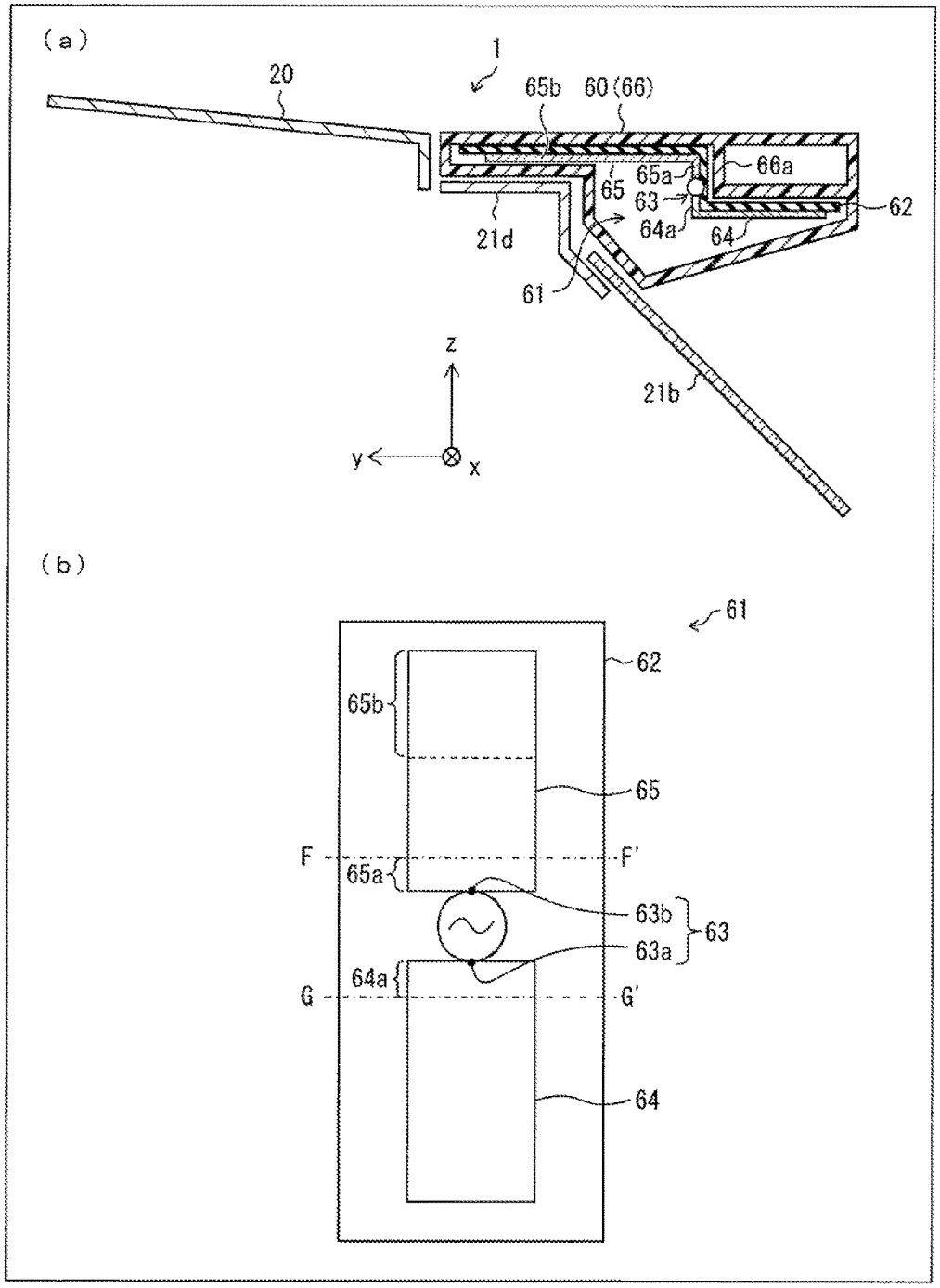

Next, the following description will discuss an on-vehicle antenna device 60 in accordance with Embodiment 4 of the present invention with reference to FIG. 5. The on-vehicle antenna device 60 is obtained by (i) replacing the spoiler 16, which serves as a housing of the on-vehicle antenna device 30 in accordance with Embodiment 3 (see FIG. 4) with a spoiler 66 and (ii) replacing the antenna 31 included in the on-vehicle antenna device 30 with an antenna 61.

(a) of FIG. 5 is a partially-magnified cross-sectional view illustrating a vehicle body 1 on which the on-vehicle antenna device 60 is mounted. (b) of FIG. 5 is a development view of the antenna 61 included in the on-vehicle antenna device 60.

As compared with the spoiler 16, the spoiler 66 is provided with an antenna base 66*a* which is arranged on an inner wall at a rear end part so that the antenna 61 is placed on the antenna base 66*a*. As illustrated in (a) of FIG. 5, the antenna base 66*a* is made up of a plane intersecting with the roof 20 and a plane which lies along the roof 20. Specifically, the antenna base 66*a* is made up of a plane extending in the up-and-down direction of the vehicle body 1 (i.e., a zx plane in coordinate axes shown in (a) of FIG. 5) and a plane extending in the front-and-rear direction of the vehicle body 1 (i.e., an xy plane in the coordinate axes shown in (a) of FIG. 5). The antenna base 66*a* forms a step projecting toward an inside of the spoiler 66.

The on-vehicle antenna device 60 is configured such that the antenna 61 is provided in a state of being bent along an internal shape of the spoiler 66. Fixing means for fixing the antenna 61 to the spoiler 66 can be fixing means similar to the fixing means for fixing each of the antennas 11 and 31 to the spoiler 16.

In order to place the antenna 61 in the spoiler 66, the antenna 61 is bent along the line F-F' in (b) of FIG. 5 such that a fold comes to an inner side and is bent along the line G-G' in (b) of FIG. 5 such that a fold comes to an outer side. As such, the antenna 61 is bent into a Z-shape. As illustrated in (a) of FIG. 5, the on-vehicle antenna device 60 employs a configuration in which the antenna 61, which is bent in the Z-shape, is fixed along the inner wall of the spoiler 66 and the antenna base 66*a*.

As illustrated in (a) of FIG. 5, in a case where the on-vehicle antenna device 60 is mounted at the rear end of the vehicle body 1, a first antenna element 64 of the antenna 61 is drawn out from a feed point 63*a* in the downward direction (corresponding to the first direction in claims) of the vehicle body 1 which direction intersects with the roof 20, and a second antenna element 65 is drawn out from a feed point 63*b* in the upward direction (corresponding to the second direction in claims) which intersects with the roof 20 and is different from the downward direction of the vehicle body 1. The on-vehicle antenna device 60 employs the configuration in which the first direction and the second direction intersect with the roof 20.

In the first antenna element 64, a part drawn out from the feed point 63*a* in the downward direction, that is, a part from a starting end (root) of the first antenna element 64 at which the first antenna element 64 is connected with the feed point 63*a* to the line G-G' along which the first antenna element 64 is bent such that a fold comes to an outer side is referred to as "feed point vicinity 64*a*".

The feed point vicinity 64*a* is drawn out from the feed point 63*a* in the downward direction, and therefore a direction of an electric current which flows in the feed point vicinity 64*a* is mainly the up-and-down direction. An electric current density of the electric current flowing in the first antenna element 64 is highest at the starting end of the first antenna element 64 (i.e., the connection section with the feed point 63*a*), and becomes lower as approaching a terminal end. From this, in the feed point vicinity 64*a*, an electric current having a relatively high electric current density flows in the up-and-down direction of the vehicle body 1. As a result, the first antenna element 64 can increase a ratio of a vertically polarized wave component contained in a radiated electromagnetic wave, as compared with a conventional technique (i.e., the on-vehicle antenna device disclosed in Patent Literature 1).

Further, the vertically polarized wave has a characteristic of hardly subjected to a damping effect by the roof 20, as compared with a horizontally polarized wave. Therefore, the on-vehicle antenna device 10 including the first antenna element 14 can sufficiently increase a radiant gain of the vertically polarized wave in a direction (in this case, forward direction) which goes across the roof 20, even in a case where the roof 20 is made of metal. As a result, even in a case where the roof is made of metal, it is possible to sufficiently increase a radiant gain of an electromagnetic wave in the direction going across the roof.

In the second antenna element 65, a part drawn out from the feed point 63*b* in the upward direction, that is, a part from a starting end (root) of the second antenna element 65 at which the second antenna element 65 is connected with the feed point 63*b* to the line F-F' along which the second antenna element 65 is bent such that a fold comes to an inner side is referred to as "feed point vicinity 65*a*". According to the configuration, as with the first antenna element 64, the second antenna element 65 can increase a ratio of a vertically polarized wave component contained in a radiated electromagnetic wave, as compared with a conventional technique (i.e., the on-vehicle antenna device disclosed in Patent Literature 1). Therefore, the antenna 61 can further increase a ratio of a vertically polarized wave component contained in a radiated electromagnetic wave, as compared with a conventional technique (i.e., the on-vehicle antenna device disclosed in Patent Literature 1).

The antenna 61 further includes an overlapping section 65*b* which lies along the roof 20 and overlaps with the spoiler fixing section 21*d*. In Embodiment 4, as with the overlapping section 35*b* provided in the antenna 31, the overlapping section 65*b* is provided in a part including a terminal end of the second antenna element 35. In a case where the overlapping section 65*b* overlaps with the spoiler fixing section 21*d* which is made up of an electric conductor, the spoiler fixing section 21*d* is used as a ground of the antenna 61, and it is possible to further increase a radiant gain in the forward direction of the vehicle body.

In Embodiment 4, the configuration is employed in which the overlapping section 65*b* is provided in a part of the second antenna element 65. Note, however, that it is possible to employ a configuration in which an overlapping section which is provided in a part of the first antenna element 64 overlaps with the spoiler fixing section 21*d*, as with Embodiment 3.

[Modified Example of Antenna]

The following description will discuss modified examples of the antennas 11, 11A, 31, and 61 respectively included in the on-vehicle antenna devices 10, 10A, 30, and 60 in accordance with Embodiments 1 through 4, with reference to FIGS. 6 through 9.

Figure 6:
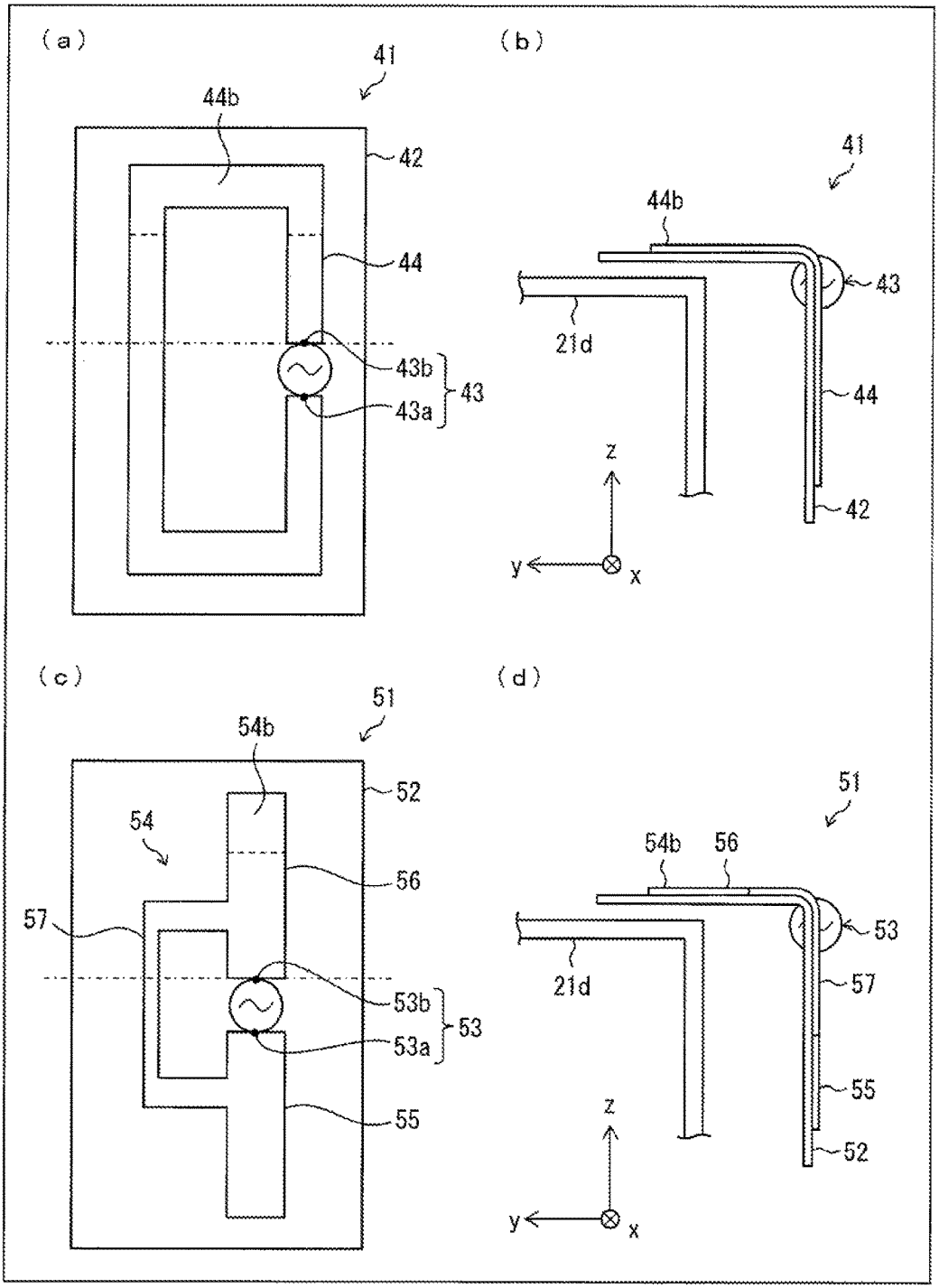
Figure 8:
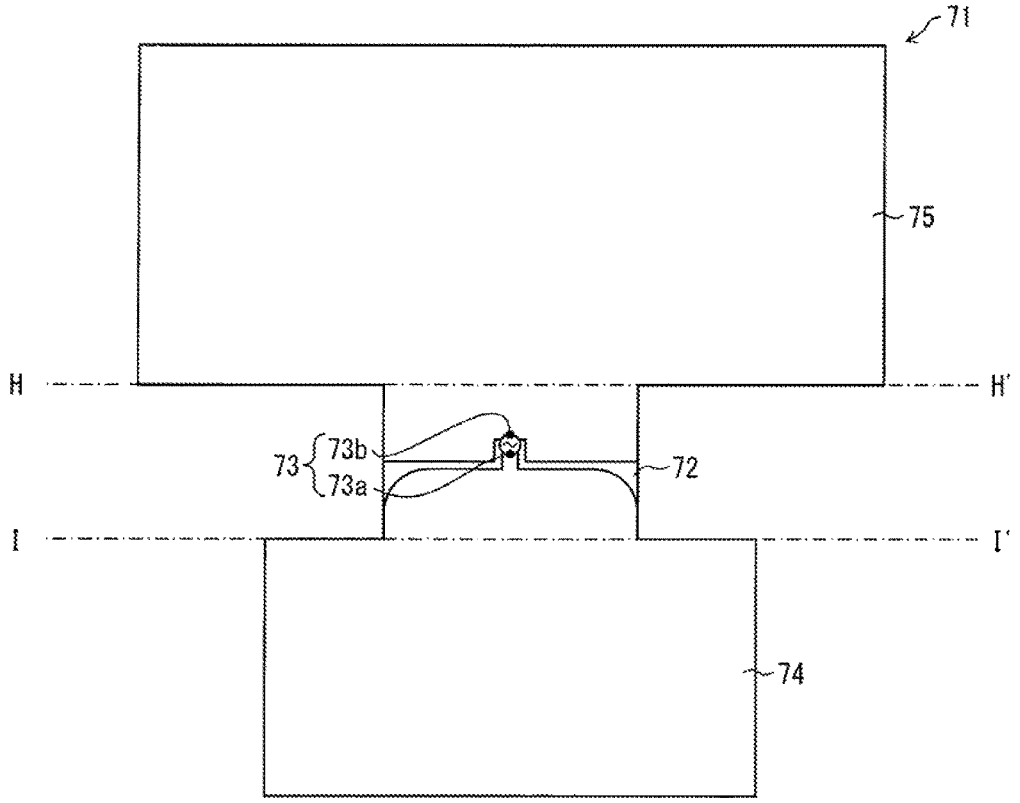
FIG. 8 is a development view illustrating another antenna in accordance with Modified Example 3.
Figure 9:
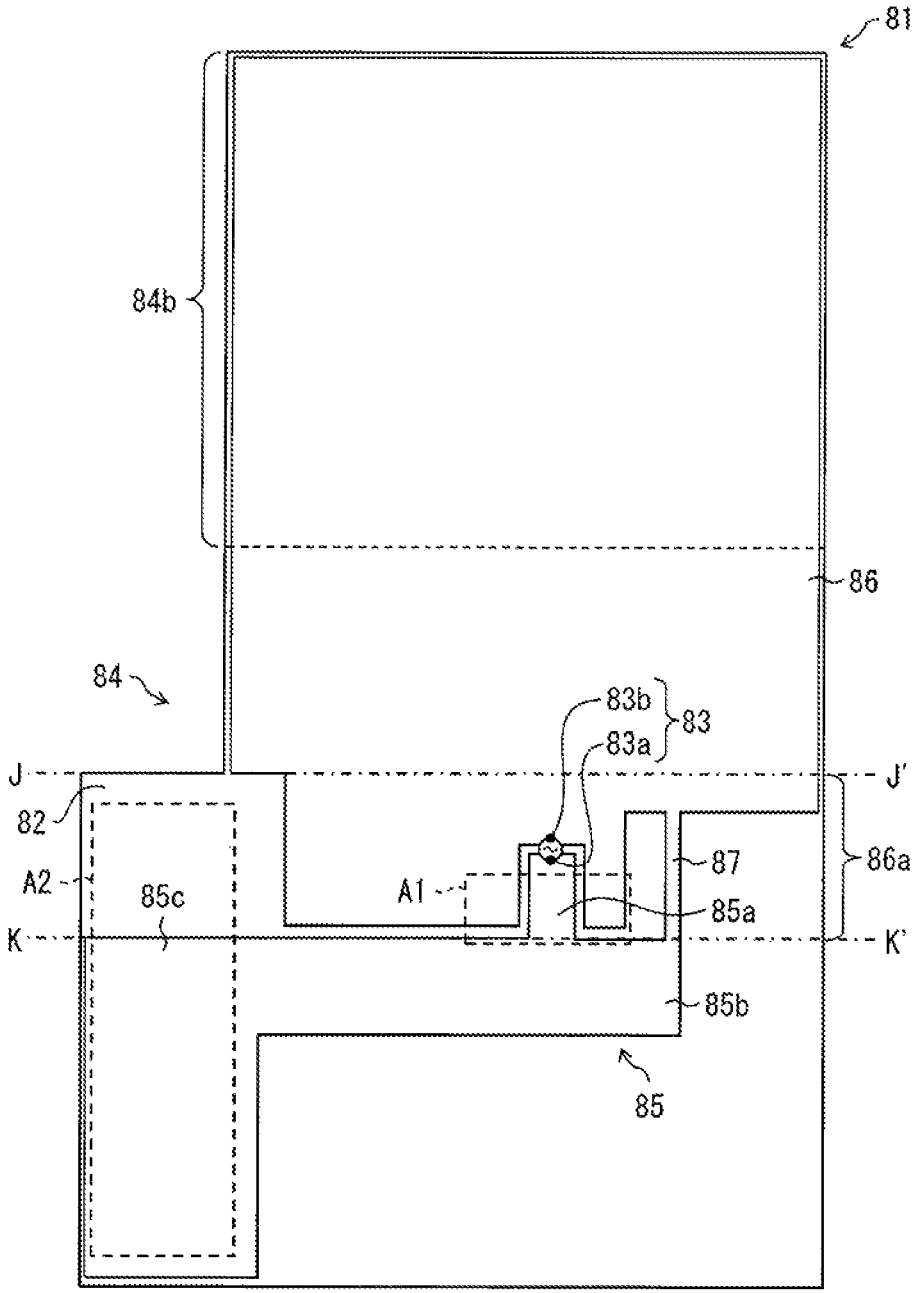
FIG. 9 is a development view illustrating an antenna in accordance with Modified Example 4.

(a) of FIG. 6 is a development view illustrating an antenna 41 in accordance with Modified Example 1, and (b) of FIG. 6 is a lateral view illustrating the antenna 41. (c) of FIG. 6 is a development view illustrating an antenna 51 in accordance with Modified Example 2, and (d) of FIG. 6 is a lateral view illustrating the antenna 51. In (b) of FIG. 6, the spoiler 16 serving as the housing is not illustrated in order to make the configuration of the antenna 41 simple. Similarly, the spoiler 16 is not illustrated in (d) of FIG. 6. FIG. 7 is a development view illustrating an antenna 71 in accordance with Modified Example 3. FIG. 8 is a development view illustrating another example of the antenna 71 illustrated in FIG. 7 in accordance with Modified Example 3. FIG. 9 is a development view illustrating an antenna 81 in accordance with Modified Example 4.

(Modified Example 1 and Modified Example 2)

As illustrated in (a) of FIG. 6, the antenna 41 includes a single and annular antenna element 44 which is drawn out from the feed point 43*a* in the downward direction (i.e., the direction intersecting with the roof 20) of the vehicle body 1 and is drawn out from the feed point 43*b* in the forward direction (i.e., the direction along the roof 20) of the vehicle body 1. That is, in Modified Example 1, the antenna 41 which is a loop antenna is employed instead of the antenna 11 which is a dipole antenna.

As illustrated in (c) of FIG. 6, the antenna 51 includes a single antenna element 54 which is made up of a first conductor 55 drawn out from the feed point 53*a* in the downward direction of the vehicle body 1 (i.e., the direction intersecting with the roof 20), a second conductor 56 drawn out from the feed point 53*b* in the forward direction of the vehicle body (i.e., the direction along the roof 20), and a third conductor 57 which connects a middle part of the first conductor 55 with a middle part of the second conductor 56.

In a case where the first conductor 55 serves as a ground plane in the antenna element 54, the third conductor 57 grounds the middle part of the second conductor 56. According to the configuration, the antenna 51 serves as an inverted F antenna.

In a case where the antenna element 54 employs a configuration in which electric power is fed to both the first conductor 55 and the second conductor 56, the antenna element 54 serves as an antenna element which is obtained by adding branches to an annular antenna element. In this case, the annular antenna element is made up of a section from the starting end to the middle part of the first conductor 55, a section from the starting end to the middle part of the second conductor 56, and the third conductor 57. One of the branches is made up of a section from the middle part to the terminal end of the first conductor 55, and the other of the branches is made up of a section from the middle part to the terminal end of the second conductor 56. According to the configuration, the antenna 51 serves as an antenna obtained by adding branches to a loop antenna.

As such, in Modified Example 2, the antenna 51 is employed which serves as an inverted F antenna or the antenna obtained by adding branches to a loop antenna, instead of the antenna 11 which is a dipole antenna.

Each of the antennas 41 and 51 included in the on-vehicle antenna devices in accordance with those modified examples includes the antenna element (44, 54) which is drawn out from the feed point (43*a*, 53*a*; one feed point) in the downward direction of the vehicle body (i.e., the negative direction of the z-axis in FIG. 6) and is drawn out from the feed point (43*b*, 53*b*; another feed point) in the forward direction of the vehicle body (i.e., the positive direction of the y-axis in FIG. 6). Therefore, the on-vehicle antenna devices in accordance with those modified examples make it possible to sufficiently increase a radiant intensity of an electromagnetic wave in the forward direction of the vehicle body.

(Modified Example 3)

As illustrated in FIG. 7, an antenna 71 in accordance with Modified Example 3 is obtained by causing a first antenna element 74 to have a bell-like shape (or a cup-like shape), as compared with the antennas 11, 11A, 31, and 61. Specifically, the first antenna element 74 having the bell-like shape is obtained by forming two of four corners of the first antenna element 74, which two are near to the second antenna element 75, into a quarter ellipse 74*b* and a quarter ellipse 74*c*, respectively. By thus changing the shape of the first antenna element 74 from the rectangular shape to the bell-like shape, it is possible to sequentially vary a distance between a feed point vicinity 74*a* of the first antenna element 74 and a feed point vicinity 75*a* of the second antenna element 75. As a result, it is possible to adjust a resonance frequency of the antenna 71, and accordingly an operating band can be adjusted.

Moreover, the first antenna element 74 has a feed point 73*a* which is provided at a projection part that is projecting from a side between two rounded corners. The first antenna element 74 thus configured is drawn out from the feed point 73*a* in the downward direction (corresponding to the first direction in claims) of the vehicle body 1 which direction intersects with the roof 20.

Meanwhile, the second antenna element 75 has a feed point 73*b* which is provided in the vicinity of a notch part that has been cut out in accordance with a shape of the projection part of the first antenna element 74. The second antenna element 75 thus configured is drawn out from the feed point 73*b* in the upward direction (corresponding to the second direction in claims) which intersects with the roof 20 and is different from the downward direction of the vehicle body 1.

Further, the antenna 71 illustrated in FIG. 7 employs a configuration in which the first direction and the second direction intersect with the roof 20, as with the antennas 11, 11A, and 61 respectively included in the on-vehicle antenna devices 10, 10A, and 60 in accordance with Embodiments 1, 2, and 4.

A width of the first antenna element 74 and the width of the second antenna element 75 are each configured to be ½ or less of a shortest wavelength of an electromagnetic wave that is transmitted from the antenna 71.

Specifically, for example, as with the antenna 11 included in the on-vehicle antenna device 10 in accordance with Embodiment 1, in the first antenna element 74, a part drawn out from the feed point 73*a* in the downward direction, that is, a part from a starting end (root) of the first antenna element 74 at which the first antenna element 74 is connected with the feed point 73*a* to the line I-I' along which the first antenna element 74 is bent such that a fold comes to an inner side is referred to as "feed point vicinity 74*a*". Moreover, in the second antenna element 75, a part drawn out from the feed point 73*b* in the upward direction, that is, a part from a starting end (root) of the second antenna element 75 to the line H-H' along which the second antenna element 75 is bent such that a fold comes to an inner side is referred to as "feed point vicinity 75*a*". Further, as with the antenna 61 included in the on-vehicle antenna device 60 in accordance with Embodiment 4, a part which includes a terminal end of the second antenna element 75 and is configured to overlap with the spoiler fixing section 21*d* is referred to as "overlapping section 75*b*".

Alternatively, for example, as with the antenna 31 included in the on-vehicle antenna device 30 in accordance with Embodiment 2, a part drawn out from the feed point 73*a* in the downward direction, that is, a part from a starting end (root) of the first antenna element 74 at which the first antenna element 74 is connected with the feed point 73*a* to the line I-I' along which the first antenna element 74 is bent such that a fold comes to an outer side is referred to as "feed point vicinity 74*a*". Moreover, in the second antenna element 75, a part drawn out from the feed point 73*b* in the upward direction, that is, a part from a starting end (root) of the second antenna element 75 to the line H-H' along which the second antenna element 75 is bent such that a fold comes to an inner side is referred to as "feed point vicinity 75*a*".

Alternatively, for example, as with the antenna 61 included in the on-vehicle antenna device 60 in accordance with Embodiment 4, a part drawn out from the feed point 73*a* in the downward direction, that is, a part from a starting end (root) of the first antenna element 74 at which the first antenna element 74 is connected with the feed point 73*a* to the line I-I' along which the first antenna element 74 is bent such that a fold comes to an outer side is referred to as "feed point vicinity 74*a*". Moreover, in the second antenna element 75, a part drawn out from the feed point 73*b* in the upward direction, that is, a part from a starting end (root) of the second antenna element 75 to the line H-H' along which the second antenna element 75 is bent such that a fold comes to an inner side is referred to as "feed point vicinity 75*a*". Further, the overlapping section 75*b* is provided in a part including the terminal end of the second antenna element 75 and is configure to lie along the spoiler fixing section 21*d* that constitutes the rear end of the roof 20 and to overlap with the spoiler fixing section 21*d* while being apart from the spoiler fixing section 21*d*.

The antenna 71 having the bell-like shape can be configured as illustrated in FIG. 8. That is, in the first antenna element 74, a part drawn out from the feed point 73*a* in the upward direction, that is, a part from a starting end (root) of the first antenna element 74 at which the first antenna element 74 is connected with the feed point 73*a* to the line I-I' along which the first antenna element 74 is bent such that a fold comes to an inner side (or bent such that a fold comes to an outer side) is referred to as "feed point vicinity". Moreover, a width of the feed point vicinity is configured to be ½ or less of a shortest wavelength of an electromagnetic wave that is radiated from the antenna. Further, a width of a region from the line I-I' to the terminal end is configured to be greater than the width of the feed point vicinity.

Similarly, in the second antenna element 75 also, a part drawn out from the feed point 73*b* in the downward direction, that is, a part from a starting end (root) of the second antenna element 75 to the line H-H' along which the second antenna element 75 is bent such that a fold comes to an inner side is referred to as "feed point vicinity". Moreover, a width of the feed point vicinity is configured to be ½ or less of a shortest wavelength of an electromagnetic wave that is radiated from the antenna. Further, a width of a region from the line H-H' to the terminal end is configured to be greater than the width of the feed point vicinity.

(Modified Example 4)

As illustrated in FIG. 9, an antenna 81 which is Modified Example 4 of the antenna 11 includes a single antenna element 84 which is made up of a first conductor 85 drawn out from a feed point 83*a* in the downward direction of the vehicle body 1 (i.e., the direction intersecting with the roof 20), a second conductor 86 drawn out from a feed point 83*b* in the upward direction of the vehicle body 1 (i.e., the direction intersecting with the roof 20), and a third conductor 87 which connects the first conductor 85 with the second conductor 86.

The first conductor 85 includes a feed point vicinity 85*a* drawn out from the feed point 83*a*, a conductor 85*b* which extends in the right-and-left direction of the vehicle body 1 in a case where the on-vehicle antenna device 60 is provided at the rear end of the roof 20, and a conductor 85*c* which extends in a direction intersecting with the conductor 85*b*, that is, in the front-and-rear direction of the vehicle body 1.

The second conductor 86 includes a feed point vicinity 86*a* drawn out from the feed point 83*b*. Moreover, an overlapping section 84*b* which is a region from a middle part to a terminal end of the second conductor 86 lies along the spoiler fixing section 21*d* and overlaps with the spoiler fixing section 21*d* while being apart from the spoiler fixing section 21*d*.

In the antenna 81 including the antenna element 84 thus configured, the feed point 83*a* is grounded, that is, the first conductor 85 serves as a ground plane, and thus the antenna 81 serves as an inverted F antenna.

In the on-vehicle antenna device 60 in accordance with Modified Example 4, it is possible to vary a resonance frequency of the antenna 81 by adjusting (i) a distance between the feed point vicinity 85*a* and the feed point vicinity 86*a* and (ii) a distance between the conductor 85*b* and the feed point vicinity 86*a* in a region A1. Consequently, it is possible to adjust an operating band of the on-vehicle antenna device 60. Similarly, a distance between the conductor 85*c* and the second conductor 86 can be adjusted in a region A2 by adjusting a shape of the conductor 85*c*, and consequently an operating b and of the on-vehicle antenna device 60 can be adjusted.

[Example 1]

The following description will discuss Example of the on-vehicle antenna device 10 in accordance with Embodiment 1. The on-vehicle antenna device 10 in accordance with Example 1 employs the antenna 71 illustrated in FIG. 8.

The on-vehicle antenna device 10 in accordance with Example 1 is mounted at a rear end of the roof 20 of the hatchback type vehicle body 1, specifically, an upper part of the hatch gate. An electromagnetic wave radiated from the antenna 11 is an electromagnetic wave at a frequency called 800 MHz band for LTE (specifically, 830 MHz).

Figure 10:
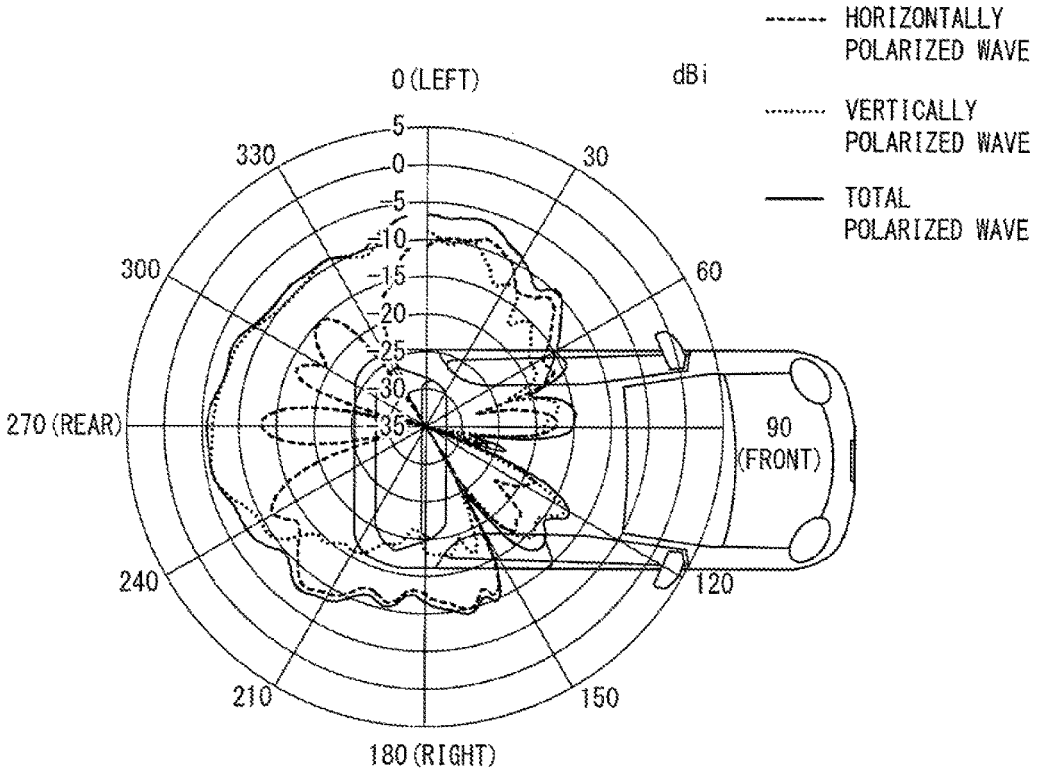
FIG. 10 is a graph showing direction dependency of a radiant gain in an xy plane obtained by an on-vehicle antenna device in accordance with Example 1.

FIG. 10 is a graph showing direction dependency of a radiant gain in an xy plane obtained by the on-vehicle antenna device 10 in accordance with Example 1. In FIG. 10, a dashed line represents a radiant gain of a horizontally polarized wave, a dotted line represents a radiant gain of a vertically polarized wave, and a solid line represents a sum of the horizontally polarized wave and the vertically polarized wave, that is, a radiant gain of a total polarized wave. A unit is [dBi].

According to FIG. 10, it is shown that the radiant gain in the forward direction of the vehicle body 1 is lower than the radiant gain in the backward direction of the vehicle body 1 but is higher than a radiant gain sufficient for the on-vehicle antenna device.

[Example 2]

The following description will discuss Example of the on-vehicle antenna device 10A in accordance with Embodiment 2. Working conditions are similar to those of Example 1. Note that the on-vehicle antenna device 10A in accordance with Example 2 employs, as the antenna 11A, the bell-like shaped antenna 71 illustrated in FIG. 7. Here, a total length of the antenna 71 thus employed (i.e., a sum of a length of the first antenna element 74 and a length of the second antenna element 75) is 1.43 times greater than a total length of the antenna 11 in accordance with Example 1 (i.e., a sum of a length of the first antenna element 14 and a length of the second antenna element 15).

The on-vehicle antenna device 10A in accordance with Example 2 is mounted at a rear end of the roof 20 of the hatchback type vehicle body 1, specifically, at an upper part of the hatch gate. An electromagnetic wave radiated from the antenna 11A is an electromagnetic wave at a frequency called 800 MHz band for LTE (specifically, 830 MHz).

Figure 11:
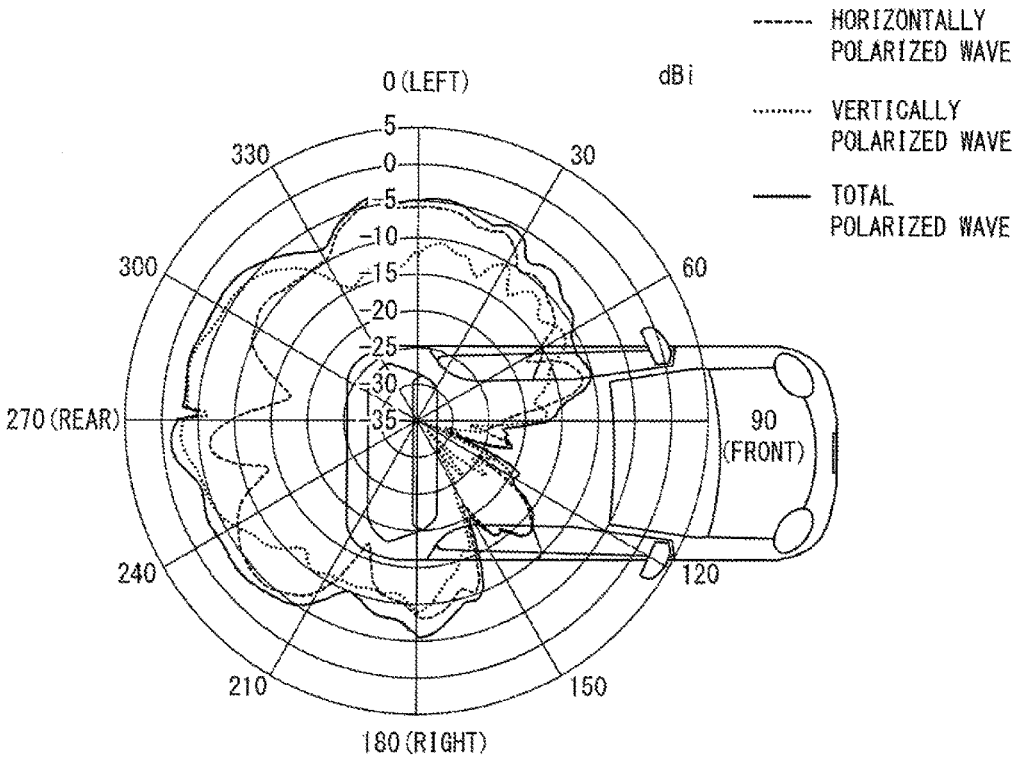
FIG. 11 is a graph showing direction dependency of a radiant gain in an xy plane obtained by an on-vehicle antenna device in accordance with Example 2.

FIG. 11 is a graph showing direction dependency of a radiant gain in an xy plane obtained by the on-vehicle antenna device 10A in accordance with Example 2. In FIG. 11, a dashed line represents a radiant gain of a horizontally polarized wave, a dotted line represents a radiant gain of a vertically polarized wave, and a solid line represents a sum of the horizontally polarized wave and the vertically polarized wave, that is, a radiant gain of a total polarized wave. A unit is [dBi].

According to FIG. 11, it is shown that the radiant gain in the forward direction of the vehicle body 1 is lower than the radiant gain in the backward direction of the vehicle body 1 but is higher than a radiant gain sufficient for the on-vehicle antenna device.

In a case where the direction dependency of the radiant gain in the xy plane obtained by the on-vehicle antenna device 10A is compared with the direction dependency of the radiant gain in the xy plane obtained by the on-vehicle antenna device 10 in accordance with Example 1 (see FIG. 10), the on-vehicle antenna device 10A exceeds the on-vehicle antenna device 10 in terms of the radiant gain in the forward direction and the radiant gain in the backward direction of the vehicle body 1. This seems to be because the antenna elements 14A and 15A (74 and 75) of the on-vehicle antenna device 10A extend along a longer side axis of the spoiler 16A, and the antenna elements 14A and 15A (74 and 75) are respectively longer than the antenna elements 14 and 15 of the on-vehicle antenna device 10.

[Example 3]

The following description will discuss Example of the on-vehicle antenna device 30 in accordance with Embodiment 3. Working conditions are similar to those of Example 1. Note that the on-vehicle antenna device 30 in accordance with Example 3 employs, as the antenna 31, an antenna element having a shape similar to that of the bell-like shaped antenna 71 illustrated in FIG. 7.

Figure 12:
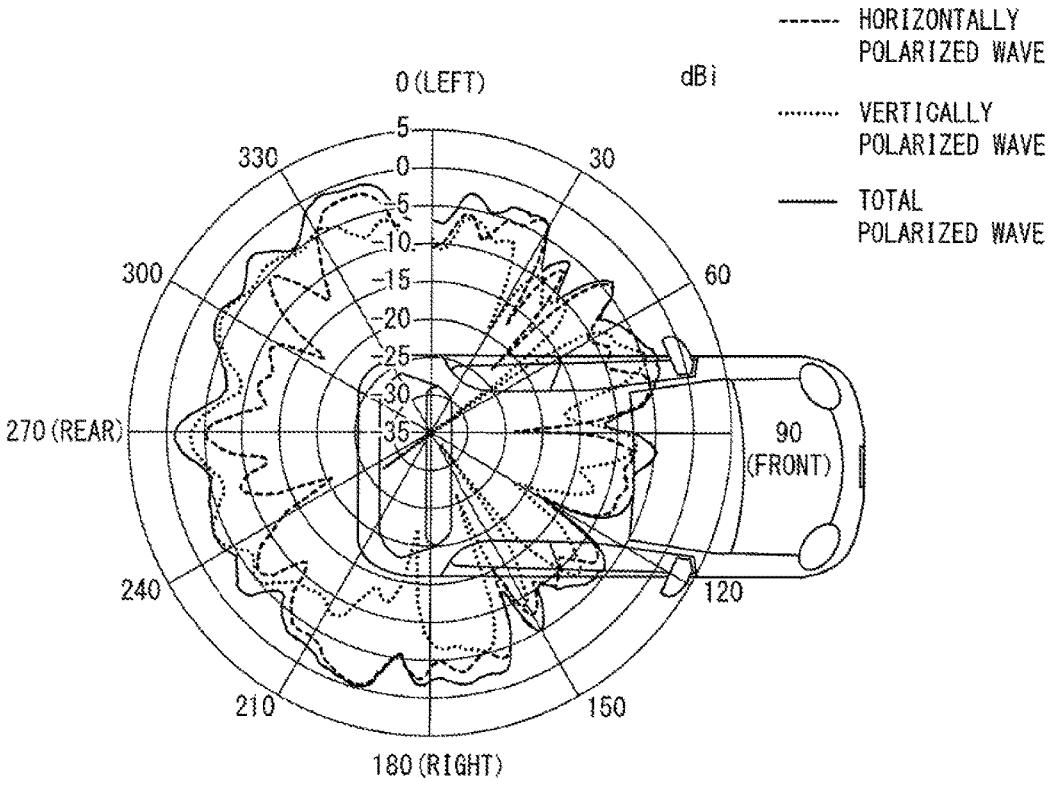
FIG. 12 is a graph showing direction dependency of a radiant gain in an xy plane obtained by an on-vehicle antenna device in accordance with Example 3.

FIG. 12 is a graph showing direction dependency of a radiant gain in an xy plane obtained by the on-vehicle antenna device 30 in accordance with Example 3. In FIG. 12, a dashed line represents a radiant gain of a horizontally polarized wave, a dotted line represents a radiant gain of a vertically polarized wave, and a solid line represents a sum of the horizontally polarized wave and the vertically polarized wave, that is, a radiant gain of a total polarized wave. A unit is [dBi].

It is shown that the radiant gain of the on-vehicle antenna device 30 in accordance with Example 3 is improved in all directions of the vehicle body 1, as compared with Example 1 illustrated in FIG. 10. In particular, the radiant gain is remarkably improved in the forward direction of the vehicle body 1. This improvement seems to be achieved by the configuration in which the overlapping section 35*b* including the terminal end of the second antenna element 35 overlaps with the roof 20.

[Example 4]

In Embodiments 1 through 4 above described, the on-vehicle antenna device in accordance with an embodiment of the present invention is provided at the rear end of the roof 20. As illustrated in FIG. 1, in the vehicle body 1, the hatch gate 21 is provided at the rear end of the roof 20. The rear glass 21*b* included in the hatch gate 21 has a plane made of an insulator. Under the circumstances, a film antenna is sometimes attached to an upper end side of the rear glass 21*b* for receiving broadcast signals for DTV or broadcast signals for FM.

In this case, the on-vehicle antenna device in accordance with an embodiment of the present invention is close to the film antenna attached to the rear glass 21*b*, and there is a possibility that electromagnetic coupling is generated between the antennas, and accordingly the antennas may influence each other.

In Example 4, in order to check the influence caused by the coupling between the antennas, the on-vehicle antenna device 10 in accordance with Embodiment 1 and a film antenna for TDV which is attached to an upper end side of the rear glass 21*b* (hereinafter, referred to as "DTV antenna") are used, and coupling generated between the on-vehicle antenna device 10 and the DTV antenna is measured.

(System of Measurement)

The following description will discuss a configuration of a system of measurement for measuring the coupling. The on-vehicle antenna device 10 in accordance with Embodiment 1 is connected to a first port of a network analyzer, and the DTV antenna is connected to a second port of the same network analyzer. The first port is an output port via which a high frequency signal is outputted from the network analyzer. The second port is an input port via which a high frequency signal is inputted to the network analyzer.

The on-vehicle antenna device 10 transmits a high frequency signal which has been supplied via the first port. The DTV antenna receives a high frequency signal which has been radiated from the on-vehicle antenna device 10 and supplies the high frequency signal to the second port. The network analyzer calculates an intensity of coupling generated between the on-vehicle antenna device 10 and the DTV antenna as a transmission characteristic S21, based on the high frequency signal which has been outputted via the first port and the high frequency signal which has been inputted via the second port.

As the intensity of coupling between the on-vehicle antenna device 10 and the DTV antenna increases, the DTV antenna efficiently receives a high frequency signal which has been transmitted from the on-vehicle antenna device 10. As a result, as the intensity of the coupling increases, the S21 becomes higher. That is, it is preferable to reduce the S21 in order to inhibit influences which are mutually exerted between the on-vehicle antenna device 10 and the DTV antenna.

(Configuration of On-vehicle Antenna Device 10)

In Example 4, two types of on-vehicle antenna devices 10 are employed which are obtained by changing a shape of the antenna 11 included in the on-vehicle antenna device 10. Specifically, the antenna 71 (see FIG. 7) is employed as an antenna of one of the on-vehicle antenna devices 10, and the antenna 81 (see FIG. 9) is employed as an antenna of the other of the on-vehicle antenna devices 10. Here, in each of the two types of on-vehicle antenna devices 10, each of the overlapping sections 74*b* and 84*b* of the antenna elements included in the antennas 71 and 81 lies along the spoiler fixing section 21*d* which is a metallic member, and overlaps with the spoiler fixing section 21*d* while being apart from the spoiler fixing section 21*d*. Moreover, a width of each of the antenna elements 74 and 75 which is measured along the rear end side of the roof 20 is ½ or less, specifically, approximately 1/2.8 of a shortest wavelength of an electromagnetic wave that is transmitted from the antenna 71. The antenna 71 is a dipole antenna including the antenna elements 74 and 75. The antenna 81 is an inverted F antenna including the first conductor 85, the second conductor 86, and the third conductor 87. The first conductor 85 is made up of the feed point vicinity 85*a*, the conductor 85*b*, and the conductor 85*c*. The feed point vicinity 85*a* is drawn out from the feed point 83*a* in the downward direction. The conductor 85*b* extends in the right-and-left direction of the vehicle body 1. The conductor 85*c* extends in the front-and-rear direction of the vehicle body 1.

(Configuration of DTV Antenna)

In Example 4, as the DTV antenna, the film antenna is employed in which a loop antenna having a rectangular shape is provided on the dielectric film. The DTV antenna is attached to the upper end side of the rear glass 21*b* such that a longer side direction of the loop antenna conforms to the right-and-left direction of the vehicle body 1. This arrangement is employed in order to prevent the DTV antenna from impairing rearward visibility of a driver of the vehicle body 1.

(S21)

Figure 13:
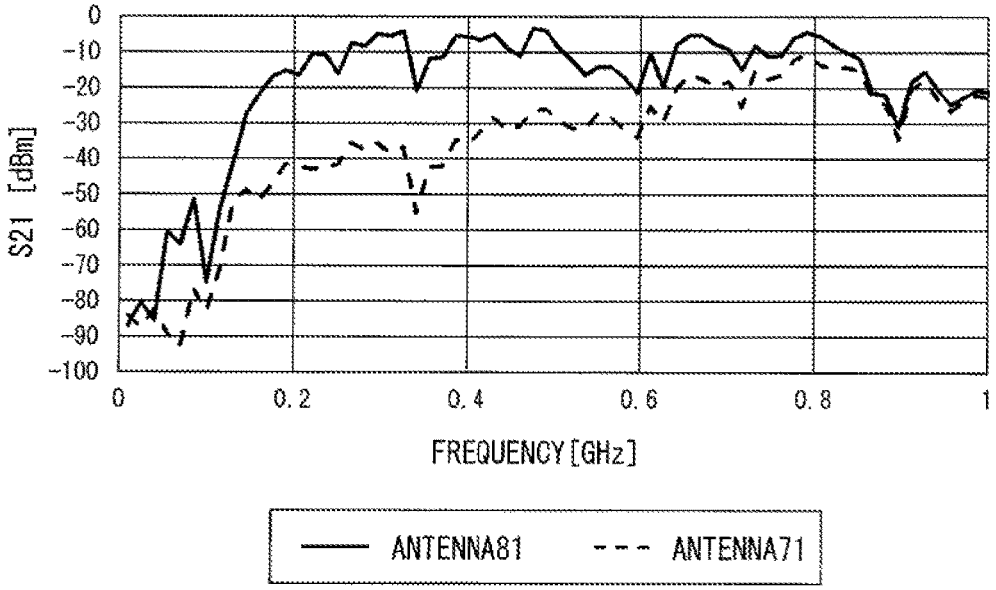
FIG. 13 is a graph showing an S21 obtained by an on-vehicle antenna device in accordance with Example 4.

FIG. 13 shows S21 which is a transmission characteristic measured in each of the on-vehicle antenna device 10 including the antenna 71 and the on-vehicle antenna device 10 including the antenna 81. As illustrated in FIG. 13, the S21 of the on-vehicle antenna device 10 including the antenna 71 is lower than the 821 of the on-vehicle antenna device 10 including the antenna 81. That is, the on-vehicle antenna device 10 including the antenna 71 is found to be able to further restrict coupling generated between the on-vehicle antenna device 10 and the DTV antenna, as compared with the on-vehicle antenna device 10 including the antenna 81.

This result can be understood as follows: In Example 4, the width of each of the antenna elements 74 and 75 included in the antenna 71 is ½ or less, specifically, approximately 1/2.8 of a shortest wavelength of an electromagnetic wave which is transmitted from the antenna 71. Therefore, directions in which (i) an electric current, which has been fed from the feed point 73*a*, flows in the first antenna element 74 and (ii) an electric current, which has been fed from the feed point 73*b*, flows in the second antenna element 75 are mostly restricted to the longer side direction of the antenna elements 74 and 75, that is, restricted to the front-and-rear direction of the vehicle body 1.

Meanwhile, the first conductor 85 included in the antenna 81 is provided with the conductor 85*b* which extends in the right-and-left direction of the vehicle body 1. Therefore, a direction in which an electric current flows, which has been fed from the feed point 83*a* and reaches the conductor 85*b* via the feed point vicinity 85*a*, is restricted to the right-and-left direction of the vehicle body 1.

Unlike the antenna 71 and the antenna 81 thus configured, the DTV antenna is attached such that the longer side direction of the loop antenna conforms to the right-and-left direction of the vehicle body 1. Therefore, the DTV antenna more efficiently receives a high frequency signal which oscillates in the right-and-left direction of the vehicle body 1, rather than a high frequency signal which oscillates in the front-and-rear direction of the vehicle body 1. The antenna 71 can restrict a main direction of an electric current, which flows in the antenna elements 74 and 75, to the front-and-rear direction of the vehicle body 1. As a result, the on-vehicle antenna device 10 including the antenna 71 can reduce an influence exerted to the DTV antenna or an influence received from the DTV antenna, as compared with the on-vehicle antenna device 10 including the antenna 81.

[Embodiment 5]

Figure 14:
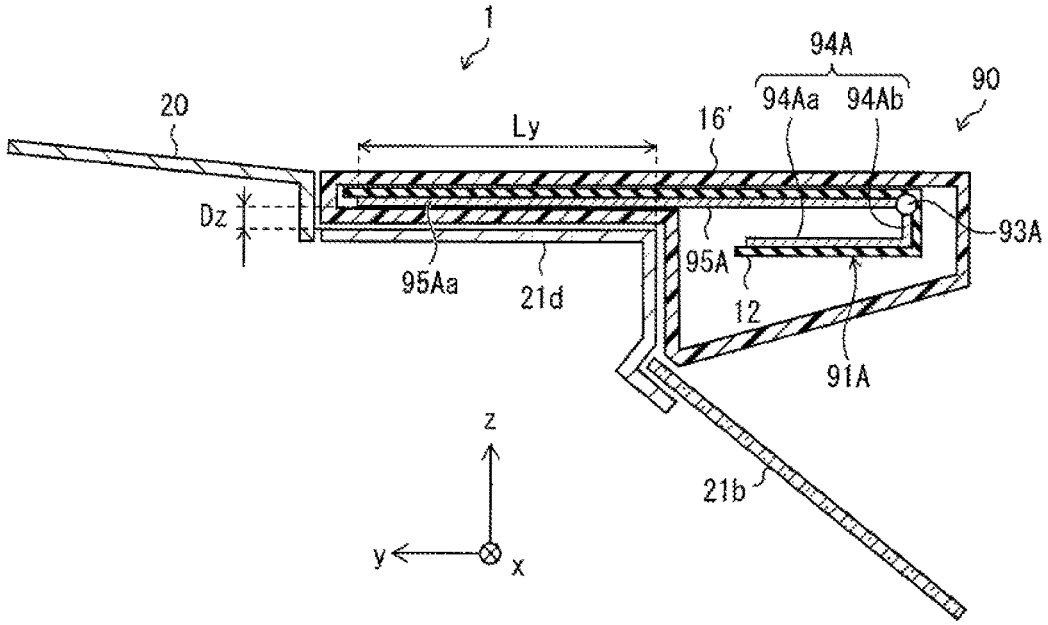
FIG. 14 is a cross-sectional view which is taken along the line A-A' in (b) of FIG. 1 and illustrates a partially magnified part of a vehicle body on which an on-vehicle antenna device in accordance with Embodiment 5 is mounted.
Figure 15:
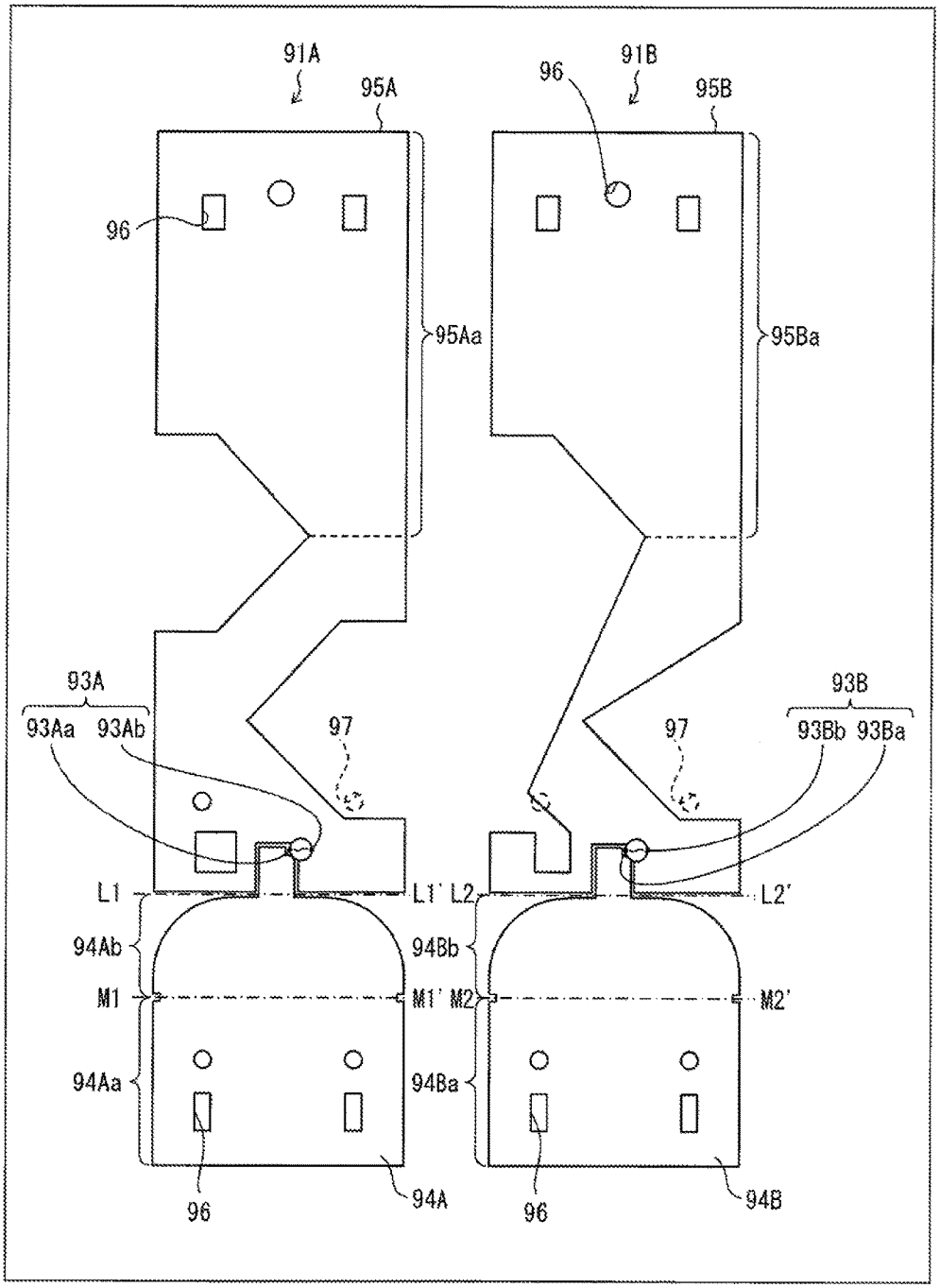
FIG. 15 is a development view illustrating flatly-developed two types of antennas each of which is included in the on-vehicle antenna device illustrated in FIG. 14.
Figure 16:
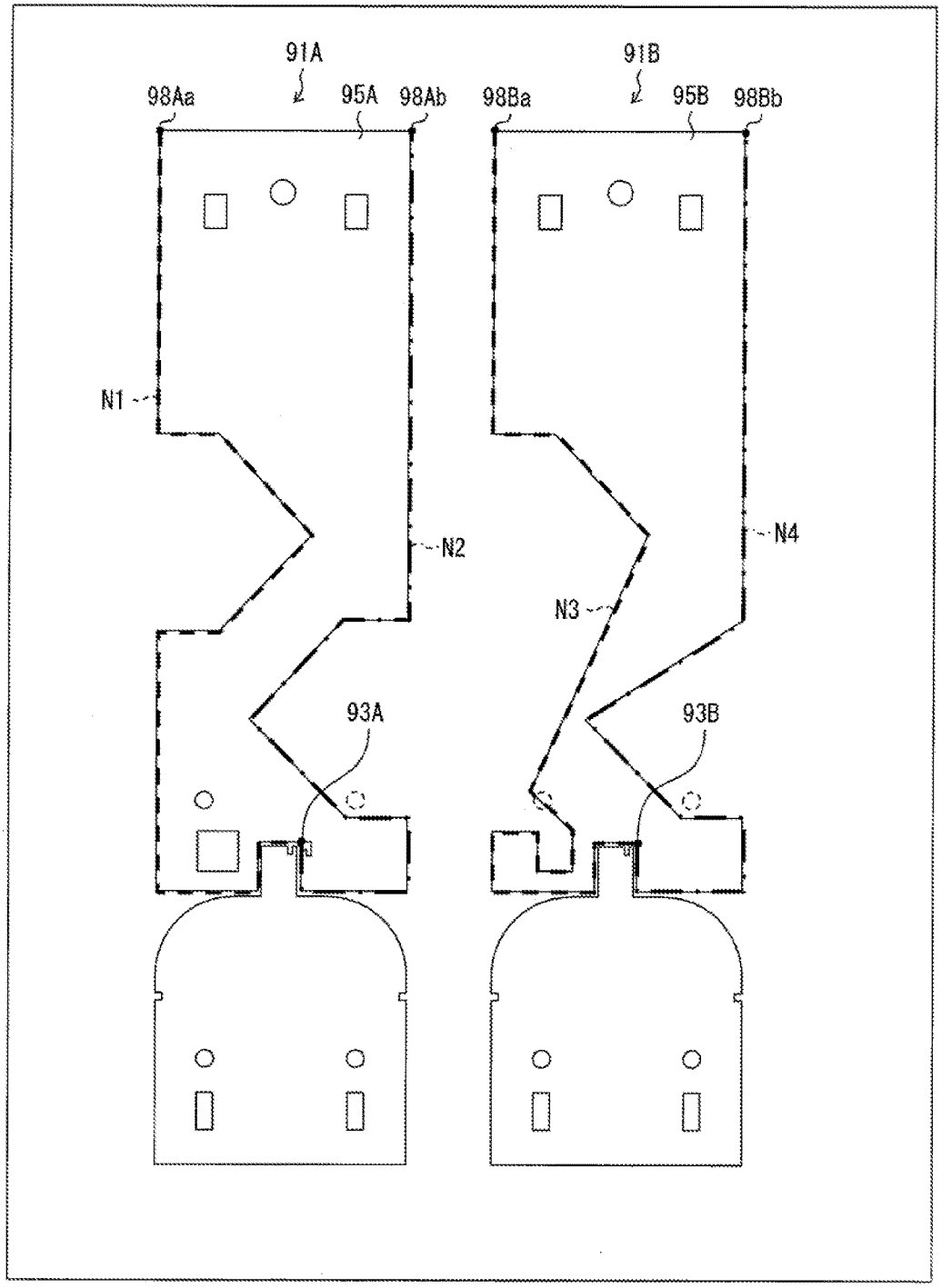
FIG. 16 is an explanatory view illustrating, in a dashed line and a dashed dotted line, shapes of two edges which connect a feed point with corner portions of each of the second antenna elements which respectively constitute the two types of antennas illustrated in FIG. 15, the corner portions being apart from the feed point in a longer side direction of each of the second antenna elements.

The following description will discuss an on-vehicle antenna device 90 in accordance with Embodiment 5 of the present invention, with reference to FIGS. 14 through 16. Note that, for convenience of explanation, identical reference numerals are given to constituent members having functions identical with those of the constituent members described in the above embodiments, and descriptions of such constituent members are omitted here.

FIG. 14 is a cross-sectional view which is taken along the line A-A' in (b) of FIG. 1 and illustrates a partially magnified part of a vehicle body 1 on which the on-vehicle antenna device 90 is mounted. The antenna is a development view illustrating flatly-developed antennas 91A and 91B each of which is included in the on-vehicle antenna device 90. Note that a dielectric film 12 is not illustrated in FIG. 15. FIG. 16 is an explanatory view illustrating, in a dashed line and a dashed dotted line, shapes of two edges each of which connects a feed point with a corner portion of each of antenna elements 95A and 95B which respectively constitute the antennas 91A and 91B, the corner portion being apart from the feed point in a longer side direction of each of the antenna elements 95A and 95B.

A spoiler 16' serving as a housing of the on-vehicle antenna device 90 is different in shape and size from the spoiler 16 illustrated in FIG. 2 or FIG. 4. However, this difference is not essential, and will therefore not be described in detail. Therefore, it is possible to configure the on-vehicle antenna device 90 by attaching the antenna 91A or 91B to the spoiler 16 illustrated in FIG. 2 or FIG. 4.

[On-vehicle Antenna Device 90]

The following description will discuss details of a configuration of the on-vehicle antenna device 90 with reference to FIG. 14. As illustrated in FIG. 14, the on-vehicle antenna device 90 is configured such that the antenna 91A or 91B in a state of being bent is provided inside the spoiler 16'. Note that the on-vehicle antenna device 90 is different from the on-vehicle antenna device 10 illustrated in FIG. 2 and the on-vehicle antenna device 30 illustrated in FIG. 4 in that the dielectric film 12, which is a constituent element of the antenna 91A or 91B, does not closely make contact with an inner wall of the spoiler 16'. In other words, in the on-vehicle antenna device 90, a space is provided between the dielectric film 12 and the inner wall of the spoiler 16'. By providing the space, it becomes easy to provide the antenna 91A or 91B inside the spoiler 16'.

The following description will discuss details of a bent state of the antenna 91A or 91B. The antenna 91A or 91B is bent into a U-shape, and consequently has an upper wall and a lower wall which face each other in the up-and-down direction (z-axis direction) of the vehicle body 1 and a standing wall which connects the upper wall with the lower wall. As illustrated in FIG. 14, the upper wall and the lower wall are parallel to the front-and-rear direction (y-axis direction) of the vehicle body 1. Moreover, the standing wall is parallel to the up-and-down direction (z-axis direction) of the vehicle body 1, and accordingly the standing wall forms an angle of 90 degrees with each of the upper wall and the lower wall.

Specifically, the space is provided as follows: that is, a space is provided between the standing wall and a rear wall of the spoiler 16' which rear wall is parallel to the standing wall; and a space is provided between the lower wall and a bottom wall of the spoiler 16' which bottom wall faces with the lower wall.

A fixing means for fixing the antenna 91A or 91B to the spoiler 16' can be identical with any of those described in the above embodiments. Alternatively, it is possible that a support is provided at an inner side of the U-shape into which the antenna 91A or 91B is bent, and the antenna 91A or 91B is fixed by being wound on the support. Note that the support is fixed to the spoiler 16'.

Alternatively, as illustrate in FIG. 15, it is possible that (i) a plurality of holes 96 and 97 are provided as appropriate in the first antenna element 94A or 94B, the second antenna element 95A or 95B, and the dielectric film 12 (not illustrated in FIG. 15) which constitute the antenna 91A or 91B and (ii) a plurality of protrusion parts (hook) are provided on the spoiler 16' and the support at locations corresponding to those of the plurality of holes 96 and 97. In this arrangement, it is possible to fix the antenna 91A or 91B by fitting the plurality of protrusion parts into the respective plurality of holes 96 and 97 or engaging the plurality of protrusion parts with the respective plurality of holes 96 and 97.

[Antenna 91A/91B]

A most important difference between the antenna 91A or 91B and the antenna 11 (FIG. 2), the antenna 31 (FIG. 4), the antenna 71 (FIG. 7), and the like is a shape of the second antenna element. Each of the first antenna elements 94A and 94B has a bell-like shape as with the first antenna element 74 (FIG. 7) in order to bring about the above described effect of adjusting an operating band. Note, however, that the shape is not limited to the bell-like shape.

Characteristics common to the second antenna elements 95A and 95B are as follows: that is, in a case where each of the second antenna elements 95A and 95B is considered to have a rectangular shape in which (i) a width is identical with a maximum width (among widths measured in the right-and-left direction (x-axis direction) of the vehicle body 1) of each of the second antenna elements 95A and 95B and (ii) longer sides thereof extend in the front-and-rear direction (y-axis direction) of the vehicle body 1, the two longer sides extending in the front-and-rear direction of the vehicle body 1 are recessed toward a center side of the rectangular shape. In other words, a notch or a recess is formed in each of longer side parts of, for example, a copper foil having the rectangular shape. Hereinafter, contour parts corresponding to the longer side parts of the second antenna elements 95A and 95B, in each of which a notch or a recess is formed, are referred to as "longer edge".

By thus setting shapes of the second antenna elements 95A and 95B, it is possible to secure a long distance over which an electric current flows along the longer edge, in accordance with a low-frequency band (698 MHz to 854 MHz) among a band (e.g., 698 MHz to 960 MHz which is an example of a mobile phone band) that is encompassed in the scope of the present invention.

An electric current which corresponds to an electromagnetic wave radiated from the antenna 91A and flows in each of the second antenna elements 95A and 95B flows on an upper surface, a lower surface, and peripheral edges of each of the second antenna elements 95A and 95B. In this case, an electric current density on the peripheral edges is greater than those on the upper surface and the lower surface. Therefore, by increasing a distance over which the electric current flows along the longer edges, it is possible to effectively expand a band of the antenna particularly to a low-frequency side. The following description will discuss details of configurations of the antennas 91A and 91B and of the distance.

(Antenna 91A)

As illustrated in FIG. 15, the antenna 91A includes (i) the first antenna element 94A having the bell-like shape and (ii) the second antenna element 95A having two longer edges in each of which the recess is provided. The configuration of the first antenna element 94A is basically identical with that of the first antenna element 74 illustrated in FIG. 7. In the second antenna element 95A, a recess provided near to a middle of left one of the two longer edges facing in the right-and-left direction of the vehicle body 1 has a home-plate-like shape. Note that an acute angle part (apex) of the home-plate-like shape faces in the rightward direction of the vehicle body 1.

Meanwhile, in the right longer edge, a recess having a home-plate-like shape whose acute angle part faces in the leftward direction of the vehicle body 1 is provided so as to avoid the recess in the left longer edge. Specifically, the recess is provided in the right longer edge in a location between the recess of the left longer edge and a connection section 93A that is provided on a boundary between the first antenna element 94A and the second antenna element 95A. Note, however, that locations at which the recesses are provided are not limited to those, and the recesses can be provided at any locations in the respective longer edges, provided that the purpose of extending the distance over which an electric current flows along the longer edge can be achieved.

The connection section 93A is provided at an arbitrary location in a section (in the vicinity of a connection section) at which a projection part of the first antenna element 94A fits into a notch part of the second antenna element 95A, as with the connection section 73 illustrated in FIG. 7. For example, the connection section 93A is provided in the vicinity of an upper right corner part of the projection part of the first antenna element 94A, as illustrated in FIG. 15. A first feed point 93Aa which is one feed point of the connection section 93A is connected with the first antenna element 94A, and a second feed point 93Ab which is another feed point of the connection section 93A is connected with the second antenna element 95A.

The antenna 91A is bent along the line L1-L1' and the line M1-M1' in FIG. 15 such that folds come to an inner side. Consequently, as illustrated in FIG. 14, the antenna 91A is bent into a U-shape such that the dielectric film 12 comes to an outer side and the antenna element 94A comes to an inner side. Further, the first antenna element 94A is drawn out from the first feed point 93Aa in the downward direction (corresponding to the first direction in claims) of the vehicle body 1 which direction intersects with the roof 20. Specifically, a first region 94Ab (feed point vicinity) of the first antenna element 94A between the line L1-L1' and the line M1-M1' is drawn out in the downward direction (corresponding to the first direction in claims) of the vehicle body 1. Moreover, a second region 94Aa that is continuous with the first region 94Ab is bent at an angle of 90 degrees with respect to the first region 94Ab, and extends in the forward direction of the vehicle body 1.

Meanwhile, the second antenna element 95A is drawn out from the second feed point 93Ab in the front-and-rear direction (corresponding to the second direction in claims) which goes along the roof 20 and is different from the downward direction of the vehicle body 1. Note that the second antenna element 95A mostly extends in the forward direction from the second feed point 93Ab, and also slightly extends in the backward direction from the second feed point 93Ab.

(Antenna 91B)

As illustrated in FIG. 15, the first antenna element 94B of the antenna 91B has a configuration identical with that of the first antenna element 94A. The second antenna element 95B has two longer edges which are provided with respective recesses. Note that shapes of the recesses are different from those of the respective two recesses in the second antenna element 95A.

Specifically, in the second antenna element 95B, a recess provided in left one of the two longer edges facing in the right-and-left direction of the vehicle body 1 has a shape obtained by modifying a home-plate-like shape whose apex faces in the rightward direction of the vehicle body 1. That is, one of two sides forming the apex of the home-plate-like shape (corresponding to two sides forming an isosceles triangle in a home plate) is longer than the other side and extends at an opening angle greater than that of the other side. As such, the one and the other sides correspond to the two sides forming an obtuse angle of a scalene triangle. Further, the one side is repeatedly bent so as to extend in a direction inclined relative to the front-and-rear direction of the vehicle body 1, in the front-and-rear direction of the vehicle body 1, and in the right-and-left direction of the vehicle body 1, and reaches the connection section 93B via the plurality of bending points, in order to increase a distance over which an electric current flows along the longer edge.

Meanwhile, in the right longer edge, a recess having a scalene triangle shape whose apex faces in the leftward direction of the vehicle body 1 is provided so as to avoid the recess in the left longer edge. Specifically, the recess is provided in the right longer edge in a location between the recess of the left longer edge and a connection section 93B that is provided on a boundary between the first antenna element 94B and the second antenna element 95B. Note, however, that locations at which the recesses are provided are not limited to those, and the recesses can be provided at any locations in the respective longer edges, provided that the purpose of extending the distance over which an electric current flows along the longer edge can be achieved. Alternatively, the recess in the left longer edge can have a scalene triangle shape that is similar to that of the recess in the right longer edge and is larger than the scalene triangle in the right longer edge.

The connection section 93B is provided at an arbitrary location in a section (in the vicinity of a connection section) at which a projection part of the first antenna element 94B fits into a notch part of the second antenna element 95B, as with the connection section 93A. A first feed point 93Ba which is one feed point of the connection section 93B is connected with the first antenna element 94B, and a second feed point 93Bb which is another feed point of the connection section 93B is connected with the second antenna element 95B.

The antenna 91B is bent along the line L2-L2' and the line M2-M2' in FIG. 15 such that folds come to an inner side. Consequently, as with the antenna 91A, the antenna 91B is bent into a U-shape. A first region 94Bb and a second region 94Ba of the first antenna element 94B respectively correspond to the first region 94Ab and the second region 94Aa of the first antenna element 94A. A manner in which the first antenna element 94B is drawn out from the first feed point 93Ba and a manner in which the second antenna element 95B is drawn out from the second feed point 93Bb are identical with those of the first antenna element 94A and the second antenna element 95A, respectively.

(Length of Longer Edge)

The following description will discuss lengths of the longer edges of the second antenna elements 95A and 95B. FIG. 16 is an explanatory view illustrating shapes of the longer edges of the second antenna elements 95A and 95B. As illustrated in FIG. 16, in the second antenna element 95A, an electric current is fed to the connection section 93A, and therefore the connection section 93A serves as a start point of a path along which the electric current flows. Moreover, a left corner and a right corner of the second antenna element 95A on a forward direction side serve as an end point 98Aa and an end point 98Ab of the path, respectively. Similarly, in the second antenna element 95B, the connection section 93B serves as a start point of a path along which the electric current flows, and a left corner and a right corner of the second antenna element 95B on a forward direction side serve as an end point 98Ba and an end point 98Bb of the path, respectively.

One of the two longer edges of the second antenna element 95A is a longer edge N1 (indicated by the dashed line in FIG. 16) which has a length from the connection section 93A to the end point 98Aa. The other of the two longer edges of the second antenna element 95A is a longer edge N2 (indicated by the dashed dotted line in FIG. 16) which has a length from the connection section 93A to the end point 98Ab. Similarly, the second antenna element 95B has a longer edge N3 which has a length from the connection section 93B to the end point 98Ba, and a longer edge N4 which has a length from the connection section 93B to the end point 98Bb.

Shapes and sizes of the recesses which are respectively provided in the longer edges N1 through N4 are selected so as to satisfy the following conditions: that is, a length of each of the longer edges N1 through N4 is equal to approximately ½ of a wavelength of a low-frequency band (e.g., 700 MHz to 730 MHz) which is intended to be broadened within a band of an electromagnetic wave that is radiated from the antenna is satisfied. Therefore, the shapes, the sizes, and the number of the recesses which are provided in the respective longer edges N1 through N4 can be arbitrarily set, provided that the above condition is satisfied.

(Characteristics of Antennas)

In a state where each of the antennas 91A and 91B is mounted on the vehicle body 1 as the on-vehicle antenna device 90 illustrated in FIG. 14, a radiant gain of each of the antennas 91A and 91B is calculated in regard to a forward direction side of the vehicle body 1. As a result, it has been found that the antennas 91A and 91B can broaden the entire band to the low-frequency side by the longer edges N1 through N4 which are provided in the second antenna elements 95A and 95B. Note that the antenna 91B further improves a radiant gain of a high-frequency band, as compared with the antenna 91A. Details will be described later with reference to FIGS. 18 and 19.

(Overlapping Section)

Note that, as illustrated in FIG. 14 and FIG. 15, the second antenna elements 95A and 95B include respective overlapping sections 95Aa and 95Ba each of which (i) lies along the spoiler fixing section 21*d* which is a metallic member constituting the roof 20 and (ii) overlaps with the spoiler fixing section 21*d* while being apart from the spoiler fixing section 21*d*. The overlapping sections 95Aa and 95Ba include respective ends of the second antenna elements 95A and 95B.

Each of the overlapping sections 95Aa and 95Ba has a length Ly. The length Ly is 64.5% or less of a total length of each of the second antenna elements 95A and 95B, more preferably 26.0% or more and 55.2% or less of the total length of each of the second antenna elements 95A and 95B.

By setting the length Ly to 64.5% or less of the total length in the spoiler 16', it is possible to obtain a larger gain in the direction going across the roof 20 from the spoiler 16' (i.e., the forward direction of the vehicle body 1 in Embodiment 5), as compared with a case where each of the second antenna elements 95A and 95B does not overlap with the spoiler fixing section 21*d*. Moreover, by setting the length Ly to 26.0% or more and 55.2% or less of the total length, it is possible to further increase a gain in the forward direction of the vehicle body 1.

A distance Dz between the spoiler fixing section 21*d* and each of the second antenna elements 95A and 95B in each of the overlapping sections 95Aa and 95Ba is less than 18 mm, more preferably less than 11 mm. In a case where, in the spoiler 16', each of the overlapping sections 95Aa and 95Ba overlaps with the spoiler fixing section 21*d* and the distance Dz in each of the overlapping sections 95Aa and 95Ba is less than 18 mm, it is possible to obtain a larger gain in the forward direction of the vehicle body 1, as compared with a case where each of the second antenna elements 95A and 95B does not overlap with the spoiler fixing section 21*d*. Moreover, by setting the distance Dz to less than 11 mm, it is possible to further increase a gain in the forward direction of the vehicle body 1.

In Embodiment 5, the spoiler 16' is configured such that each of the overlapping sections 95Aa and 95Ba lies along the spoiler fixing section 21*d* and overlaps with the spoiler fixing section 21*d* while being apart from the spoiler fixing section 21*d*. Note, however, that the spoiler 16' can be fixed to the roof 20. In that case, the spoiler 16' can be configured such that each of the overlapping sections 95Aa and 95Ba lies along a metallic member constituting the rear end of the roof 20 and overlaps with the metallic member while being apart from the metallic member.

A total length of each of the first antenna elements 94A and 94B and a total length of each of the second antenna elements 95A and 95B are not particularly limited, and can be determined as appropriate in accordance with a frequency of an electromagnetic wave which is intended to be radiated from each of the antennas 91A and 91B. The length Ly can be determined so as to fall within the above described range based on the total length of each of the second antenna elements 95A and 95B which has been set in accordance with a frequency of an electromagnetic wave intended to be radiated from each of the antennas 91A and 91B.

[Examples 5 Through 7]

The following description will discuss Examples 5 through 7 of the present invention. An on-vehicle antenna 10 in accordance with Example 5 employs the antenna 71 illustrated in (a) of FIG. 17. An on-vehicle antenna 90 in accordance with Example 6 employs the antenna 91A illustrated in (b) of FIG. 17. An antenna 90 in accordance with Example 7 employs the antenna 91B illustrated in (c) of FIG. 17. Each of (a) through (c) of FIG. 17 is a development view illustrating flatly developed antenna 71, antenna 91A, and antenna 91B, respectively.

(a) of FIG. 18 is a graph showing frequency dependency of radiant gains of the on-vehicle antenna device 70 including the antenna 71 and the on-vehicle antenna device 90 including the antenna 91A. (b) of FIG. 18 is a graph showing frequency dependency of VSWRs of the on-vehicle antenna device 70 including the antenna 71 and the on-vehicle antenna device 90 including the antenna 91A.

(a) of FIG. 19 is a graph showing frequency dependency of radiant gains of the on-vehicle antenna device 90 including the antenna 91A and the on-vehicle antenna device 90 including the antenna 91B. (b) of FIG. 19 is a graph showing frequency dependency of VSWRs of radiant gains of the on-vehicle antenna device 90 including the antenna 91A and the on-vehicle antenna device 90 including the antenna 91B.

The radiant gains and VSWRs of the on-vehicle antenna devices 70 and 90 are measured in a state in which each of the on-vehicle antenna devices 70 and 90 is mounted at the rear end of the roof 20 of the vehicle body 1. The radiant gains of the respective on-vehicle antenna devices 70 and 90 illustrated in (a) of FIG. 18 and (a) of FIG. 19 are values obtained by (i) calculating radiant gains in a plane along the roof 20 of the vehicle body 1 in all directions from each of the antennas 71, 91A, and 91B and (ii) summing the radiant gains in the all directions.

As shown in (a) of FIG. 18, the radiant gain of the on-vehicle antenna device 90 including the antenna 91A is higher than the radiant gain of the on-vehicle antenna device 70 including the antenna 71 in a frequency band of less than 0.8 GHz.

As shown in (b) of FIG. 18, the VSWR of the on-vehicle antenna device 90 including the antenna 91A is lower than the VSWR of the on-vehicle antenna device 70 including the antenna 71 in a frequency band of less than 0.8 GHz.

This is an effect brought about by the configuration in which the recess is provided in the second antenna element 95A of the antenna 91A. That is, by setting an edge length of the antenna 95A to be longer than an edge length of the antenna 71, it is possible to broaden a band of the on-vehicle antenna device 90 to a low-frequency side, as compared with a band of the on-vehicle antenna device 70.

As shown in (a) of FIG. 19, the radiant gain of the on-vehicle antenna device 90 including the antenna 91B is higher than the radiant gain of the on-vehicle antenna device 90 including the antenna 91A in a frequency band in the vicinity of 2 GHz.

As shown in (b) of FIG. 19, the VSWR of the on-vehicle antenna device 90 including the antenna 91B is lower than the VSWR of the on-vehicle antenna device 90 including the antenna 91A in a frequency band of 1.7 GHz or more and 2.3 GHz or less.

As such, the on-vehicle antenna device 90 including the antenna 91B has a better high-frequency band characteristic, as compared with the on-vehicle antenna device 90 including the antenna 91A.

[Further Modified Example of Antenna]

The following description will discuss, with reference to FIGS. 20 through 22, a modified example of the antenna 71 illustrated in FIG. 7. FIG. 20 is a development view illustrating a flatly developed antenna 71A which is a modified example of the antenna 71. (a) of FIG. 21 is a plan view illustrating the antenna 71A which is being bent in a U-shape and viewed from a direction perpendicular to a second antenna element 75A. (b) of FIG. 21 is a right-side lateral view illustrating the antenna 71 illustrated in (a) of FIG. 21. (c) of FIG. 21 is a cross sectional view taken along the line X-X' in (a) of FIG. 21. (a) of FIG. 22 is a development view illustrating a flatly developed antenna 71B which is another modified example of the antenna 71. (b) of FIG. 22 is a plan view illustrating the antenna 71B which is being bent in a U-shape and viewed from a direction perpendicular to a second antenna element 75B.

(Antenna 71A)

The antenna 71A is obtained by replacing the first antenna element 74 of the antenna 71 with a first antenna element 74A and replacing the second antenna element 75 of the antenna 71 with a second antenna element 75A.

As illustrated in FIG. 20, the first antenna element 74A is connected with one of conductors of a coaxial line (not illustrated) at one feed point 73Aa, and is made up of (i) a region including the one feed point 73Aa, (ii) a feed point vicinity 74Aa (first part recited in claims) which is a region from the line N-N' to the line O-O', and (iii) a second part 74Ab which is a region from the line O-O' to a terminal end (i.e., an end part opposite to the connection section 73A) of the first antenna element 74A. The feed point vicinity 74Aa is a part drawn out from the one feed point 73Aa in the first direction.

The second antenna element 75A is connected with the other of conductors of the coaxial line (not illustrated) at another feed point 73Ab, and is made up of (i) a root section 75Aa including the another feed point 73Ab, (ii) a branch section 75Ab, (iii) a neck section 75Ac, and (iv) a main section 75Ad.

The antenna 71A is bent along the line N-N' and the line O-O' in FIG. 20 such that folds come to an inner side, and the antenna 71A is thus bent into a U-shape so as to lie along a first plane P1 lying in the first direction, a second plane P2 lying in the second direction, and a third plane P3 which intersects with the first plane P1 and faces with the second plane P2. Consequently, as illustrated in FIG. 21, the antenna 71A is bent into the U-shape such that a dielectric film 72 comes to an outer side and the first and second antenna elements 74A and 75A come to an inner side.

In the state of being bent in the U-shape, the connection section 73A including the feed points 73Aa and 73Ab is arranged in the third plane P3 and in the vicinity of an intersection between the third plane P3 and the first plane P1.

(First Antenna Element 74A)

In the first antenna element 74A, the feed point vicinity 74Aa is arranged in the first plane P1, and the second part 74Ab is arranged in the third plane P3.

Moreover, the second antenna element 75A is arranged on the second plane P2. In this modified example, the second plane P2 and the third plane P3 are perpendicular to the first plane P1. That is, the second plane P2 and the third plane P3 are parallel to each other. The first plane P1, the second plane P2, and the third plane P3 respectively correspond to the first surface, the second surface, and the third surface which are recited in claims. In this modified example, flat planes are employed as the first surface, the second surface, and the third surface, respectively. Note, however, that it is possible to employ curved surfaces as the first surface, the second surface, and the third surface, respectively. Moreover, the second surface does not need to be parallel to the third surface.

The second part 74Ab of the first antenna element 74A is constituted by a first straight line section which extends from an end part of the feed point vicinity 74Aa in one direction. The one direction goes along the third plane P3 and goes away from the second plane P2. In this modified example, the first plane P1 and the third plane P3 are parallel to each other, and therefore the one direction conforms to the second direction.

(Second Antenna Element 75A)

As above described, the second antenna element 75A is connected with the another feed point 73Ab and is made up of the root section 75Aa, the branch section 75Ab, the neck section 75Ac, and the main section 75Ad.

The root section 75Aa is a conductor which is configured, in the second plane P2, to extend in the second direction from the another feed point 73Ab and to have a width smaller than that of the feed point vicinity 74Aa of the first antenna element 74A in a third direction (parallel to the line X-X' in FIG. 21) which intersects with the second direction. In a case where the width of the root section 75Aa in the third direction is smaller than that of the first part 74Aa of the first antenna element 74A, it is possible to accomplish an arrangement in which the second part 74Ab (first straight line section) extending from the first part 74Aa of the first antenna element 74A does not overlap with the root section 75Aa of the second antenna element.

The branch section 75Ab is a belt-shaped conductor which extends from the root section 75Aa in the third direction in the second plane P2. A length of the second part 74Ab extending from the first antenna element 74A and a length of the branch section 75Ab extending from the root section 75Aa are determined such that the second part 74Ab and the branch section 75Ab do not overlap with each other.

The neck section 75Ac is a belt-shaped conductor which, in the second plane P2, extends from an end part of the root section 75Aa in the second direction and is smaller in width than the root section 75Aa in the third direction.

The main section 75Ad is a conductor that is provided at an end part of the neck section 75Ac and has an elliptical shape.

As illustrated in the plan view of (a) of FIG. 21, when viewed from a direction perpendicular to the third plane P3, the second part 74Ab is arranged so as not to overlap with the feed point 73Aa of the first antenna element 74A that is arranged in the second plane P2. Moreover, the second part 74Ab does not overlap with the second antenna element 75A.

(Effect of Antenna 71A)

For example, the antenna 11 can be mounted in a small space by being bent in the U-shape. Meanwhile, the inventors of the present application have found the followings: that is, an antenna in a state of being flatly developed and an antenna being bent in a U-shape vary in radiation characteristic, and the radiation characteristic of the antenna being bent in the U-shape deteriorates, as compared with that of the antenna in the state of being flatly developed.

The antenna 71A employs the configuration in which the second part 74Ab of the first antenna element 74A does not overlap with the feed point 73Aa of the first antenna element 74A, and this makes it possible to inhibit the above described deterioration (i.e., deterioration caused in a case where the antenna is bent into the U-shape). This is because it is possible to reduce an electrostatic capacitance that is generated in the first antenna element 74A which is being bent, that is, it is possible to reduce an electrostatic capacitance that is generated between the second part 74Ab and the one feed point 73Aa.

Moreover, by employing the configuration of not overlapping with the second antenna element 75A, the antenna 71A can further inhibit the above described deterioration. This is because it is possible to reduce an electrostatic capacitance generated between the second part 74Ab and the second antenna element 75A which are respectively provided in the second plane P2 and the third plane P3 that face with each other.

Note that, in the antenna 71, change in input characteristic of the antenna caused by bending the antenna into the U-shape is cancelled by appropriately causing the antenna 71 to partially overlap with the end part of the roof 20 of the vehicle body 1. Therefore, in a case where the antenna 71 is used, the input characteristic of the antenna becomes sensitive to a location at which the antenna 71 is provided to the vehicle body 1 (roof 20), and this may lower versatility in providing the antenna 71 in various types of vehicles. The antenna 71A can inhibit the above described deterioration (caused by bending the antenna into the U-shape), and therefore has advantages that (i) the antenna 71A has a small change in input characteristic caused by providing the antenna, which is being bent into the U-shape, at the end part of the roof 20 of the vehicle body 1 and (ii) the antenna 71A can be used for various purposes.

It is known that impedance matching between (i) the coaxial line that is connected to the connection section 73A and (ii) the antenna 71A depends on an electrostatic capacitance that is generated between the first antenna element 74A and the second antenna element 75A. The antenna 71A configured as above described can improve the impedance matching and further improve the radiation characteristic of the antenna, as compared with a case where an electrostatic capacitance that is generated between the first antenna element and the second antenna element is generated only in a feeding region.

Moreover, the main section 75Ad has the elliptical shape, and this makes it possible to broaden a VSWR characteristic band on the low-frequency side of the frequency band in which the antenna 71A operates, as compared with an antenna element in which a main section has a rectangular shape.

(Distance Between Second Plane P2 and Third Plane P3)

In view of reducing a space in which the antenna 11 is mounted, it is preferable that a distance between the second plane P2 and the third plane P3, in other words, a distance between the line O-O' and the line N-N' is short. Hereinafter, the distance is referred to as "height h" of the antenna 11 (see (b) of FIG. 21).

However, as the height h becomes smaller, a distance d (see the cross sectional view in (c) of FIG. 21) between the root section 75Aa of the second antenna element 75A and the second part 74Ab of the first antenna element 74A becomes shorter.

In a case where the distance d is excessively short, an electrostatic capacitance generated between the second part 74Ab and the root section 75Aa of the second antenna element 75A may increase even in the configuration in which the second part 74Ab and the second antenna element 75A do not overlap with each other, and accordingly the radiation characteristic of the antenna may be decreased.

The inventors of the present application have found that deterioration in radiation characteristic can be sufficiently inhibited by employing a configuration in which the distance d is 1/20 or more, more preferably 1/16 or more of a wavelength, in vacuum, of an electromagnetic wave having a resonance frequency of the second part 74Ab.

Moreover, the second antenna element 75A includes the neck section 75Ac, and this makes it possible to inhibit interference caused by the coaxial line to the antenna device 71A, even in a case where the coaxial line is provided in the vicinity of the second antenna element 75A.

Therefore, it is possible to inhibit deterioration in radiation characteristic caused in a case where the antenna 71 is bent into the U-shape. Moreover, by appropriately adjusting a size of the neck section 75Ac, it is possible to adjust the operating band (mainly on the low-frequency side) of the antenna 71A.

(Antenna 71B)

The antenna 71B is obtained by replacing the first antenna element 74 of the antenna 71 with a first antenna element 74B and replacing the second antenna element 75 of the antenna 71 with a second antenna element 75B.

As illustrated in (a) of FIG. 22, the first antenna element 74B is connected with one feed point 73Ba, and is made up of (i) a feed point vicinity 74Ba (first part recited in claims) which is a region from the line P-P' to the line Q-Q' and (ii) a second part 74Bb and a third part 74Bd which are a region from the line Q-Q' to a terminal of the first antenna element 74A (i.e., an end part opposite to the connection section 73B).

The second antenna element 75B is connected with another feed point 73Bb, and is made up of a root section 75Ba, a thin neck section 75Bc, and a main section 75Bd.

The antenna 71B is bent along the line P-P' and the line Q-Q' in (a) of FIG. 22 such that folds come to an inner side, and the antenna 71B is thus bent into a U-shape so as to lie along a first plane P1 lying in the first direction, a second plane P2 lying in the second direction, and a third plane P3 which intersects with the first plane P1 and faces with the second plane P2. Consequently, as illustrated in (b) of FIG. 22, the antenna 71B is bent into the U-shape such that a dielectric film 72 comes to an outer side and the first and second antenna elements 74B and 75B come to an inner side.

The second part 74Bb of the first antenna element 74B is constituted by a first straight line section which extends from an end part of the feed point vicinity 74Aa in one direction, and a second straight line section which extends from an end part of the first straight line section (i.e., an end part opposite to the feed point vicinity 74Aa) in a direction intersecting with the first straight line section. The one direction goes along the third plane P3 and goes away from the second plane P2. In this modified example, the first plane P1 and the third plane P3 are parallel to each other, and therefore the one direction conforms to the second direction.

The third part 74Bd of the first antenna element 74B is constituted by a first straight line section that extends from the end part of the feed point vicinity 74Aa in the one direction.

The second antenna element 75B is connected with the another feed point 73Bb, and is made up of the root section 75Ba, the neck section 75Bc, and the main section 75Bd.

The root section 75Ba and the neck section 75Bc are respectively configured in manners similar to those of the root section 75Aa and the neck section 75Ac of the antenna 71A.

The main section 75Bd is provided at an end part of the neck section 75Bc, and is configured by regions 75Bd1 each of which extends in the second direction and regions 75*bd*2 each of which extends in the third direction. The regions 75Bd1 and the regions 75*bd*2 are alternately arranged so as to form a meander shape.

In this modified example, a configuration is employed in which a region 75*bd*2 is connected with the end part of the neck section 75Bc, and then two regions 75Bd1 and two regions 75Bd2 are alternately arranged. Note, however, that it is possible to appropriately determine (i) which one of the region 75Bd1 and the region 75Bd2 is to be connected to the end part of the neck section 75Bc and (ii) the number of sets of the region 75Bd1 and the region 75Bd2 to be provided.

As illustrated in a plan view of (b) of FIG. 22, when the second part 74Bb of the first antenna element 74B is viewed from a direction perpendicular to the third plane P3, the second part 74Bb and the third part 74Bd are arranged so as not to overlap with the feed point 73Ba of the first antenna element 74B. Moreover, the second part 74Bb does not overlap with the second antenna element 75B, except for an end region 74Bc which is an end part opposite to the first part 74Ba.

The antenna 71B thus configured has the configuration in which the second part 74Bb and the third part 74Bd do not overlap with the feed point 73Ba of the first antenna element 74B when the second part 74Bb of the first antenna element 74B is viewed in the direction perpendicular to the third plane P3. Therefore, the antenna 71B brings about an effect similar to that of the antenna 71A. Moreover, the main section 75Bd has the meander shape, and this makes it possible to reduce a length (i.e., a length from the line P-P' to the end part of the second antenna element 75B) of the second antenna element 75B while securing a long edge length of the second antenna element 75B. This allows further reduction in size of the antenna 71B.

Note that, in the antenna 71B, the end region 74Bc of the first antenna element 74B overlaps with the second antenna element 75B, and this makes it possible to improve impedance matching.

[Example 8]

(a) of FIG. 23 is a graph showing frequency dependency of VSWRs of the on-vehicle antenna device 70 including the antenna 71 in accordance with Example 5.

The solid line represents a VSWR measured in a state before the antenna 71 is bent into the U-shape, i.e., in a state where the antenna 71 is flatly developed. The dashed line represents a VSWR measured in a state where the antenna 71 is being bent in the U-shape. The dotted line represents a VSWR measured in a state where the antenna 71 which is being bent in the U-shape overlaps with a metal plate.

(b) of FIG. 23 is a graph showing frequency dependency of VSWRs of the above described on-vehicle antenna device 70 including the antenna 71A (Example 8). The solid line, the dashed line, and the dotted line represent VSWRs measured in a state where the antenna 71A is developed, a state where the antenna 71A is bent in the U-shape, and a state where the antenna 71A which is being bent overlaps with a metal plate, respectively, as with in (a) of FIG. 23.

The metal plate imitates a roof that is in a case where an on-vehicle antenna device is mounted on a vehicle body. Therefore, VSWRs which are obtained in a state where the on-vehicle antenna devices 70 in accordance with Examples 5 and 8 are actually used seem to be close to the VSWRs indicated by the dotted lines.

As shown in (a) of FIG. 23, in the antenna 71, the frequency dependency of the measured VSWRs remarkably varies when the states are changed as in the state of being developed, the state of being bent in the U-shape, and the state of overlapping with the metal plate.

On the other hand, as shown in (b) of FIG. 23, in the antenna 91B, the frequency dependency of the measured VSWRs is stable (i.e., hardly varies) even when the states are changed as in the state of being developed, the state of being bent in the U-shape, and the state of overlapping with the metal plate.

As such, it has been found that the antenna 71A can inhibit deterioration in radiation characteristic caused in a case where the antenna is bent into the U-shape, as compared with the antenna 71. Moreover, it has been found that the antenna 71A can also inhibit deterioration in radiation characteristic that can be caused in a case where the antenna which is being bent in the U-shape overlaps with the metal plate, as compared with the antenna 71.

Therefore, the antenna 71A makes it possible to simplify an adjusting step of adjusting (optimizing) an antenna pattern while feeding back measured radiation characteristics. This is because a difference in radiation characteristic between the state of being developed and a state of being actually used is small, and it is possible to adjust the antenna pattern by using the radiation characteristic in the state of being developed.

[Embodiment 6]

The following description will discuss Embodiment 6 of the present invention with reference to FIGS. 24 through 27.

[Schematic Configuration of On-vehicle Antenna Device 110]

First, the following description will discuss a schematic configuration of an on-vehicle antenna device in accordance with Embodiment 6, with reference to FIG. 24. (a) of FIG. 24 is a perspective view illustrating an appearance of a vehicle body 101 on which an on-vehicle antenna device 110 in accordance with Embodiment 6 is mounted. (b) of FIG. 24 is a partially-magnified plan view illustrating the vehicle body 101 on which the on-vehicle antenna device 110 in accordance with Embodiment 6 is mounted. Specifically, (b) of FIG. 24 is a magnified plan view illustrating the on-vehicle antenna device 110 mounted on the vehicle body 101.

The vehicle body 101 illustrated in (a) of FIG. 24 is configured in a manner similar to that of the vehicle body 1 illustrated in (a) of FIG. 1. That is, a roof 120 of the vehicle body 101 is configured in a manner similar to that of the roof 20 of the vehicle body 1. In the descriptions below, constituent members corresponding to those already described will not be repeatedly described in detail. The on-vehicle antenna device 110 in accordance with Embodiment 6 is mounted at a rear end of the roof 120, and a spoiler serves as a housing of the on-vehicle antenna device 110.

As illustrated in (b) of FIG. 24, a hatch gate 121 of the vehicle body 101 is configured in a manner similar to that of the hatch gate 21 of the vehicle body 1 illustrated in (b) of FIG. 1. Therefore, detailed descriptions of the hatch gate 121 are omitted here. A hatch gate panel 121*a*, a rear glass 121*b*, and a frame body 121*c* of the hatch gate 121 respectively correspond to the hatch gate panel 21*a*, the rear glass 21*b*, and the frame body 21*c* of the hatch gate 21. Moreover, a spoiler fixing section 121*d* of the hatch gate 121 corresponds to the spoiler fixing section 21*d* of the hatch gate 21.

The on-vehicle antenna device 110 is attached to the spoiler fixing section 121*d* with fixing means (e.g., bolt, clip, fastener, or the like; not illustrated). By thus fixing the on-vehicle antenna device 110 to the spoiler fixing section 121*d*, an upper surface of the on-vehicle antenna device 110 becomes substantially flush with an entire upper surface of the roof 120. The spoiler in which an antenna 111 and a stop lamp 119 are incorporated is made of a dielectric substance (e.g., resin or the like), and allows an electromagnetic wave to pass through.

The antenna 111 is arranged inside the spoiler at a location at which the antenna 111 does not interfere with the stop lamp 119. Specifically, the antenna 111 is arranged offset to a left side of the stop lamp 119 so as to avoid the stop lamp 119 which is arranged at a center of the spoiler in the right-and-left direction.

[On-vehicle Antenna Device 110]

The following description will discuss a specific configuration of the on-vehicle antenna device 110 with reference to FIG. 25. FIG. 25 illustrates a configuration of the on-vehicle antenna device 110 in accordance with Embodiment 6. (a) of FIG. 25 is a partially-magnified cross-sectional view which is taken along the line A-A' in (b) of FIG. 24 and illustrates the vehicle body 101 on which the on-vehicle antenna device 110 is mounted. (b) of FIG. 25 is a development view illustrating a state where the antenna 111 included in the on-vehicle antenna device 110 is flatly developed.

As illustrated in (a) of FIG. 25, the on-vehicle antenna device 110 is configured such that the antenna 111 which is being bent is placed inside the spoiler which serves as a housing. Examples of the fixing means for fixing the antenna 111 to the inside of the on-vehicle antenna device 110 encompass an adhesive sheet, a double-sided adhesive tape, a resin fastener, and the like. The fixing means is not limited and is preferably made of a member which is not electrically conductive so as not to interfere with transmission and reception of electromagnetic waves. A specific way of bending the antenna 111 and the like will be described later with reference to (b) of FIG. 25.

[Antenna 111]

As illustrated in (a) of FIG. 25, the antenna 111 includes a first antenna element 115, a second antenna element 114, and a connection section 113 with which the antenna elements 114 and 115 are connected with a coaxial line (not illustrated). In a case where the on-vehicle antenna device 110 is mounted at a rear end of the vehicle body 101, the second antenna element 114 of the antenna 111 is drawn out from a first feed point 113*b* which is one feed point in the forward direction (corresponding to the second direction in claims) of the vehicle body 101 which direction goes along the roof 120, and the first antenna element 115 is drawn out from a second feed point 113*a* which is another feed point in the downward direction (corresponding to the first direction in claims) of the vehicle body 101 which direction intersects with the roof 120.

The second antenna element 114 (*i*) lies along the spoiler fixing section 121*d* which is a metallic member that constitutes a rear end part of the roof 120 and (ii) includes an overlapping section 114*a* that overlaps with the spoiler fixing section 121*d* while being apart from the spoiler fixing section 121*d* and includes an end of the second antenna element 114.

A length Lx of the overlapping section 114*a* is 64.5% or less of a total length of the second antenna element 114, more preferably 26.0% or more and 55.2% or less of the total length of the second antenna element 114.

By setting the length Lx of an overlapping section of the second antenna element 114 to 64.5% or less of the total length of the second antenna element 114 in the on-vehicle antenna device 110, it is possible to increase a gain in the direction going across the roof 120 from the on-vehicle antenna device 110 (i.e., the forward direction of the vehicle body 101 in Embodiment 6), as compared with a case where the second antenna element 114 does not overlap with the spoiler fixing section 121*d*. Moreover, by setting the length Lx to 26.0% or more and 55.2% or less of the total length of the second antenna element 114, it is possible to further increase a gain in the forward direction of the vehicle body 101.

A distance Dz between the second antenna element 114 and the spoiler fixing section 121*d* in the overlapping section 114*a* is less than 18 mm, more preferably less than 11 mm.

In a case where the on-vehicle antenna device 110 is configured such that the overlapping section 114*a* of the second antenna element 114 overlaps with the spoiler fixing section 121*d* while being apart from the spoiler fixing section 121*d* and the distance Dz between the second antenna element 114 and the spoiler fixing section 121*d* in the overlapping section 114*a* is less than 18 mm, it is possible to increase a gain in the forward direction of the vehicle body 101, as compared with a case where the second antenna element 114 does not overlap with the spoiler fixing section 121*d*. Moreover, in a case where the distance Dz is set to less than 11 mm, it is possible to further increase the gain in the forward direction of the vehicle body 101.

In Embodiment 6, the on-vehicle antenna device 110 is configured such that the overlapping section 114*a* of the second antenna element 114 overlaps with the spoiler fixing section 121*d*. Note, however, that the on-vehicle antenna device 110 can be fixed to the roof 120. In such a case, the on-vehicle antenna device 110 can be configured such that the overlapping section 114*a* of the second antenna element 114 overlaps with a metallic member which constitutes the roof 120.

A total length of the second antenna element 114 and a total length of the first antenna element 115 are not particularly limited, and can be determined as appropriate in accordance with a frequency of an electromagnetic wave which is intended to be radiated from the antenna 111. The length Lx can be determined so as to fall within the above described range based on the total length of the second antenna element 114 which has been set in accordance with a frequency of an electromagnetic wave intended to be radiated from the antenna 111.

Note that a reason for the preferable range of the length Lx will be described later with reference to Example 9 and Modified Examples 7 through 11 (FIG. 26) of the present invention. Moreover, the preferable range of the distance Dz will be described later with reference to Example 9 and Modified Examples 12 through 15 (FIG. 27) of the present invention.

[Configuration of Antenna 111]

The antenna 111 is a film antenna and can be configured, for example, as follows. As illustrated in (b) of FIG. 25, in the antenna 111, an antenna pattern is provided on a dielectric film 112 which is an antenna substrate. A material of the dielectric film 112 can be, for example, polyimide resin but the material is not limited to this.

In the example illustrated in (b) of FIG. 25, the antenna element including the second antenna element 114 and the first antenna element 115 is provided on a surface of the dielectric film 112. Each of the second antenna element 114 and the first antenna element 115 is a thin plate member constituted by a conductor. Each of the second antenna element 114 and the first antenna element 115 can be, for example, a copper foil but the second antenna element 114 and the first antenna element 115 are not limited to this.

At the connection section 113 which is provided on surfaces of the second antenna element 114 and the first antenna element 115, the second antenna element 114 and the first antenna element 115 are connected with a coaxial line (not illustrated), and the connection section 113 includes feed points (pair of feed points) 113*a* and 113*b*. The connection section 113 is configured in a manner similar to that of the connection section 13.

In Embodiment 6, a dipole antenna is employed as the antenna 111. Note, however, that it is possible to use a loop antenna, a monopole antenna, or an inverted F antenna as the antenna 111. Moreover, each of the antenna elements can be a planar antenna element as with the second antenna element 114 and the first antenna element 115 of Embodiment 6 or can be a linear antenna element.

In Embodiment 6, the second antenna element 114 is constituted by a conductor having a rectangular shape, and is arranged such that a longer side of the rectangular shape extends in parallel with the front-and-rear direction of the vehicle body 101 in a case where the on-vehicle antenna device 110 is mounted on the vehicle body 101.

In Embodiment 6, the first antenna element 115 is a conductor made up of (i) a head section 115*a* having a bell-like shape and (ii) a neck section 115*d* which has a rectangular shape and is provided between the head section 115*a* and the second feed point 113*a*. The head section 115*a* has a substantially rectangular shape whose longer side extends in parallel with the up-and-down direction of the vehicle body 101 in a case where the on-vehicle antenna device 110 is mounted on the vehicle body 101, and two corners of the head section 115*a* on a second feed point 113*a* side are rounded. In other words, each of a region 115*b* and a region 115*c*, which respectively include the two corners of the head section 115*a* on the second feed point 113*a* side, has a shape of quarter ellipse.

The first antenna element 115 including the head section 115*a* makes it possible to sequentially vary a distance between the second antenna element 114 and the first antenna element 115. As a result, it is possible to adjust a resonance frequency of the antenna 111, and accordingly an operating band can be adjusted.

The antenna 111 is bent along the line B-B' and the line C-C' in (b) of FIG. 25 such that folds come to an inner side. Consequently, the antenna 111 is formed into a U-shape such that the dielectric film 112 comes to an outer side and the second antenna element 114 and the first antenna element 115 come to the inner inside. As illustrated in (a) of FIG. 25, the on-vehicle antenna device 110 has a configuration in which the antenna 111, which is being bent in the U-shape, is fixed along an inner wall of the spoiler which serves as the housing.

By thus bending the first antenna element 115, it is possible to reduce a volume of a space required for providing the first antenna element 115. Therefore, it is possible to provide the on-vehicle antenna device 110 which has a smaller size (i.e., lower height), as compared with a case where the first antenna element 115 is not bent.

Note that shapes of the second antenna element 114 and the second antenna element are not limited to those. For example, it is possible to employ, as the second antenna element 114, a conductor which includes (i) a head section having a bell-like shape and (ii) a neck section which has a rectangular shape and is provided between the head section and the first feed point 113*b*. Moreover, it is possible to employ, as the first antenna element 115, a conductor having a rectangular shape. The shapes of the region 115*b* and the region 115*c* do not need to be the quarter ellipse shape, provided that the region 115*b* and the region 115*c* are configured such that the distance between the second antenna element 114 and the first antenna element 115 becomes greater from the second feed point 113*a* to each of longer sides of the second antenna element.

[Example 9]

The following description will discuss Example 9 of the on-vehicle antenna device 110 in accordance with Embodiment 6 of the present invention. The on-vehicle antenna device 110 in accordance with Example 9 is obtained by setting, in the on-vehicle antenna device 110 in accordance with Embodiment 6 of the present invention, a total length of the second antenna element 114 to 120 mm, a total length of the first antenna element 115 to 44 mm, a length Lx of the overlapping section 114*a* to 60 mm, and a distance Dz to 10 mm. That is, in Example 9, the length Lx is 50.0% of the total length of the second antenna element 114.

As with the on-vehicle antenna device 110 in accordance with Embodiment 6 of the present invention, the on-vehicle antenna device 110 in accordance with Example 9 is mounted at a rear end of the roof 120 of the hatchback type vehicle body 101, specifically, at an upper part of the hatch gate. An electromagnetic wave radiated from the antenna 111 is an electromagnetic wave at a frequency called 800 MHz band for LTE (specifically, 832 MHz).

Moreover, as Comparative Example of the on-vehicle antenna device 110 in accordance with Embodiment 6 of the present invention, an on-vehicle antenna device is used in which a length Lx of an overlapping section of a second antenna element is 0 mm. In the on-vehicle antenna device in accordance with Comparative Example, a total length of the first antenna element, a total length of the second antenna element, and a distance Dz are respectively identical with those in the on-vehicle antenna device 110 in accordance with Example 9.

Radiant gains of the on-vehicle antenna device 110 in accordance with Example 9 and the on-vehicle antenna device in accordance with Comparative Example in the forward direction (i.e., a y-axis direction in (a) of FIG. 24) of the vehicle body 101 are calculated by numerical calculation. As a result, the radiant gain obtained in the forward direction of the vehicle body 101 by the on-vehicle antenna device in accordance with Comparative Example is −6.35 dB, whereas the radiant gain obtained in the forward direction of the vehicle body 101 by the on-vehicle antenna device 110 in accordance with Example 9 is −4.57 dB.

From those results, it has been found that the on-vehicle antenna device 110 in accordance with Example 9 can enhance the radiant gain in the forward direction of the vehicle body 101, as compared with the on-vehicle antenna device in accordance with Comparative Example. That is, it has been found that the on-vehicle antenna device 110 in which the length Lx is 60 mm can enhance the radiant gain in the direction going across the roof 120 in a case where the on-vehicle antenna device 110 is mounted at the end part of the roof 120 of the vehicle body 101, as compared with the on-vehicle antenna device in accordance with Comparative Example in which the length Lx is 0 mm.

[First Group of Modified Examples]

The following description will discuss, with reference to FIG. 26, a first group of modified examples of the on-vehicle antenna device 110 in accordance with Embodiment 6 of the present invention. The first group includes on-vehicle antenna devices 110 in accordance with Modified Examples 7 through 11 of the present invention.

In the on-vehicle antenna devices 110 in accordance with Modified Examples 7 through 11, a distance Dz is 10 mm, and lengths Lx are modified to 30 mm, 40 mm, 50 mm, 70 mm, and 90 mm. With use of the on-vehicle antenna devices 110 in accordance with Modified Examples 7 through 11 thus configured, radiant gains in the forward direction of the vehicle body 101 in an xy plane and radiant gains in the backward direction of the vehicle body 101 in the xy plane are obtained by numerical calculation.

(a) of FIG. 26 is a graph which shows a correlation between the length Lx and radiant gains which are obtained in the forward direction and the backward direction of the vehicle body 101 in the xy plane by the on-vehicle antenna devices 110 in accordance with Example 9, Modified Examples 7 through 11, and Comparative Example of the present invention.

The radiant gains which are obtained by the on-vehicle antenna device in accordance with Comparative Example are −6.35 dB in the forward direction of the vehicle body 101 and −1.21 dB in the backward direction of the vehicle body 101.

As shown in (a) of FIG. 26, it has been found that the radiant gains in the forward direction and the backward direction of the vehicle body 101 first increase and then decrease, as the length Lx becomes greater from 0 mm.

(b) of FIG. 26 is a graph showing a result obtained by fitting the radiant gains shown in (a) of FIG. 26 by a polynomial, specifically, by a quadric represented by $f(x)=ax^2+bx+c$. As a result of the fitting, it has been found that the radiant gains obtained by the on-vehicle antenna device 110 in accordance with Modified Example 7 and the on-vehicle antenna device in accordance with Comparative Example are better fit by a function system different from that of radiant gains obtained by the on-vehicle antenna devices 110 in accordance with Example 9 and Modified Examples 8 through 11. Under the circumstances, (b) of FIG. 26 shows only a result of fitting the radiant gains obtained by the on-vehicle antenna devices 110 in accordance with Example 9 and Modified Examples 8 through 11.

Note that a vertical axis in (b) of FIG. 26 plots a radiant gain of the on-vehicle antenna device 110 as a ratio of radiated electric power radiated from the on-vehicle antenna device 110 to inputted electric power inputted to the on-vehicle antenna device 110.

As a result of the fitting shown in (b) of FIG. 26, obtained coefficients a, b, and c of the quadric f(x) are as follows: $a=-1.66\times10^{-4}$, $b=1.61\times10^{-2}$, and $c=-2.58\times10^{-2}$.

The radiant gain of −6.35 dB, which is obtained in the forward direction of the vehicle body 101 by the on-vehicle antenna device in accordance with Comparative Example, is represented as 0.2316 in terms of the ratio of radiated electric power radiated from the on-vehicle antenna device 110 to inputted electric power inputted to the on-vehicle antenna device 110. As shown in (b) of FIG. 26, it has been found that the length Lx corresponding to 0.2316 is 77.35 mm. Therefore, the length Lx of the on-vehicle antenna device 110 in accordance with an aspect of the present invention is set to 64.5% or less of the total length of the second antenna element 114.

Moreover, it has been found that the radiant gain, which is in the backward direction of the vehicle body 101 and is obtained by the on-vehicle antenna device 110 configured such that the length Lx falls within the range, is greater than the radiant gain which is in the backward direction of the vehicle body 101 and is obtained by the on-vehicle antenna device in accordance with Comparative Example (see (a) of FIG. 26). As such, the on-vehicle antenna device 110 in accordance with the present invention can enhance a radiant gain in the forward direction of the vehicle body 101 without deteriorating a radiant gain in the backward direction of the vehicle body 101, as compared with the on-vehicle antenna device in accordance with Comparative Example.

A radiant gain of −5.0 dB, which is a more preferable radiant gain obtained by the on-vehicle antenna device 110, is represented as 0.3162 in terms of the ratio of radiated electric power radiated from the on-vehicle antenna device 110 to inputted electric power inputted to the on-vehicle antenna device 110. As shown in (b) of FIG. 26, it has been found that the length Lx corresponding to 0.3162 is 31.18 mm or more and 66.28 mm or less. From this, the length Lx of the on-vehicle antenna device 110 in accordance with an aspect of the present invention is preferably 26.0% or more and 55.2% or less of the total length of the second antenna element 114.

[Second Group of Modified Examples]

The following description will discuss, with reference to FIG. 27, a second group of modified examples of the on-vehicle antenna device 110 in accordance with Embodiment 6 of the present invention. The second group includes on-vehicle antenna devices 110 in accordance with Modified Examples 12 through 15 of the present invention.

In the on-vehicle antenna devices 110 in accordance with Modified Examples 12 through 15, a length Lx is 60 mm, and distances Dz are modified to 2.5 mm, 5.0 mm, 20 mm, and 40 mm. With use of the on-vehicle antenna devices 110 in accordance with Modified Examples 12 through 15 thus configured, radiant gains in the forward direction of the vehicle body 101 in an xy plane and radiant gains in the backward direction of the vehicle body 101 in the xy plane are obtained by numerical calculation.

(a) of FIG. 27 is a graph showing a correlation between a distance Dz and radiant gains which are obtained in the forward direction and the backward direction of the vehicle body 101 in an xy plane by each of the on-vehicle antenna devices 110 in accordance with Example 9 and Modified Examples 12 through 15 of the present invention.

As shown in (a) of FIG. 27, it has been found that the radiant gains in the forward direction and the backward direction of the vehicle body 101 are decreased as the distance Dz becomes greater. In other words, it has been found that it is preferable to set the distance Dz in the on-vehicle antenna device 110 as small as possible, ideally, to 0 mm. However, in actual practice, at least a base plate of the on-vehicle antenna device 110 exists between the second antenna element 114 and the spoiler fixing section 121*d* and, in some cases, fixing means for fixing the on-vehicle antenna device 110 to the spoiler fixing section 121*d* also exists between the second antenna element 114 and the spoiler fixing section 121*d*. Under the circumstances, the distance Dz is preferably as small as possible within a range in which the on-vehicle antenna device 110 can be fixed to the spoiler fixing section 121*d*.

(b) of FIG. 27 is a graph showing a result of fitting the radiant gains shown in (a) of FIG. 27 by a logarithmic function represented by $g(x)=d\log_e(x)+e$. As a result of the fitting, it has been found that the radiant gains obtained by the on-vehicle antenna devices 110 in accordance with Modified Examples 12 and 13 are better fit by a function system different from that of radiant gains obtained by the on-vehicle antenna devices 110 in accordance with Example 9 and Modified Examples 14 and 15. Under the circumstances, (b) of FIG. 27 shows only a result of fitting the radiant gains obtained by the on-vehicle antenna devices 110 in accordance with Example 9 and Modified Examples 14 and 15.

Note that a vertical axis in (b) of FIG. 27 plots a radiant gain of the on-vehicle antenna device 110 as a ratio of radiated electric power radiated from the on-vehicle antenna device 110 to inputted electric power inputted to the on-vehicle antenna device 110.

As a result of the fitting shown in (b) of FIG. 27, obtained coefficients d and e of the logarithmic function g(x) are as follows: $d=-1.71\times10^{-1}$, and $e=7.26\times10^{-1}$.

As a criterion for determining a range of the distance Dz also, the radiant gain is used which is obtained in the forward direction of the vehicle body 101 by the on-vehicle antenna device in accordance with Comparative Example, that is, −6.35 dB is used.

The radiant gain of −6.35 dB is represented as 0.2316 in terms of the ratio of radiated electric power radiated from the on-vehicle antenna device 110 to inputted electric power inputted to the on-vehicle antenna device 110. As shown in (b) of FIG. 27, it has been found that the distance Dz corresponding to 0.2316 is 18 mm (in two significant figures; 17.94 mm in four significant figures). Therefore, the distance Dz of the on-vehicle antenna device 110 in accordance with an aspect of the present invention is set to less than 18 mm.

A radiant gain of −5.0 dB, which is a more preferable radiant gain obtained by the on-vehicle antenna device 110, is represented as 0.3162 in terms of the ratio of radiated electric power radiated from the on-vehicle antenna device 110 to inputted electric power inputted to the on-vehicle antenna device 110. As shown in (b) of FIG. 27, it has been found that the distance Dz corresponding to 0.3162 is 11 mm (in two significant figures; 10.94 mm in four significant figures). From this, the distance Dz in the on-vehicle antenna device 110 in accordance with an aspect of the present invention is preferably less than 11 mm.

[Embodiment 7]

The following description will discuss Embodiment 7 of the present invention with reference to the drawings. In Embodiment 7, an on-vehicle antenna device is described in which a spoiler provided at a rear end of a roof serves as a housing. Note, however, that the present invention is not limited to this. That is, the present invention can be applied to an on-vehicle antenna device which is to be provided at a front end, a right end, or a left end of the roof.

[Schematic Configuration of On-vehicle Antenna Device 210]

First, the following description will discuss a schematic configuration of an on-vehicle antenna device in accordance with Embodiment 7 of the present invention, with reference to (a) of FIG. 28. (a) of FIG. 28 is a perspective view illustrating an appearance of a vehicle body 201 on which an on-vehicle antenna device 210, which is an example of the on-vehicle antenna device in accordance with Embodiment 7, is mounted.

The vehicle body 201 illustrated in (a) of FIG. 28 is configured in a manner similar to that of the vehicle body 1 illustrated in (a) of FIG. 1. That is, a roof 120 of the vehicle body 101 is configured in a manner similar to that of the roof 20 of the vehicle body 1. In the descriptions below, constituent members corresponding to those already described will not be repeatedly described in detail. The on-vehicle antenna device 210 in accordance with Embodiment 7 is an on-vehicle antenna device provided in a spoiler 211 which serves as a housing, and the on-vehicle antenna device 210 is mounted at a rear end of the roof 202.

An upper lateral surface of the vehicle body 201 includes a pillar 203 and windowpanes 204*a* through 204*c* which are incorporated in a front door and a rear door. In the vehicle body 201 in accordance with Embodiment 7, the pillar 203 is made up of an A-pillar 203*a*, a B-pillar 203*b*, a C-pillar 203*c*, and a D-pillar 203*d*.

The windowpane 204*a* is a window which is attached to the front door so as to be freely opened or closed. Similarly, the windowpane 204*b* is a window which is attached to the rear door so as to be freely opened or closed. The windowpane 204*c* is a fixed sash window which is provided between the C-pillar 203*c* and the D-pillar 203*d*.

The A-pillar 203*a* supports the roof 202 and a windshield. The B-pillar 203*b* is arranged on an interior side of the front door and the rear door so as to support the roof 202 and enhance strength of an opening that is formed in order to provide the front door and the rear door. The C-pillar 203*c* and the D-pillar 203*d* support the roof 202 and hold the windowpane 204*c*.

A hatch gate 205 of the vehicle body 201 is configured in a manner similar to that of the hatch gate 21 of the vehicle body 1 illustrated in (b) of FIG. 1. Therefore, the hatch gate 205 will not be described in detail. A hatch gate panel 251, a rear glass 252, and a frame body 253 of the hatch gate 205 respectively correspond to the hatch gate panel 21*a*, the rear glass 21*b*, and the frame body 21*c* of the hatch gate 21. Moreover, a spoiler fixing section 254 of the hatch gate 251 corresponds to the spoiler fixing section 21*d* of the hatch gate 21.

A spoiler 211 is attached to the spoiler fixing section 254 with fixing means (e.g., bolt or the like; not illustrated). By thus fixing the spoiler 211 to the spoiler fixing section 254, an upper surface of the spoiler 211 becomes substantially flush with an entire upper surface of the roof 202.

The antenna 214 is arranged inside the spoiler 211 at a location at which the antenna 214 does not interfere with the stop lamp 211*a*. Specifically, the antenna 214 is arranged on a left side of the stop lamp 211*a* so as to avoid the stop lamp 211*a* which is arranged at a center of the spoiler 211 in the right-and-left direction. In other words, the antenna element 212 is arranged between a vertical pole 253*a*, which is one of two vertical poles included in the frame body 253, and the stop lamp 211*a*. The vertical pole 253*a* is a metallic structure which is electrically connected with the spoiler fixing section 254 and extends in a direction intersecting with the roof 202.

[On-vehicle Antenna Device 210]

Next, the following description will specifically discuss a configuration of the on-vehicle antenna device 210 with reference to (b) of FIGS. 28 and 29. (b) of FIG. 28 is a partially-magnified cross-sectional view which is in a yz plane that passes the antenna element 212 illustrated in (a) of FIG. 28 and illustrates the vehicle body 201 on which the on-vehicle antenna device 210 is mounted. FIG. 29 is a development view illustrating a state where the antenna element 212 included in the on-vehicle antenna device 210 is flatly developed.

As illustrated in (b) of FIG. 28, the on-vehicle antenna device 210 is configured such that the antenna element 212 which is being bent is placed inside the spoiler 211. Specifically, the antenna 214 in which the antenna element 212 is provided on a dielectric film 213 is (i) bent into a U-shape such that the antenna element 212 comes to an inner side and the dielectric film 213 comes to an outer side, and (ii) fixed inside the spoiler 211. Examples of the fixing means for fixing the antenna 214 inside the spoiler 211 encompass an adhesive sheet, a double-sided adhesive tape, a resin fastener, and the like. The fixing means is not limited and is preferably made of a member which is not electrically conductive so as not to interfere with transmission and reception of electromagnetic waves. A specific way of bending the antenna element 212 and the like will be described later with reference to FIG. 29.

In Embodiment 7, an example will be described in which the on-vehicle antenna device 210 is mounted at a rear end of the roof 202. However, an end part of the roof 202 at which the on-vehicle antenna device 210 is mount is not limited to the rear end and can vary as appropriate depending on a shape of the vehicle body and a shape of a housing (in Embodiment 7, spoiler 211) of the on-vehicle antenna device 210.

[Antenna 214]

As illustrated in FIG. 29, the antenna 214 includes the antenna element 212, the dielectric film 213, and a connection section 212*b* with which a coaxial line (not illustrated) and the antenna element 212 are connected with each other. The antenna element 212 is provided on the dielectric film 213. A material of the dielectric film 213 can be, for example, polyimide resin but the material is not limited to this.

In the example illustrated in FIG. 29, the antenna element 212 which is provided on a surface of the dielectric film 213 includes a first antenna element 212*c* and a second antenna element 212*d*. Each of the first antenna element 212*c* and the second antenna element 212*d* is a thin plate member made of a conductor. Each of the first antenna element 212*c* and the second antenna element 212*d* can be, for example, a copper foil but is not limited to this.

The connection section 212*b* connects the coaxial line (not illustrated) with the first antenna element 212*c* and the second antenna element 212*d* and includes a first feed point 212*b*1 and a second feed point 212*b*2 (pair of feed points). The connection section 212*b* is configured in a manner similar to that of the connection section 13.

In Embodiment 7, a dipole antenna is employed as the antenna element 212. Note, however, that it is possible to use a loop antenna, a monopole antenna, or an inverted F antenna as the antenna element 212. Moreover, each of the antenna elements can be a planar antenna pattern as with the first antenna element 212*c* and the second antenna element 212*d* of Embodiment 7, or can be a linear antenna pattern.

In Embodiment 7, as an example of the dipole antenna, a copper foil having a bell-like shape is employed as the first antenna element 212*c*, and a copper foil having a rectangular shape is employed as the second antenna element 212*d*. The first antenna element 212*c* having a bell-like shape is formed from a copper foil having a rectangular shape. The first antenna element 212*c* having the bell-like shape is obtained by forming two of four corners of the copper foil having the rectangular shape, which two are near to the second antenna element 212*d*, into a quarter ellipse 212*c*2 and a quarter ellipse 212*c*3, respectively. By thus changing the shape of the first antenna element 212*c* from the rectangular shape to the bell-like shape, it is possible to sequentially vary a distance between a feed point vicinity 212*c*1 of the first antenna element 212*c* and the second antenna element 212*d*. As a result, it is possible to adjust a resonance frequency of the antenna element 212, and accordingly an operating band can be adjusted.

The antenna element 212 is bent along the line B-B' and the line C-C' in FIG. 29 such that folds come to an inner side, and is fixed inside the spoiler 211 while being bent in a U-shape (see (b) of FIG. 28). In a case where the on-vehicle antenna device 210 is mounted at the rear end of the vehicle body 201, the antenna element 212 has a part which is drawn out from the first feed point 212*b*1 in a direction (corresponding to the first direction in claims) intersecting with the roof 202. Further, the antenna element 212 is configured such that at least part of the antenna element 212 (*i*) lies along a metallic member constituting the rear end of the roof 202 and overlaps with the metallic member while being apart from the metallic member or (ii) lies along an antenna fixing section 254 for fixing the on-vehicle antenna device 210 to the rear end of the roof 202 and overlaps with the antenna fixing section 254 while being apart from the antenna fixing section 254.

As illustrated in (b) of FIG. 28, Embodiment 7 employs a configuration as follows: that is, in a case where the on-vehicle antenna device 210 is mounted at the rear end of the vehicle body 201, (1) the first antenna element 212*c* is drawn out from the first feed point 212*b*1 in the downward direction (corresponding to the first direction in claims) of the vehicle body 201 which direction intersects with the roof 202, (2) the second antenna element 212*d* is drawn out from the second feed point 212*b*2 in the forward direction (corresponding to the second direction in claims) going along the roof 202, and (3) the overlapping section 212*d*1 which is a part of the antenna element 212 overlaps with the spoiler fixing section 254. The overlapping section 212*d*1 is a part which (i) lies along the spoiler fixing section 254 which is a metallic member constituting a rear end part of the roof 202, (ii) overlaps with the spoiler fixing section 254 while being apart from the spoiler fixing section 254, and (iii) is from a middle to a terminal end of the second antenna element 212*d*.

In the first antenna element 212*c*, a part drawn out from the first feed point 212*b*1 in the downward direction, that is, a part from a starting end (root) of the first antenna element 212*c* at which the first antenna element 212*c* is connected with the first feed point 212*b*1 to the line C-C' along which the first antenna element 212*c* is bent such that a fold comes to an inner side is referred to as "feed point vicinity 212*c*1".

The feed point vicinity 212*c*1 is drawn out from the first feed point 212*b*1 in the downward direction, and therefore a direction of an electric current which flows in the feed point vicinity 212*c*1 is mainly the up-and-down direction. From this, the feed point vicinity 212*c*1 radiates a vertically polarized wave. The vertically polarized wave is hardly subjected to a damping effect by the roof 202 when passing across the roof 202, as compared with a horizontally polarized wave. In a case where the on-vehicle antenna device 210 is mounted at the rear end of the roof 202, the feed point vicinity 212*c*1 that radiates the vertically polarized wave makes it possible to reduce a loss, which is caused due to the damping effect by the roof 202, of radiant gain in the forward direction of the vehicle body 201.

Once a high-frequency current flows in the overlapping section 212*d*1, an induced current flows in the spoiler fixing section 254 and the vertical pole 253*a*. The vertical pole 253*a* extends in a direction intersecting with the roof 202, that is, in the up-and-down direction of the vehicle body 201. Therefore, a direction in which the induced current flows in the vertical pole 253*a* is mainly the up-and-down direction. From this, the vertical pole 253*a* radiates a vertically polarized wave. That is, in a case where the on-vehicle antenna device 210 is mounted at the rear end of the roof 202, the on-vehicle antenna device 210 can radiate the vertically polarized wave, which is hardly subjected to the damping effect by the roof 202, not only from the antenna element 212 but also from the vertical pole 253*a*.

A location of the antenna element 212 in the on-vehicle antenna device 210 is determined such that, in a case where the on-vehicle antenna device 210 is mounted on the vehicle body 201, a shortest distance from the vertical pole 253*a* to the antenna element 212 becomes ⅓ or more and ⅔ or less of a wavelength λo of a center frequency in an operating band of the antenna element 212 (details of this will be described later with reference to FIGS. 30 through 32).

According to the inventors' finding obtained from the studies, a gain of a vertically polarized wave in the forward direction of the vehicle body 201 (i.e., a direction going across the roof 202 from the antenna element 212), which gain is obtained in a case where the shortest distance from the vertical pole 253*a* to the antenna element 212 is ⅓ or more and ⅔ or less of the wavelength λo of the center frequency in the operating band, is greater than a gain of the vertically polarized wave obtained in a case where the vertical pole 253*a* is not provided. This seems to be because, in a case where the shortest distance from the vertical pole 253*a* to the antenna element 212 is set to ⅓ or more and ⅔ or less of the wavelength λo of the center frequency in the operating band, in the forward direction of the vehicle body 201, a vertically polarized wave radiated from the antenna element 212 and a vertically polarized wave radiated from the vertical pole 253*a* interfere with each other so as to reinforce each other.

That is, according to the on-vehicle antenna device 210 in accordance with Embodiment 7, it is possible to provide the on-vehicle antenna device in which a gain of a vertically polarized wave in the forward direction of the vehicle body 201 is enhanced by utilizing the vertical pole 253*a*. Therefore, the on-vehicle antenna device 210 can be suitably used also as an on-vehicle antenna device which utilizes a frequency band of a short wavelength which is typically of an electromagnetic wave for LTE.

Moreover, the shortest distance from the vertical pole 253*a* to the antenna element 212 is preferably ½ of the wavelength λo of the center frequency in the operating band. According to the configuration, it is possible to further enhance a gain of a vertically polarized wave in the forward direction of the vehicle body 201 by utilizing the vertical pole 253*a*.

In Embodiment 7, the spoiler 211 is fixed to the spoiler fixing section 254. Note, however, that the spoiler 211 can be fixed directly to the roof 202. In a case where the spoiler 211 is fixed to the roof 202, the D-pillar 203*d* extending in the up-and-down direction of the vehicle body 201 serves as a metallic structure. In that case, a location of the antenna element 212 in the on-vehicle antenna device 210 can be determined such that, in a case where the on-vehicle antenna device 210 is mounted on the vehicle body 201, a shortest distance from the D-pillar 203*d* to the antenna element 212 becomes ⅓ or more and ⅔ or less of the wavelength λo of the center frequency in the operating band.

The metallic structure is preferably a member which constitutes the vehicle body 201, as with the vertical pole 253*a* and the D-pillar 203*d*. Note, however, that the metallic structure can be any of an electric conductor plate, a conductor bar, and a conductor pipe each of which is provided to the spoiler fixing section 254 or the roof 202 and extends in a direction intersecting with the roof 202.

[Method for Setting Up Antenna Element]

A setting up method in accordance with an embodiment of the present invention is a method for setting up the on-vehicle antenna device 210 at the end part of the roof 202 of the vehicle body 201 while satisfying the following three conditions:

Condition 1: The antenna element 212 is drawn out from one feed point in the direction (corresponding to the first direction in claims) intersecting with the roof 202.

Condition 2: At least part of the antenna element 212 overlaps with the roof 202 or the antenna fixing section 254 for fixing the on-vehicle antenna device 210 to the rear end of the roof 202.

Condition 3: A shortest distance Dx from a metallic structure (in Embodiment 7, the vertical pole 253*a*) which is electrically connected with the roof 202 or the antenna fixing section 254 and extends in the direction intersecting with the roof 202 to the antenna element 212 is ⅓ or more and ⅔ or less of the wavelength λo of the center frequency in the operating band of the antenna element 212.

The setting up method brings about an effect similar to that of the on-vehicle antenna device 210.

[Series of Examples]

The following description will discuss on-vehicle antenna devices 210 in accordance with a series of Examples of the present invention with respect to FIGS. 30 through 32. (a) of FIG. 30 is a top view illustrating a configuration of a model of the vehicle body 201 on which the on-vehicle antenna device 210 is mounted, the model being used to calculate a radiant gain of each of the on-vehicle antenna devices 210 in the series of Examples. (b) of FIG. 30 is a lateral view illustrating a configuration of the model. (a) of FIG. 31 is a partially-magnified top view illustrating the model illustrated in (a) of FIG. 30. (b) of FIG. 31 is a partially-magnified lateral view illustrating the model illustrated in (b) of FIG. 30. FIG. 32 is a graph showing radiant gains which are obtained in the forward direction of the vehicle body 201 by the respective on-vehicle antenna devices 210 in accordance with the series of Examples.

In order to simply show a relation between the antenna element 212 and the vertical pole 253*a*, in FIGS. 30 and 31, the spoiler 211 which is a housing of the on-vehicle antenna device 210 is not illustrated.

As illustrated in (a) and (b) of FIG. 30, the antenna element 212 is arranged at a rear end of the roof 202 while being displaced to a left side from a center of the vehicle body 201 in the right-and-left direction.

In the series of Examples, a shortest distance Dx from the vertical pole 253*a* to the antenna element 212, a length Ly of the overlapping section 212*d*1 in the front-and-rear direction of the vehicle body 201, and a distance Dz between a lower surface of the antenna element 212 and an upper surface of the spoiler fixing section 254 are determined as shown in (a) and (b) of FIG. 31.

In the series of Examples, Ly=60 mm and Dz=10 mm are employed, and a radiant gain of a vertically polarized wave in an xy plane is calculated with use of the model illustrated in FIGS. 30 and 31, concerning the on-vehicle antenna devices 210 which are obtained by changing the shortest distance Dx within a range of 0 mm≤Dx≤400 mm. A frequency of a high frequency signal inputted to the antenna element 212 is 832 MHz. From this, the wavelength λo of the center frequency in the operating band of the antenna element 212 is 360 mm in three significant figures.

FIG. 32 is a graph showing shortest distance Dx dependency of a forward radiant gain of the on-vehicle antenna device 210 mounted on the vehicle body 201 illustrated in FIG. 30. Here, the "forward radiant gain" indicates an average radiant gain obtained by averaging radiant gains of a vertically polarized wave in the xy plane within a range of ±30° with respect to a positive direction of the y-axis.

FIG. 32 also shows, as Comparative Example, a forward radiant gain of the on-vehicle antenna device 210 which is mounted on a vehicle body 1101 illustrated in FIG. 33. The vehicle body 1101 illustrated in FIG. 33 is obtained by removing the pillars 303*a* through 303*d* and the vertical pole

253*a* from the vehicle body 101 illustrated in FIG. 30. Note that the on-vehicle antenna device 210 mounted on the vehicle body 1101 illustrated in FIG. 33 also employs Ly=60 mm and Dz=10 mm.

The forward radiant gain of the on-vehicle antenna device 210 mounted on the vehicle body 101 illustrated in FIG. 30 becomes maximum when Dx=175 mm. On the other hand, the forward radiant gain of the on-vehicle antenna device 210 mounted on the vehicle body 1101 illustrated in FIG. 33 substantially monotonically decreases as Dx increases from 0 mm.

As shown in the graph of FIG. 32, it has been found that the forward radiant gain, which is obtained in a case where the shortest distance Dx from the vertical pole 253*a* to the antenna element 212 is approximately ⅓ or more and ⅔ or less (more accurately, 36.1% or more and 69.4%) of the wavelength λo of the center frequency in the operating band of the antenna element 212, is greater than the forward radiant gain obtained in a case where the vertical pole 253*a* is omitted. This seems to be because, in a case where the shortest distance Dx from the vertical pole 253*a* to the antenna element 212 is set to ⅓ or more and ⅔ or less of the wavelength λo of the center frequency in the operating band of the antenna element 212, a vertically polarized wave radiated from the antenna element 212 in the forward direction and a vertically polarized wave radiated from the vertical pole 253 in the forward direction interfere with each other so as to reinforce each other.

Moreover, as shown in the graph of FIG. 32, it has been found that the forward radiant gain becomes maximum when the shortest distance Dx from the vertical pole 253*a* to the antenna element 212 is set to approximately ½ (more accurately, 48.6%) of the wavelength λo of the center frequency in the operating band of the antenna element 212.

[Modified Example 15]

The following description will discuss, with reference to FIG. 34, Modified Example 15 of on-vehicle antenna devices 210 in accordance with the series of Examples. FIG. 34 is a graph showing shortest distance Dx dependency of a forward radiant gain of on-vehicle antenna devices 210 in accordance with Modified Example 15 and shortest distance Dx dependency of the forward radiant gain of the on-vehicle antenna devices 210 in accordance with the series of Examples.

The on-vehicle antenna devices 210 in accordance with Modified Example 15 are obtained by changing, in the on-vehicle antenna devices 210 of the series of Examples, the distance Dz from 10 mm to 5 mm. That is, in Modified Example 15, Ly=60 mm and Dz=5 mm are employed, and a forward radiant gain is calculated with use of the model illustrated in FIGS. 30 and 31, concerning the on-vehicle antenna devices 210 which are obtained by changing the shortest distance Dx within a range of 100 mm≤Dx≤300 mm.

The graph of FIG. 34 shows that the forward radiant gains of the on-vehicle antenna devices 210 in accordance with Modified Example 15 are greater than the forward radiant gains of the on-vehicle antenna devices 210 in accordance with the series of Examples in the entire range of 100 mm≤Dx≤300 mm. Therefore, it has been found that the distance Dz in the on-vehicle antenna device 210 in accordance with Embodiment 7 is not limited to 10 mm and can be set as appropriate.

A reason why the forward radiant gain of the on-vehicle antenna device 210 is enhanced by changing the distance Dz from 10 mm to 5 mm seems to be because an induced current flowing in the spoiler fixing section 254 and the vertical pole 253*a* becomes greater as the antenna element 212 comes near to the spoiler fixing section 254, and accordingly a vertically polarized wave component radiated from the vertical pole 253*a* is increased.

[Modified Examples 16 and 17]

The following description will discuss, with reference to FIG. 35, Modified Examples 16 and 17 of the on-vehicle antenna devices 210 in accordance with the series of Examples. FIG. 35 is a graph showing shortest distance Dx dependency of forward radiant gains of on-vehicle antenna devices 210 in accordance with Modified Example 16 and on-vehicle antenna devices 210 in accordance with Modified Example 17.

The on-vehicle antenna devices 210 in accordance with Modified Example 16 are obtained by changing, in the on-vehicle antenna devices 210 of the series of Examples, the length Ly from 60 mm to 70 mm. That is, in Modified Example 16, Ly=70 mm and Dz=10 mm are employed, and a forward radiant gain is calculated with use of the model illustrated in FIGS. 30 and 31, concerning the on-vehicle antenna devices 210 which are obtained by changing the shortest distance Dx within a range of 0 mm≤Dx≤400 mm.

The on-vehicle antenna devices 210 in accordance with Modified Example 17 are obtained by changing, in the on-vehicle antenna devices 210 of the series of Examples, the length Ly from 60 mm to 50 mm. That is, in Modified Example 17, Ly=50 mm and Dz=10 mm are employed, and a forward radiant gain is calculated with use of the model illustrated in FIGS. 30 and 31, concerning the on-vehicle antenna devices 210 which are obtained by changing the shortest distance Dx within a range of 0 mm≤Dx≤400 mm.

As shown in FIG. 35, the forward radiant gains of the on-vehicle antenna devices 210 in accordance with Modified Example 16 and the forward radiant gains of the on-vehicle antenna devices in accordance with Modified Example 17 are slightly lower than but are similar in tendency to those of the on-vehicle antenna devices in accordance with the series of Examples. Therefore, it has been found that the length Ly in the on-vehicle antenna device 210 in accordance with Embodiment 7 is not limited to 60 mm and can be set as appropriate.

Note that, in view of the forward radiant gains obtained by the on-vehicle antenna devices 210 in accordance with the series of Examples, Modified Example 16, and Modified Example 17, the length Ly of the overlapping section 212*dl* in the front-and-rear direction of the vehicle body 101 is preferably 60 mm. In other words, the length Ly is preferably ⅓ of the wavelength λo of the center frequency in the operating band. It has been found that, according to the configuration, it is possible to further enhance a forward radiant gain of a vertically polarized wave in the forward direction of the vehicle body 101 by utilizing the vertical pole 253*a*.

[Main Points]

As above described, the on-vehicle antenna device in accordance with an embodiment is an on-vehicle antenna device which is to be provided at an end part of a roof of a vehicle body, the on-vehicle antenna device including: an antenna having antenna elements which include a first antenna element and a second antenna element, the first antenna element being drawn out from one feed point of a pair of feed points in a first direction, and the second antenna element being drawn out from another feed point of the pair of feed points in a second direction which is different from the first direction; or an antenna having a single antenna element which is drawn out from one feed point of a pair of feed points in a first direction and is drawn out from another feed point of the pair of feed points in a second direction which is different from the first direction. The first direction is a direction intersecting with a horizontal plane in a case where the on-vehicle antenna device is mounted on the vehicle body.

According to the configuration, the first direction in which the antenna element is drawn out from the one feed point is a direction (e.g., a direction perpendicular to the roof) intersecting with the horizontal plane in a case where the on-vehicle antenna device is mounted on the vehicle body. It is therefore possible to increase a ratio of a vertically polarized wave component contained in a radiated electromagnetic wave, as compared with a conventional technique (i.e., the on-vehicle antenna device disclosed in Patent Literature 1).

The vertically polarized wave is hardly subjected to a damping effect by a roof, as compared with a horizontally polarized wave. Therefore, according to the configuration, it is possible to provide the on-vehicle antenna device whose radiant gain in the direction going across the roof is larger than that of a conventional technique. For example, in a case where the on-vehicle antenna device is provided at a rear end of the roof, it is possible to provide the on-vehicle antenna device whose radiant gain in the forward direction of the vehicle body is larger than that of a conventional technique.

In the on-vehicle antenna device in accordance with an embodiment, it is preferable that the second direction is a direction along the horizontal plane in a case where the on-vehicle antenna device is mounted on the vehicle body.

According to the configuration, it is possible to radiate an electromagnetic wave which contains both a vertically polarized wave component and a horizontally polarized wave component.

In the on-vehicle antenna device in accordance with an embodiment, it is preferable that the antenna element further includes an overlapping section which (i) lies along a metallic member constituting the end part of the roof and (ii) overlaps with the metallic member while being apart from the metallic member.

According to the configuration, it is possible to use the roof, which is made of an electric conductor, as a ground for the antenna element. This makes it possible to enhance a radiant gain in the direction going across the vehicle body.

In the on-vehicle antenna device in accordance with an embodiment, it is preferable that a width of a part of the antenna element which part is drawn out from the one feed point in the first direction is ½ or less of a shortest wavelength of an electromagnetic wave which is radiated from the antenna.

According to the configuration, it is possible to restrict a direction, in which an electric current flows in the antenna element in the vicinity of the one feed point, to the first direction. It is therefore possible to provide an on-vehicle antenna device whose radiant gain in the direction going across the roof is further greater than that of a conventional technique.

In the on-vehicle antenna device in accordance with an embodiment, it is preferable that the antenna is a dipole antenna.

According to the configuration, in an on-vehicle antenna device in which the dipole antenna is incorporated, it is possible to provide the on-vehicle antenna device whose radiant gain in the direction going across the roof is greater than that of a conventional technique.

In the on-vehicle antenna device in accordance with an embodiment, it is preferable that the first antenna element has (i) a first part which is provided in a first surface that intersects with the horizontal plane and (ii) a second part which is provided in a second surface that intersects with the first surface; and the second antenna element is provided in a third surface which lies along the horizontal plane and faces with the second surface.

According to the configuration, the antenna element can be bent into a U-shape, and it is therefore possible to reduce a volume of a space required for providing the antenna element. From this, it is possible to provide an on-vehicle antenna device which is smaller in size, as compared with a case where the antenna element is not bent.

In the on-vehicle antenna device in accordance with an embodiment, it is preferable that the second antenna element has a shape in which a notch or a recess is provided in a longer side part of a rectangular shape.

By providing a notch or a recess in the longer side part of the second antenna element having a rectangular shape, it is possible to secure a long contour part (referred to as longer edge) which corresponds to the longer side part of the second antenna element. From this, it is possible to secure a length of the longer edge in accordance with, for example, a band on a low-frequency side in the operating band of the on-vehicle antenna device. This makes it possible to effectively broaden the operating band of the antenna particularly to the low-frequency side.

In the on-vehicle antenna device in accordance with an embodiment, it is preferable that the one feed point is provided in the third surface in a vicinity of an intersection between the third surface and the first surface; and, in a plan view of the antenna element viewed from a direction perpendicular to the third surface, the one feed point and the second part do not overlap with each other.

According to the configuration, the second part of the first antenna element is configured not to overlap with the feed point (one feed point) of the first antenna element, and this makes it possible to reduce an electrostatic capacitance that is generated between the second part and the feed point in the first antenna element. As a result, it is possible to inhibit deterioration in radiation characteristic caused by bending the antenna from a state of being flatly developed.

As above described, in the on-vehicle antenna device in accordance with an embodiment, it is preferable that, in the plan view of the antenna element viewed from the direction perpendicular to the third surface, the second antenna element and the second part do not overlap with each other.

As above described, the on-vehicle antenna device in accordance with an embodiment is an on-vehicle antenna device which is to be provided at an end part of a roof of a vehicle body, the on-vehicle antenna device including: an antenna having a first antenna element and a second antenna element, the first antenna element being drawn out from one feed point of a pair of feed points in a first direction which intersects with a horizontal plane in a case where the on-vehicle antenna device is mounted on the vehicle body, and the second antenna element being drawn out from another feed point of the pair of feed points in a second direction which goes along the horizontal plane in a case where the on-vehicle antenna device is mounted on the vehicle body. The second antenna element includes an overlapping section which (i) lies along a metallic member constituting the end part of the roof, (ii) overlaps with the metallic member while being apart from the metallic member, and (iii) includes an end of the second antenna element, and a length of the overlapping section is 64.5% or less of a total length of the second antenna element.

According to the configuration, it is possible to enhance a gain in a direction going across the roof from the on-vehicle antenna device (e.g., in a case where the on-vehicle antenna device is provided at the rear end part of the roof of the vehicle body, a gain in the forward direction of the vehicle body), as compared with a case where the first antenna element does not overlap with the metallic member.

In the on-vehicle antenna device in accordance with an embodiment, it is preferable that a distance between the first antenna element and the metallic member in the overlapping section is less than 18 mm.

According to the configuration, it is possible to enhance a gain in a direction going across the roof from the on-vehicle antenna device, as compared with a case where the first antenna element does not overlap with the metallic member.

As above described, the on-vehicle antenna device in accordance with an embodiment is an on-vehicle antenna device which is to be mounted at an end part of a roof of a vehicle body, the on-vehicle antenna device including: an antenna having an antenna element which includes a first antenna element and a second antenna element, the first antenna element being drawn out from one feed point of a pair of feed points in a first direction which intersects with a horizontal plane in a case where the on-vehicle antenna device is mounted on the vehicle body, and the second antenna element being drawn out from another feed point of the pair of feed points in a second direction which is different from the first direction in a case where the on-vehicle antenna device is mounted on the vehicle body. In a case where the on-vehicle antenna device is mounted on the vehicle body, a location of the antenna element in the on-vehicle antenna device is determined such that: (1) at least part of the antenna element lies along a metallic member constituting the end part of the roof and overlaps with the metallic member while being apart from the metallic member, and (2) a shortest distance from a structure, which is made of metal, is electrically connected with the end part of the roof, and extends in a direction intersecting with the horizontal plane, to the antenna element becomes ⅓ or more and ⅔ or less of a wavelength of a center frequency in an operating band of the antenna element.

In a case where a high-frequency current flows in a part of the antenna element which part is drawn out in the first direction intersecting with the roof, a vertically polarized wave is radiated from the part. Moreover, in a case where a high-frequency current flows in a part of the antenna element which part overlaps with the roof, an induced current flows in the roof and the structure, and consequently a vertically polarized wave is radiated from the structure.

According to the inventors' finding obtained from the studies, a gain of a vertically polarized wave in the direction going across the roof from the antenna element, which gain is obtained in a case where the shortest distance from the structure to the antenna element is ⅓ or more and ⅔ or less of the wavelength of the center frequency in the operating band of the antenna element, is greater than a gain of the vertically polarized wave obtained in a case where the structure is not provided. This seems to be because, in a case where the shortest distance from the structure to the antenna element is set to ⅓ or more and ⅔ or less of the wavelength of the center frequency in the operating band, in the direction going across the roof from the antenna element, a vertically polarized wave radiated from the antenna element and a vertically polarized wave radiated from the structure interfere with each other so as to reinforce each other.

That is, according to the configuration, it is possible to provide the on-vehicle antenna device in which a gain of a vertically polarized wave in the direction going across the roof from the antenna element is enhanced by utilizing the metallic structure (e.g., pillar) which constitutes the vehicle body.

In the on-vehicle antenna device in accordance with an embodiment, the structure can be a pillar.

According to the configuration, it is possible to enhance a gain in the direction going across the roof from the antenna element with use of the pillar which is an original constituent member of the vehicle. That is, it is possible to enhance a gain of a vertically polarized wave in the direction going across the roof from the antenna element, without adding a new constituent member to the vehicle.

In the on-vehicle antenna device in accordance with an embodiment, it is preferable that a housing of the on-vehicle antenna device is a spoiler; or the on-vehicle antenna device is used as a spoiler of the vehicle body.

According to the configuration, it is possible to provide an on-vehicle antenna device whose radiant gain in the direction going across the roof from the antenna element is greater than that of a conventional technique, without impairing beauty and an aerodynamic characteristic of the vehicle body and without influencing the appearance of the vehicle body at all.

The present invention is not limited to the embodiments, but can be altered by a skilled person in the art within the scope of the claims. An embodiment derived from a proper combination of technical means each disclosed in a different embodiment is also encompassed in the technical scope of the present invention.

INDUSTRIAL APPLICABILITY

The present invention is applicable to an on-vehicle antenna device which is provided at an end part of a roof of a vehicle body.

REFERENCE SIGNS LIST

1, 101, 201: Vehicle body
10, 10A, 30, 60, 90, 110, 210: On-vehicle antenna device
11, 11A, 31, 41, 51, 61, 71, 71A, 71B, 81, 91A, 91B, 111, 214: Antenna
12, 12A, 32, 42, 52, 62, 72, 82, 112, 213: Dielectric film
13, 13A, 33, 43, 53, 63, 73, 83, 93A, 93B, 113, 212: Connection section
13*a*, 33*a*, 43*a*, 53*a*, 63*a*, 73*a*, 73Aa, 73Ba, 83*a*, 93Aa, 93Ba, 113*a*, 212*b*1: First feed point (one feed point)
13*b*, 33*b*, 43*b*, 53*b*, 63*b*, 73*b*, 73Ab, 73Bb, 83*b*, 93Ab, 93Bb, 113*b*, 212*b*2: Second feed point (another feed point)
14, 14A, 34, 64, 74, 74A, 74B, 94A, 94B, 115, 212*c*: First antenna element
14*a*, 14Aa, 34*a*, 64*a*, 74*a*, 74Aa, 74Ba, 85*a*, 114*a*, 212*c*1: Feed point vicinity (part drawn out in first direction)
15, 15A, 35, 65, 75, 75A, 75B, 95A, 95B, 114, 212*d*: Second antenna element
15*a*, 15Aa, 55*a*, 75*a*, 86*a*, 115*a*: Feed point vicinity (part drawn out in second direction)
16, 16A, 16', 66, 211: Spoiler
20, 120, 202: Roof
21, 121, 205: Hatch gate
21*a*, 121*a*, 251: Hatch gate panel
21*b*, 121*b*, 252: Rear glass
21*c*, 121*c*, 253: Frame body
21*d*, 121*d*, 254: Spoiler fixing section (antenna device fixing section)

35*b*, 44*b*, 54*b*, 65*b*, 75*b*, 84*b*, 95Aa, 95Ba, 212*d*1: Overlapping section
44, 54, 84: Antenna element
55, 85: First conductor (antenna element)
56, 86: Second conductor (antenna element)
57, 87: Third conductor (antenna element)
115*d*: Neck section
203: Pillar
203*a* through 203*d*: A-pillar through D-pillar
204*a* through 204*c*: Windowpane
212: Antenna element
P1: First plane (first surface)
P2: Second plane (second surface)
P3: Third plane (third surface)

The invention claimed is:

1. An on-vehicle antenna device which is to be provided at an end part of a roof of a vehicle body, said on-vehicle antenna device comprising:

an antenna having antenna elements which include a first antenna element and a second antenna element, the first antenna element being drawn out from one feed point of a pair of feed points in a first direction, and the second antenna element being drawn out from another feed point of the pair of feed points in a second direction which is different from the first direction, the first direction being a direction intersecting with a horizontal plane in a case where said on-vehicle antenna device is mounted on the vehicle body, the first antenna element having (i) a first part which is provided in a first surface that intersects with the horizontal plane and (ii) a second part which is provided in a second surface that intersects with the first surface, and the second antenna element being provided in a third surface which lies along the horizontal plane and faces with the second surface.

2. The on-vehicle antenna device as set forth in claim 1, wherein:

the second direction is a direction along the horizontal plane in a case where said on-vehicle antenna device is mounted on the vehicle body.

3. The on-vehicle antenna device as set forth in claim 1, wherein:

the first antenna element or the second antenna element further includes an overlapping section which (i) lies along a metallic member constituting the end part of the roof and (ii) overlaps with the metallic member while being apart from the metallic member.

4. The on-vehicle antenna device as set forth in claim 1, wherein:

a width of a part of the first antenna element which part is drawn out from the one feed point in the first direction is ½ or less of a shortest wavelength of an electromagnetic wave which is radiated from the antenna.

5. The on-vehicle antenna device as set forth in claim 1, wherein:

the antenna is a dipole antenna including the first antenna element and the second antenna element.

6. The on-vehicle antenna device as set forth in claim 1, wherein:

the second antenna element has a shape in which a notch or a recess is provided in a longer side part of a rectangular shape.

7. The on-vehicle antenna device as set forth in claim 1, wherein:

the one feed point is provided in the third surface in a vicinity of an intersection between the third surface and the first surface; and in a plan view of the antenna element viewed from a direction perpendicular to the third surface, the one feed point and the second part do not overlap with each other.

8. The on-vehicle antenna device as set forth in claim 7, wherein:

in the plan view of the antenna element viewed from the direction perpendicular to the third surface, the second antenna element and the second part do not overlap with each other.

9. The on-vehicle antenna device as set forth in claim 1, wherein:

a housing of said on-vehicle antenna device is a spoiler; or said on-vehicle antenna device is used as a spoiler of the vehicle body.

10. An on-vehicle antenna device which is to be provided at an end part of a roof of a vehicle body, said on-vehicle antenna device comprising:

an antenna having a first antenna element and a second antenna element, the first antenna element being drawn out from one feed point of a pair of feed points in a first direction which intersects with a horizontal plane in a case where said on-vehicle antenna device is mounted on the vehicle body, and the second antenna element being drawn out from another feed point of the pair of feed points in a second direction which goes along the horizontal plane in a case where said on-vehicle antenna device is mounted on the vehicle body, the first antenna element having (i) a first part which is provided in a first surface that intersects with the horizontal plane and (ii) a second part which is provided in a second surface that intersects with the first surface, the second antenna element being provided in a third surface which lies along the horizontal plane and faces with the second surface, and the second antenna element including an overlapping section which (i) lies along a metallic member constituting the end part of the roof, (ii) overlaps with the metallic member while being apart from the metallic member, and (iii) includes an end of the second antenna element, and a length of the overlapping section being 64.5% or less of a total length of the second antenna element.

11. The on-vehicle antenna device as set forth in claim 10, wherein:

a distance between the second antenna element and the metallic member in the overlapping section is less than 18 mm.

12. An on-vehicle antenna device which is to be mounted at an end part of a roof of a vehicle body, said on-vehicle antenna device comprising:

an antenna having an antenna element which includes a first antenna element and a second antenna element, the first antenna element being drawn out from one feed point of a pair of feed points in a first direction which intersects with a horizontal plane in a case where said on-vehicle antenna device is mounted on the vehicle body, and the second antenna element being drawn out from another feed point of the pair of feed points in a second direction which is different from the first direction in a case where said on-vehicle antenna device is mounted on the vehicle body, in a case where said on-vehicle antenna device is mounted on the vehicle body, a location of the antenna in the on-vehicle antenna device being determined such that:

(1) the first antenna element has (i) a first part which is provided in a first surface that intersects with the horizontal plane and (ii) a second part which is provided in a second surface that intersects with the first surface, (2) the second antenna element is provided in a third surface which lies along the horizontal plane and faces with the second surface, (3)at least part of the second antenna element lies along a metallic member constituting the end part of the roof and overlaps with the metallic member while being apart from the metallic member, and (4) a shortest distance from a structure, which is made of metal, is electrically connected with the end part of the roof, and extends in a direction intersecting with the horizontal plane, to the second antenna element becomes ⅓ or more and ⅔ or less of a wavelength of a center frequency in an operating band of the second antenna element.

13. The on-vehicle antenna device as set forth in claim 12, wherein the structure is a pillar.

* * * * *